US008407815B2

(12) United States Patent
Meschter et al.

(10) Patent No.: US 8,407,815 B2
(45) **Date of Patent: *Apr. 2, 2013**

(54) APPAREL INCORPORATING TENSILE STRANDS

(75) Inventors: James C. Meschter, Portland, OR (US); Sebastian Huff, Portland, OR (US); Rachel Ellen Bradstreet, Washougal, WA (US)

(73) Assignee: NIKE, Inc., Beaverton, OR (US)

( * ) Notice: Subject to any disclaimer, the term of this patent is extended or adjusted under 35 U.S.C. 154(b) by 326 days.

This patent is subject to a terminal disclaimer.

(21) Appl. No.: 12/860,506

(22) Filed: Aug. 20, 2010

(65) Prior Publication Data

US 2012/0036614 A1 Feb. 16, 2012

Related U.S. Application Data

(60) Provisional application No. 61/373,447, filed on Aug. 13, 2010.

(51) Int. Cl.
*A41D 1/06* (2006.01)
*A41F 9/00* (2006.01)

(52) U.S. Cl. ..... 2/236; 2/227; 2/228; 2/238

(58) Field of Classification Search ..... 2/236, 237, 2/220, 221, 238, 400, 67, 79, 219, 227, 228, 2/235, 401, 404, 407, 402, 338, 272, 69, 2/243.1

See application file for complete search history.

(56) References Cited

U.S. PATENT DOCUMENTS

| | | | | | |
|---|---|---|---|---|---|
| 508,429 | A | * | 11/1893 | Lewis | 66/173 |
| 1,499,647 | A | * | 7/1924 | Emsley | 2/236 |
| 1,592,732 | A | * | 7/1926 | Friedman | 602/69 |
| 1,788,809 | A | * | 1/1931 | Stein | 2/237 |
| 1,825,271 | A | * | 9/1931 | Karberg | 2/237 |
| 1,868,212 | A | * | 7/1932 | Lewis | 2/236 |
| 1,951,450 | A | * | 3/1934 | Sochel | 2/237 |
| 2,034,091 | A | | 3/1936 | Dunbar | |

(Continued)

FOREIGN PATENT DOCUMENTS

| | | |
|---|---|---|
| CN | 101125044 A | 2/2008 |
| DE | 20215559 | 1/2003 |

(Continued)

OTHER PUBLICATIONS

International Search Report for PCT/US2011/047167 mailed on Dec. 23, 2011.

(Continued)

*Primary Examiner* — Amy Vanatta
(74) *Attorney, Agent, or Firm* — Plumsea Law Group, LLC

(57) ABSTRACT

An article of apparel may include a waistband for extending around a waist of the wearer. The waistband may have a first layer and a second layer that lay adjacent to each other, and the waistband may have a plurality of strand segments located between the first layer and the second layer. The strand segments extend at least partially around the waistband. Additionally, the strand segments may lay substantially parallel to surfaces of the first layer and the second layer for distances of at least five centimeters. In some configurations, the strand segments may be bonded to the first layer and the second layer along the distances of at least five centimeters.

22 Claims, 52 Drawing Sheets

U.S. PATENT DOCUMENTS

| | | | | |
|---|---|---|---|---|
| 2,048,294 | A | 7/1936 | Roberts | |
| 2,205,356 | A | 6/1940 | Gruensfelder | |
| 2,311,996 | A | 2/1943 | Parker | |
| 2,632,177 | A * | 3/1953 | McFerin | 2/406 |
| 3,439,434 | A | 4/1969 | Tangorra | |
| 3,571,814 | A | 3/1971 | Miller | |
| 3,672,078 | A | 6/1972 | Fukuoka | |
| 3,823,493 | A | 7/1974 | Brehm et al. | |
| 4,400,832 | A * | 8/1983 | Kinder | 2/406 |
| 4,627,369 | A | 12/1986 | Conrad et al. | |
| 4,634,616 | A | 1/1987 | Musante | |
| 4,642,819 | A * | 2/1987 | Ales et al. | 2/400 |
| 4,756,098 | A | 7/1988 | Boggia | |
| 4,858,339 | A | 8/1989 | Hayafuchi et al. | |
| 4,873,725 | A | 10/1989 | Mitchell | |
| 4,938,753 | A * | 7/1990 | Van Gompel et al. | 604/385.29 |
| 5,149,388 | A | 9/1992 | Stahl | |
| 5,156,022 | A | 10/1992 | Altman | |
| 5,271,130 | A | 12/1993 | Batra | |
| 5,285,658 | A | 2/1994 | Altman et al. | |
| 5,304,162 | A * | 4/1994 | Kuen | 604/391 |
| 5,345,638 | A | 9/1994 | Nishida | |
| 5,359,790 | A | 11/1994 | Iverson et al. | |
| 5,367,795 | A | 11/1994 | Iverson et al. | |
| 5,380,480 | A | 1/1995 | Okine et al. | |
| 5,399,410 | A | 3/1995 | Urase | |
| 5,645,935 | A | 7/1997 | Kemper et al. | |
| 5,706,524 | A * | 1/1998 | Herrin et al. | 2/400 |
| 5,832,540 | A | 11/1998 | Knight | |
| D405,587 | S | 2/1999 | Merikoski | |
| 5,930,918 | A | 8/1999 | Healy | |
| 5,990,378 | A | 11/1999 | Ellis | |
| 6,003,247 | A | 12/1999 | Steffe | |
| 6,004,891 | A | 12/1999 | Tuppin et al. | |
| 6,009,637 | A | 1/2000 | Pavone | |
| 6,029,376 | A | 2/2000 | Cass | |
| 6,038,702 | A | 3/2000 | Knerr | |
| 6,128,835 | A | 10/2000 | Ritter | |
| 6,151,804 | A | 11/2000 | Hieblinger | |
| 6,164,228 | A | 12/2000 | Lin | |
| 6,170,175 | B1 | 1/2001 | Funk | |
| 6,213,634 | B1 | 4/2001 | Harrington et al. | |
| 6,615,427 | B1 | 9/2003 | Hailey | |
| 6,665,958 | B2 | 12/2003 | Goodwin | |
| 6,676,647 | B2 * | 1/2004 | Shimada et al. | 604/385.11 |
| 6,718,895 | B1 | 4/2004 | Fortuna | |
| 6,860,214 | B1 | 3/2005 | Wang | |
| 6,910,288 | B2 | 6/2005 | Dua | |
| 7,086,179 | B2 | 8/2006 | Dojan | |
| 7,086,180 | B2 | 8/2006 | Dojan | |
| 7,100,310 | B2 | 9/2006 | Foxen | |
| 7,278,174 | B2 * | 10/2007 | Villalobos | 2/227 |
| 7,293,371 | B2 | 11/2007 | Aveni | |
| 7,337,560 | B2 | 3/2008 | Marvin et al. | |
| 7,574,818 | B2 | 8/2009 | Meschter | |
| 7,665,230 | B2 | 2/2010 | Dojan | |
| 7,676,956 | B2 | 3/2010 | Dojan | |
| 7,849,518 | B2 | 12/2010 | Moore et al. | |
| 7,870,681 | B2 | 1/2011 | Meschter | |
| 7,870,682 | B2 | 1/2011 | Meschter et al. | |
| 2001/0051484 | A1 | 12/2001 | Ishida et al. | |
| 2003/0178738 | A1 | 9/2003 | Staub et al. | |
| 2004/0074589 | A1 | 4/2004 | Gessler et al. | |
| 2004/0118018 | A1 | 6/2004 | Dua | |
| 2004/0142631 | A1 | 7/2004 | Luk | |
| 2004/0181972 | A1 | 9/2004 | Csorba | |
| 2004/0225271 | A1 * | 11/2004 | Datta et al. | 604/385.11 |
| 2004/0261295 | A1 | 12/2004 | Meschter | |
| 2005/0028403 | A1 | 2/2005 | Swigart | |
| 2005/0115284 | A1 | 6/2005 | Dua | |
| 2005/0132609 | A1 | 6/2005 | Dojan | |
| 2005/0268497 | A1 | 12/2005 | Alfaro | |
| 2005/0273907 | A1 * | 12/2005 | Fontes | 2/235 |
| 2006/0048413 | A1 | 3/2006 | Sokolowski et al. | |
| 2006/0137221 | A1 | 6/2006 | Dojan | |
| 2007/0191796 | A1 * | 8/2007 | Vincent et al. | 604/358 |
| 2007/0199210 | A1 | 8/2007 | Vattes et al. | |
| 2007/0271821 | A1 | 11/2007 | Meschter | |
| 2008/0110049 | A1 | 5/2008 | Sokolowski et al. | |
| 2009/0038046 | A1 * | 2/2009 | Moore et al. | 2/67 |
| 2010/0018075 | A1 | 1/2010 | Meschter et al. | |
| 2010/0037483 | A1 | 2/2010 | Meschter et al. | |
| 2010/0043253 | A1 | 2/2010 | Dojan et al. | |
| 2010/0154256 | A1 | 6/2010 | Dua | |
| 2010/0175276 | A1 | 7/2010 | Dojan et al. | |
| 2010/0251491 | A1 | 10/2010 | Dojan et al. | |
| 2010/0251564 | A1 | 10/2010 | Meschter | |
| 2011/0041359 | A1 | 2/2011 | Dojan et al. | |

FOREIGN PATENT DOCUMENTS

| | | | |
|---|---|---|---|
| EP | 0082824 | | 6/1983 |
| EP | 0818289 | | 1/1998 |
| FR | 1462349 | A | 2/1967 |
| FR | 2046671 | | 3/1971 |
| FR | 2457651 | A1 | 12/1980 |
| WO | 9843506 | A1 | 10/1998 |
| WO | 03013301 | A1 | 2/2003 |
| WO | WO2004089609 | | 10/2004 |
| WO | WO2007139567 | | 12/2007 |
| WO | WO2007140055 | | 12/2007 |

OTHER PUBLICATIONS

Office Action in U.S. Appl. No. 12/860,468, mailed on Sep. 5, 2012.

* cited by examiner

APPAREL INCORPORATING TENSILE STRANDS

CROSS-REFERENCE TO RELATED APPLICATION

This non-provisional U.S. patent application claims priority under 35 U.S.C. §119(e)(1) to provisional U.S. Patent Application Ser. No. 61/373,447, which was filed in the U.S. Patent and Trademark Office on 13 Aug. 2010 and entitled Apparel Incorporating Tensile Strands, such provisional U.S. patent application being entirely incorporated herein by reference.

BACKGROUND

Articles of apparel are frequently formed from two or more types of textiles, as well as other elements, in order to impart different properties to different areas. Examples of properties that textiles may exhibit include resistance to abrasion and wear, air permeability, drape, hand, moisture absorption, stretch, and water resistance. Accordingly, combinations of textiles and other elements may be incorporated into articles of apparel in order to impart specific properties to areas of the apparel.

SUMMARY

An article of apparel is disclosed below as including a pelvic region and a pair of leg regions. The pelvic region is for covering a pelvic area of a wearer, whereas the leg regions are for covering at least a portion of leg areas of the wearer. The pelvic region includes a waistband for extending around a waist of the wearer, and the waistband has a first layer and a second layer that lay adjacent to each other. The waistband also includes a plurality of strand segments located between the first layer and the second layer. The strand segments extend at least partially around the waistband, and the strand segments lay substantially parallel to surfaces of the first layer and the second layer for distances of at least five centimeters. Additionally, the strand segments are bonded to the first layer and the second layer along the distances of at least five centimeters. The leg regions are for covering at least a portion of leg areas of the wearer.

The advantages and features of novelty characterizing aspects of the invention are pointed out with particularity in the appended claims. To gain an improved understanding of the advantages and features of novelty, however, reference may be made to the following descriptive matter and accompanying drawings that describe and illustrate various embodiments and concepts related to the invention.

FIGURE DESCRIPTIONS

The foregoing Summary of the Invention and the following Detailed Description of the Invention will be better understood when read in conjunction with the accompanying drawings.

DETAILED DESCRIPTION

The following discussion and accompanying figures disclose an article of apparel 100 having a configuration of a pair of board shorts or water shorts that may be utilized for aquatic activities (e.g., swimming, surfing, snorkeling). In further configurations, apparel 100 may have the structure of other types of shorts that are utilized during athletic activities, including basketball shorts, biking shorts, running shorts, soccer shorts, and swim suits, for example. Concepts associated with apparel 100 may also be applied to similar garments, including dress shorts, jeans, pants, skirts, slacks, tights, or various types of undergarments. Accordingly, the concepts associated with apparel 100 may be applied to a wide range of garment styles or configurations that are used for both athletic and non-athletic activities.

General Apparel Structure

Figure 1:
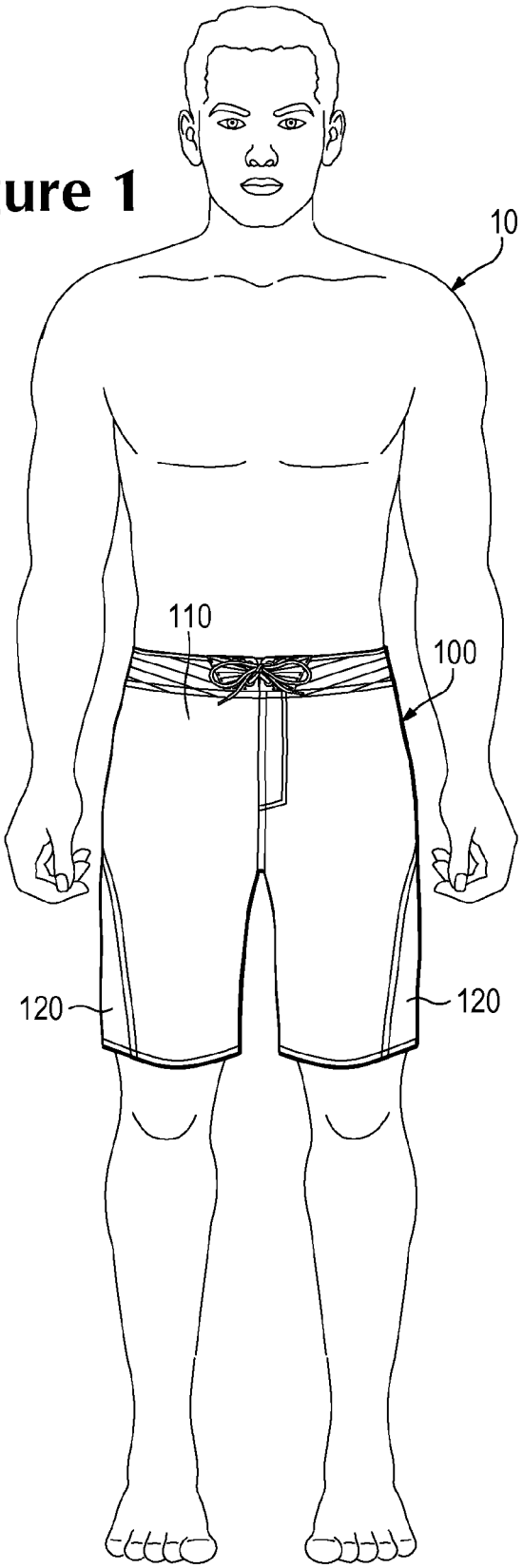
FIG. 1 is a front elevational view of an individual wearing an article of apparel.
Figure 2:
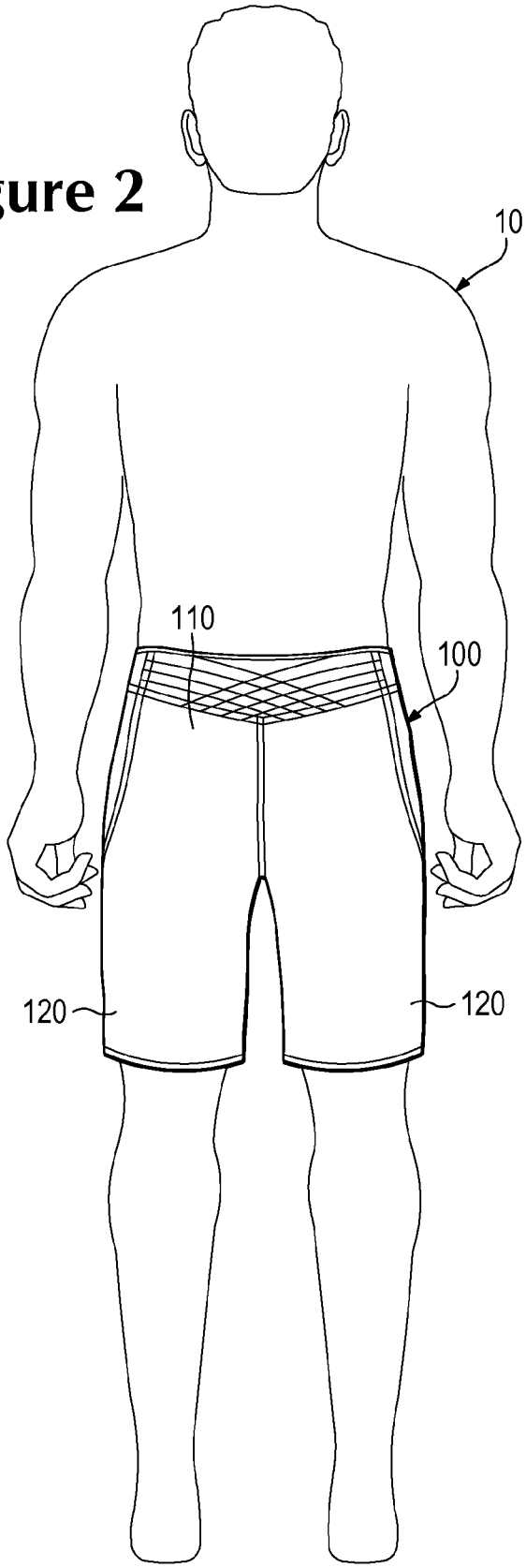
FIG. 2 is a rear elevational view of the individual wearing the article of apparel.
Figure 3:
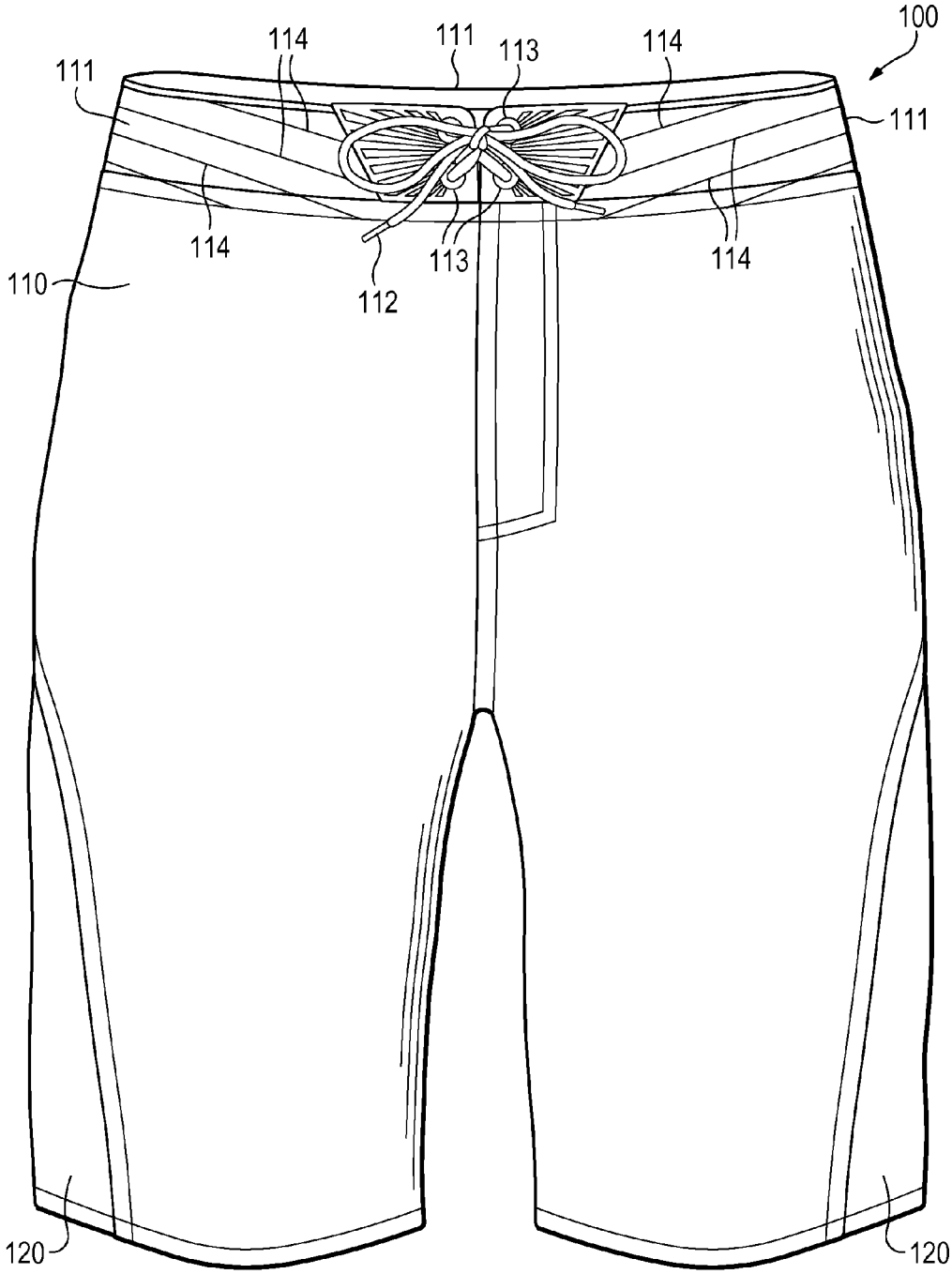
FIG. 3 is a front elevational view of the article of apparel.
Figure 4:
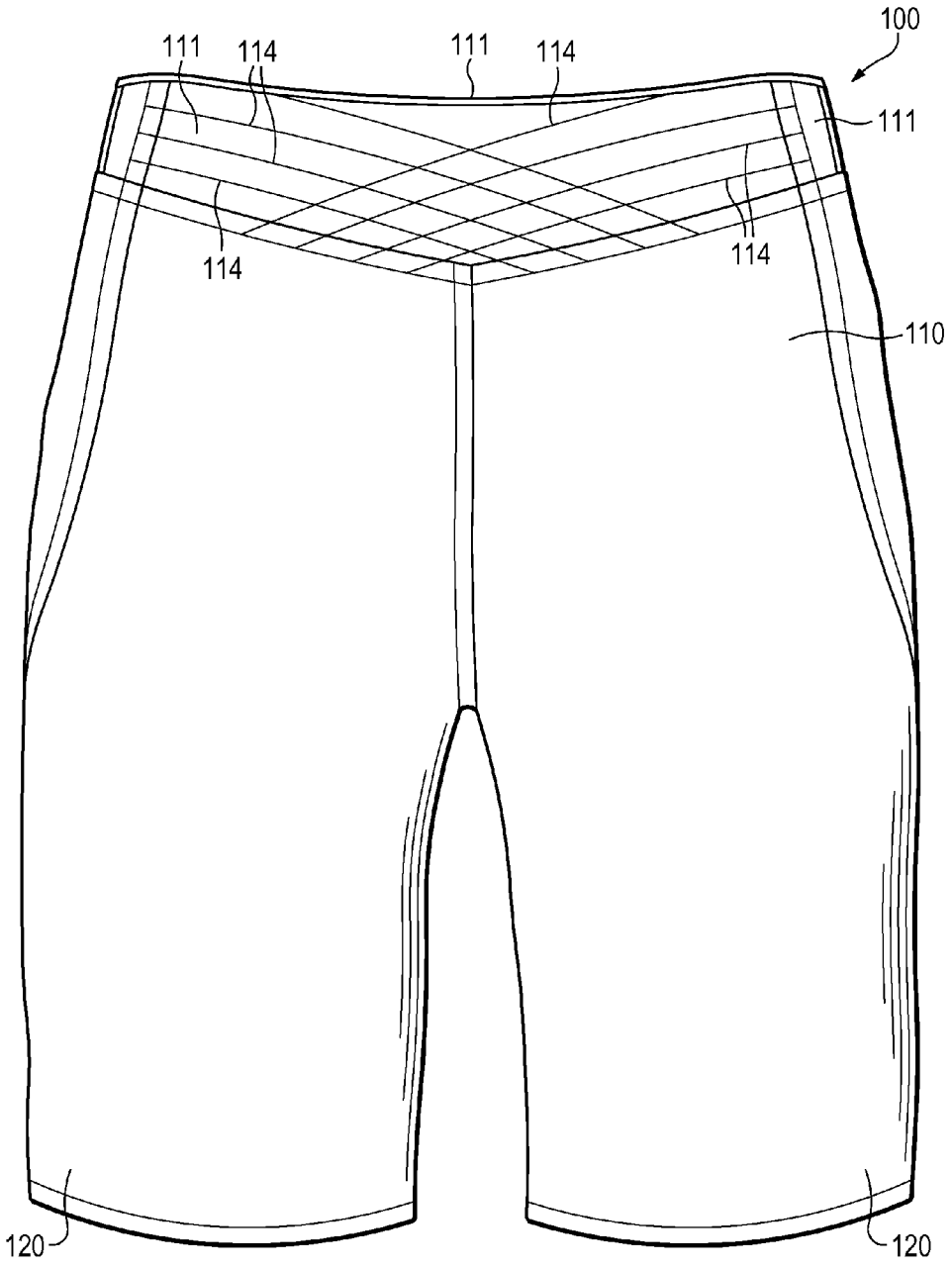
FIG. 4 is a rear elevational view of the article of apparel.

With reference to FIGS. 1 and 2, apparel 100 is depicted as being worn by an individual 10. Additionally, various views of apparel 100 in the absence of individual 10 are provided in FIGS. 3-6. Apparel 100 generally includes a pelvic region 110 and a pair of leg regions 120. Pelvic region 110 has a configuration that substantially extends around and covers a pelvic area of individual 10. Leg regions 120 extend downward from opposite sides of pelvic region 110 and have a configuration that substantially extends around and covers upper leg areas of individual 10.

A majority of apparel 100 is formed from various textile elements that are joined through stitching, adhesives, bonding, or thermobonding, for example, to define each of regions 110 and 120. The textile elements may be formed from either stretch textiles or non-stretch textiles. Although non-stretch textile elements may be utilized in apparel 100, an advantage to stretch textile elements is that portions of regions 110 and 120 will stretch or otherwise elongate to conform with movements of individual 10 during aquatic or land-based activities, thereby providing less restriction and a greater freedom of movement during the activities. The textile elements may also be formed from either woven or knitted textiles. Although knitted textile elements may be utilized in apparel 100, an advantage of utilizing woven textile elements relates to high durability and a low tendency to permanently deform when subjected to tensile forces (i.e., when stretched). A further advantage to woven textile elements, which benefits apparel 100 having the configuration of board shorts or water shorts, is that small spaces between yarns within the woven textile elements tend to hold a small quantity of water and exhibit little deformation as a result of being saturated with water. In some configurations, portions of apparel 100 may also include various appliqués, transfers, patches, indicia, tags, pulls, grommets, or other aesthetic or functional features.

Pelvic region 110 includes a waistband 111 that defines an upper opening out of which a torso area of individual 10 extends. With the exception of waistband 111, a majority of apparel 100 has a loose-fitting configuration. That is, apparel 100 is generally structured to be spaced from individual 10 or in loose contact with individual 10 when worn, rather than in tight-fitting contact with individual 10. A lace 112 extends through various apertures 113 in a front area of waistband 111, and lace 112 crosses between apertures 113. When apparel 100 is worn by individual 10, lace 112 may be utilized in a conventional manner to adjust the circumference of waistband 111, thereby tightening and loosening waistband 111. That is, lace 112 may be tensioned and tied to secure apparel 100 to individual 10, and lace 112 may be untied and loosened to assist in removing apparel 100 from individual 10. Although the combination of lace 112 and apertures 113 provides a suitable structure for adjusting the circumference of waistband 111, alternative fasteners that may be utilized in other configurations of apparel 100 include zippers, snaps, buttons, or hook and loop fasteners.

Various strand segments 114 extend through and around waistband 111 to limit stretch in waistband 111. Strand segments 114 operate in conjunction with lace 112 to tighten waistband 111 and secure apparel 100 to individual 10. Referring to FIGS. 3-6, strand segments 114 extend outward from the area where lace 112 and apertures 113 are located in the front area of waistband 111 and toward side areas of waistband 111. Additionally, further strand segments 114 extend from the side areas of waistband 111 to a rear area of waistband 111, where these strand segments 114 cross each other. In general, strand segments 114 may be less stretchable than the textile elements forming apparel 100, particularly in waistband 111. Given that strand segments 114 extend around waistband 114, therefore, strand segments 114 may be tensioned through the use of lace 112. That is, by placing tension upon lace 112, strand segments 114 may also be placed in tension to tighten waistband 111 and secure apparel 100 to individual 10. In effect, therefore, strand segments 114 form structural components in apparel 100 that resist stretch in the direction extending around waistband 111.

First Tensile Strand Element

Figure 7:
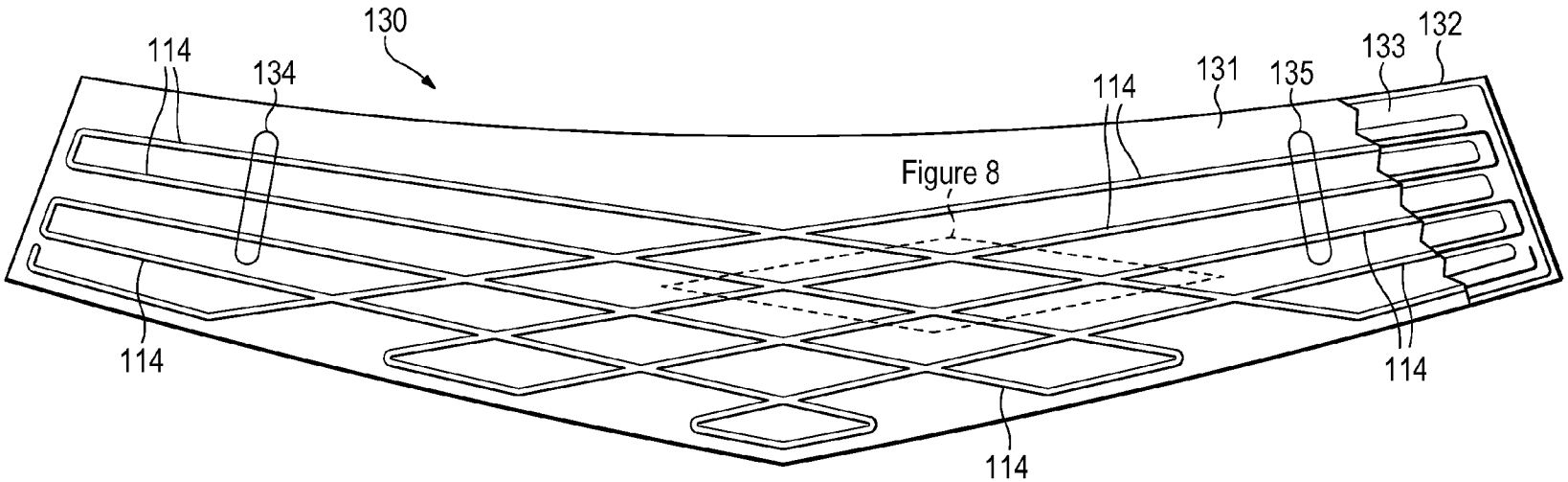
FIG. 7 is a plan view of a first tensile strand element that may be utilized in the article of apparel.
Figure 8:
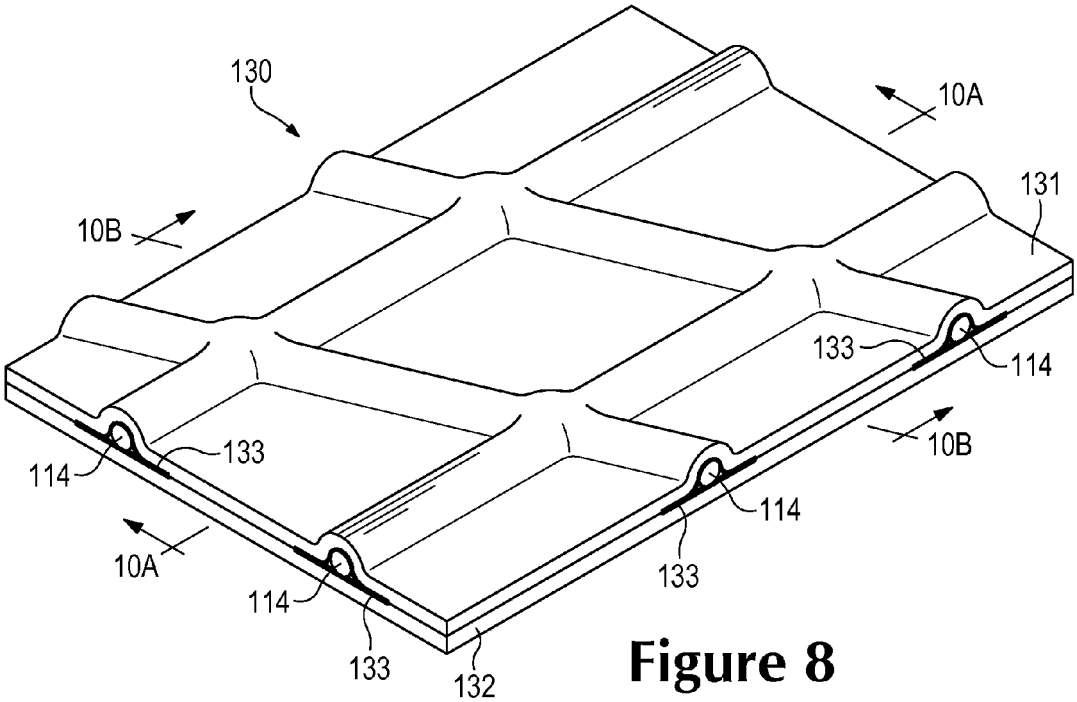
FIG. 8 is a perspective view of a portion of the first tensile strand element, as defined in FIG. 7.

A tensile strand element 130 that may be utilized in apparel 100 is depicted in FIG. 7. Additionally, a smaller portion of tensile strand element 130 is shown in FIGS. 8-10B to provide further detail. Tensile strand element 130 has a configuration that may form the rear area of waistband 111. Other tensile strand elements that form the front area of waistband 111 may have a similar structure. As an alternative, some configurations of apparel 100 may include a single tensile strand element, with a configuration that is similar to tensile strand element 130, that extends entirely around apparel 100 and forms the front area, the side areas, and the rear area of waistband 111.

Tensile strand element 130 includes a first layer 131, a second layer 132, a pair of securing elements 133, and the various strand segments 114. When incorporated into apparel 100, first layer 131 may form an outer surface of waistband 111 (i.e., a surface that faces away from individual 10) and second layer 132 may form an inner surface of waistband 111 (i.e., a surface that faces toward individual 10). As an example, each of layers 131 and 132 may be formed from textile elements, including either stretch or non-stretch textile elements and either woven or knitted textile elements. Moreover, the textile elements may be formed from a wide range of materials, including polyamide, polyester, nylon, spandex, wool, silk, cotton, or combinations of these materials, for example. Although a majority of apparel 100 may be formed from textile elements, one or both of layers 131 and 132 may also be formed from polymer sheets or a variety of other materials.

Figure 9:
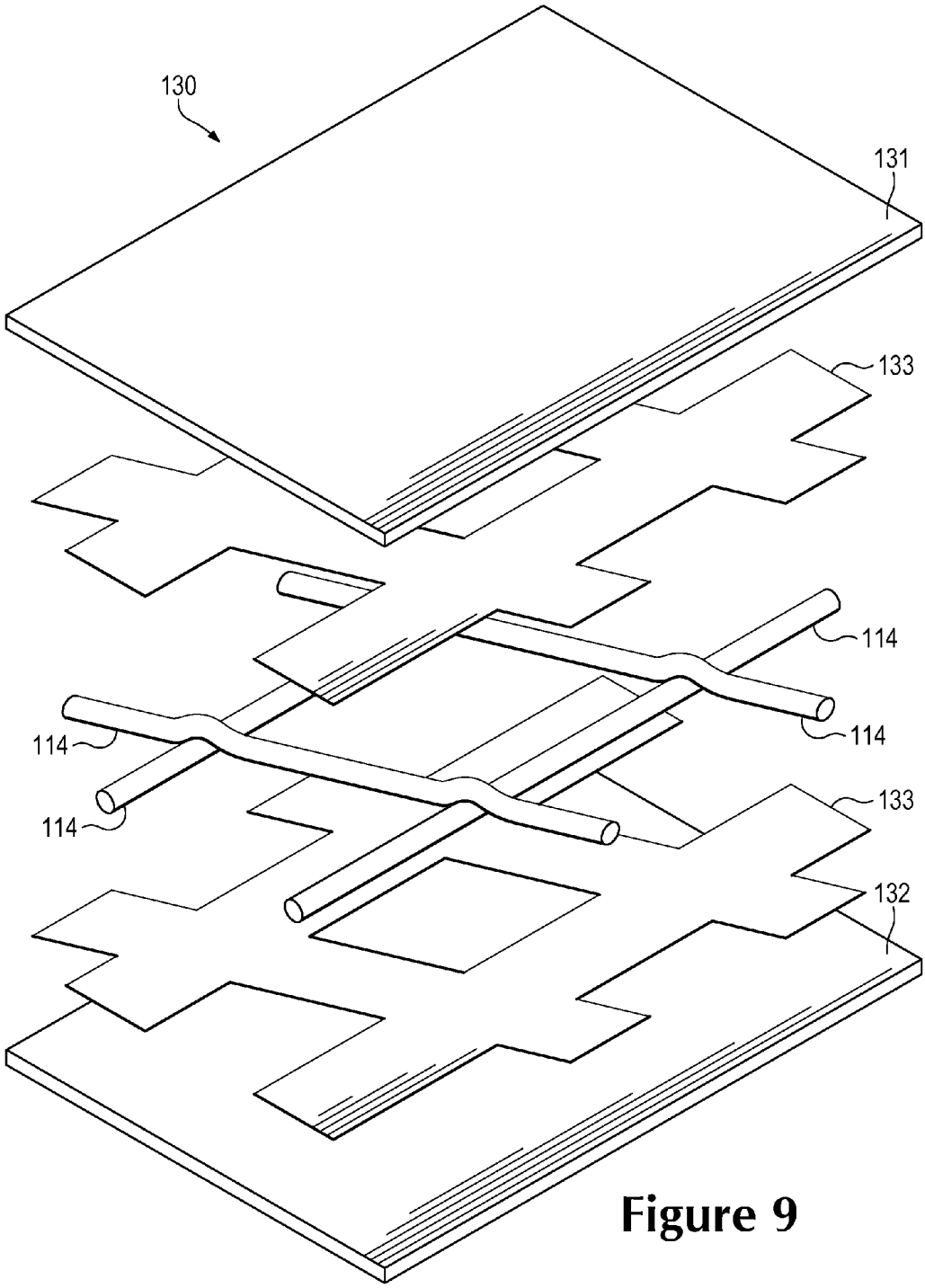
FIG. 9 is an exploded perspective view of the portion of the first tensile strand element.
Figure 10A:
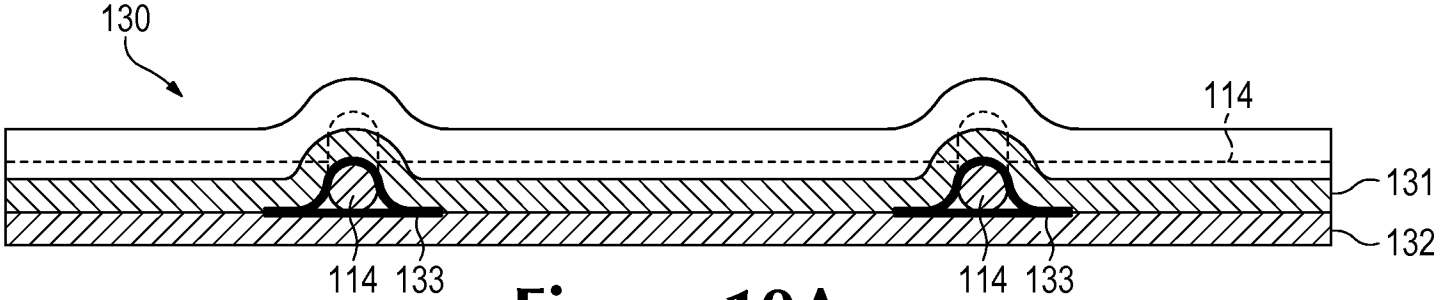
FIGS. 10A and 10B are cross-sectional views of the portion of the first tensile strand element, as defined by section lines 10A and 10B in FIG. 8.
Figure 10B:
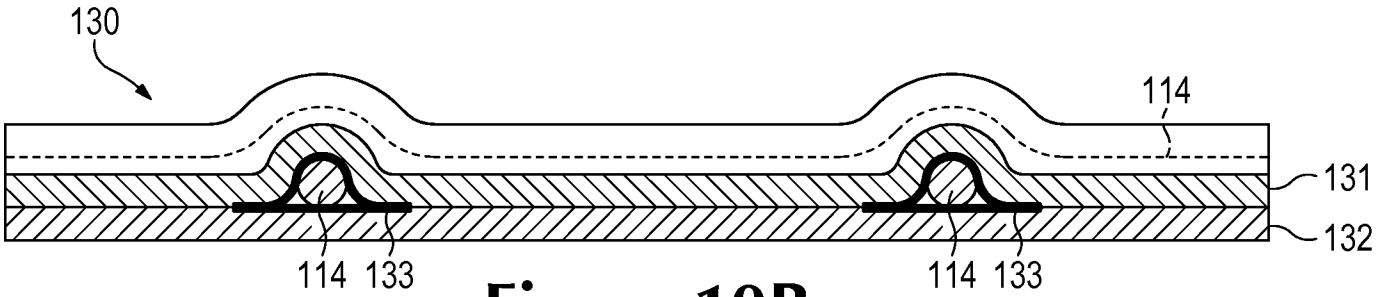

Securing elements 133 are positioned between layers 131 and 132 to (a) secure strand segments 114 within tensile strand element 130 and (b) join layers 131 and 132 to each other. Although securing elements 133 may be continuous sheets, securing elements 133 are depicted in FIG. 9 as defining apertures or spaces in areas between strand segments 114. An advantage of this configuration is that securing elements 133 are absent in areas where strand segments 114 are absent, thereby enhancing the breathability of waistband 111, increasing the flexibility of waistband 111, providing better conformance to the shape of individual 10, and reducing the overall mass of apparel 100. Although layers 131 and 132 may be secured to each other in areas where securing elements 133 are present, layers 131 and 132 may be unsecured in the areas where securing elements 133 are absent (i.e., the apertures or spaces).

Securing elements 133 may be formed as sheets of thermoplastic polymer material, such as polyurethane, polyamide, polyester, polyolefin, or vinyl. As an example, a suitable thermoplastic polymer material may be supplied by Bemis Associates, Inc. of Shirley, Mass., United States. When heated, the thermoplastic polymer material forming securing elements 133 may melt or otherwise soften, thereby infiltrating the structure of strand segments 114 and layers 131 and 132. Upon cooling, the thermoplastic polymer material hardens or otherwise solidifies to securely join layers 131 and 132 and secure strand segments 114. Securing elements 133 may also be replaced by an adhesive or other element that effectively joins the components of tensile strand element 130 together. Moreover, securing elements 133 may be absent in configurations where strand segments 114, first layer 131, or first layer 132 incorporates a thermoplastic polymer material or other adhesive that effectively joins the components of tensile strand element 130 together.

Strand segments 114 are positioned between securing elements 133 and between layers 131 and 132 to form a central portion of tensile strand element 130. Referring to FIG. 7, for example, strand segments 114 are portions of an individual strand that repeatedly pass across tensile strand element 130. That is, strand segments 114 are portions of a single strand within tensile strand element 130. In further configurations, strand segments 114 may be separate elements or separate sections of a strand within tensile strand element 130. Suitable materials for strand segments 114 include various filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel. Individual strand segments 114 may include two or more materials, and different strand segments 114 may be formed from different materials. The thicknesses of strand segments 114 may also vary significantly to range from 0.03 millimeters to more than 5 millimeters, for example, but are generally less than two millimeters.

Strand segments 114 lay adjacent to surfaces of first layer 131, second layer 132, and securing elements 133. Moreover, strand segments 114 are substantially parallel to the surfaces of first layer 131, second layer 132 and securing elements 133. As discussed above, strand segments 114 extend around waistband 111 to limit stretch. By being substantially parallel to the surfaces of first layer 131, second layer 132, and securing elements 133, strand segments 114 resist stretch in directions that correspond with these surfaces. That is, strand segments 114 resist stretch in the direction extending around waistband 111. Although strand segments 114 may extend through one or both of layers 131 and 132 in some locations (e.g., as a result of stitching), areas where strand segments 114 extend through layers 131 and 132 may permit stretch, thereby reducing the overall ability of strand segments 114 to limit stretch. As a result, strand segments 114 generally lay adjacent to and substantially parallel to surfaces of first layer 131, second layer 132, and securing elements 133 throughout distances of at least five centimeters or more. That is, strand segments 114 extend parallel to layers 131 and 132 and between layers 131 and 132 throughout distances of at least five centimeters or more to limit stretch in waistband 111. In many configurations, strand segments 114 are also bonded to layers 131 and 132 along the distances of at least five centimeters to ensure that strand segments 114 remain properly positioned within tensile strand element 130.

Based upon the above discussion, first layer 131 and second layer 132 lay adjacent to each other and strand segments 114 are located between first layer 131 and second layer 132. Although a variety of configurations are possible, strand segments 114 may extending at least partially around waistband 111. Moreover, strand segments 114 lay substantially parallel to surfaces of first layer 131 and second layer 132 for distances of at least five centimeters, and strand segments 114 may be bonded to first layer 131 and second layer 132 along the distances of at least five centimeters.

Structural Components

Strand segments 114 form structural components in apparel 100 that resist stretch around waistband 111. By resisting stretch, strand segments 114 have an effect upon the degree to which waistband 111 is tensioned to secure apparel 100 to individual 10. Various factors affect the ability of strand segments 114 to resist stretch in waistband 111, including (a) the properties of strand segments 114, (b) the extent to which strand segments 114 extend around waistband 111, and (c) the orientation and layout of strand segments 114. Each of these factors will be discussed in detail below.

The properties of strand segments 114 affect the ability of strand segments 114 to resist stretch in waistband 111. As discussed above, strand segments 114 may be formed from various materials and may have various thicknesses. By selecting particular materials and thicknesses for strand segments 114, a specific degree of stretch may be imparted to apparel 100 in waistband 111. Moreover, the materials utilized for strand segments 114 may be selected based upon their tensile strengths, modulus of elasticity, mass, and ability to bond with securing elements 133, for example.

Figure 5:
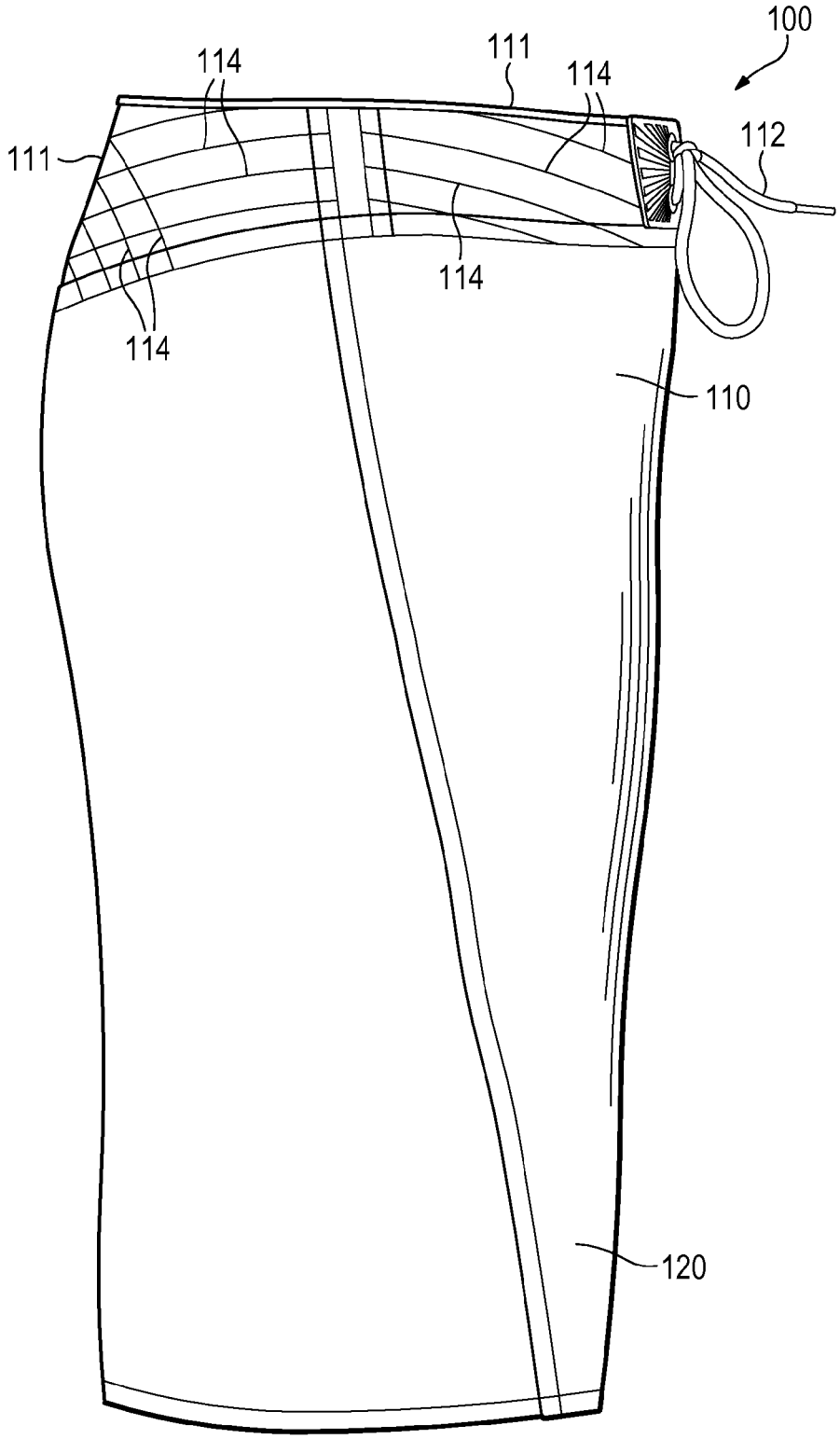
FIG. 5 is a first side elevational view of the article of apparel.
Figure 6:
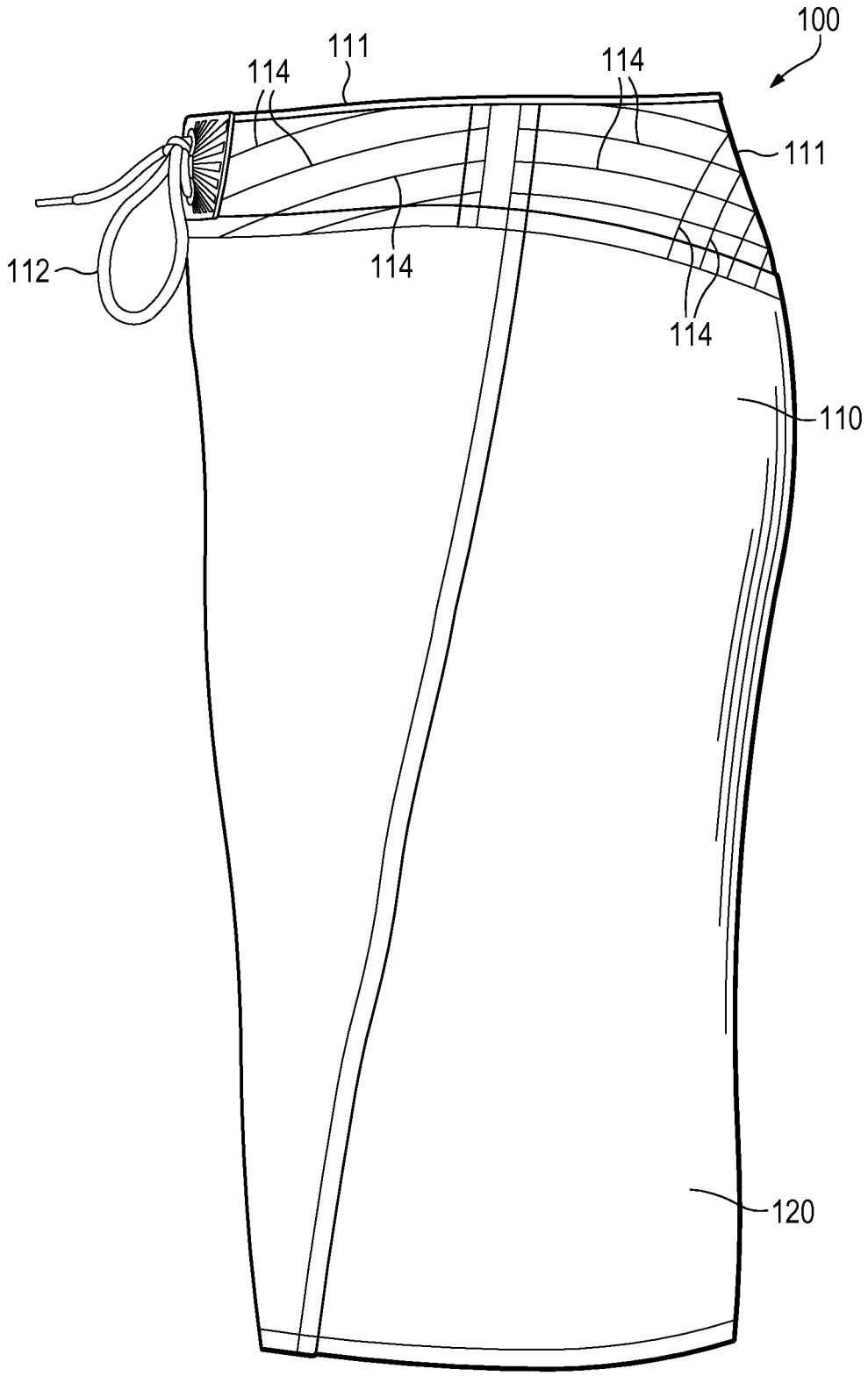
FIG. 6 is a second side elevational view of the article of apparel.

The extent to which strand segments 114 extend around waistband 111 also affects the ability of strand segments 114 to resist stretch in waistband 111. Strand segments 114 are depicted as extending around substantially all of the circumference of waistband 111. Referring to FIGS. 5 and 6, however, a gap is depicted between strand segments 114 in the side areas of apparel 100. That is, a gap is formed between strand segments 114 located in the front area of apparel 100 and strand segments 114 located in the rear area of apparel 100. This gap between strand segments 114 may permit some stretch in waistband 111 when stretch textile elements are present in the gap, which may enhance the comfort of apparel 100. In other configurations, however, the gap between segments 114 may be absent or may be increased. Moreover, when non-stretch textile elements are incorporated into waistband 111, strand segments 114 may be absent in areas of the non-stretch textile elements. Accordingly, strand segments 114 may extend around substantially all of waistband 111 or may include various gaps to impart a specific degree of stretch to apparel 100 in waistband 111.

The orientations and layout of strand segments 114 also affects the ability of strand segments 114 to resist stretch in waistband 111. Strand segments 114 are depicted as being angled with respect to the direction extending around waistband 111. In the front area of apparel 100, for example, strand segments 114 angle downward as they extend toward lace 112 and apertures 113. In the rear area of apparel 100, strand segments 114 angle downward as they extend toward a center of the rear area. The angled configurations of strand segments 114 may permit some stretch in waistband 111. In comparison, configurations where strand segments 114 are less angled may exhibit lesser stretch, and configurations where strand segments 114 are more angled may permit even greater stretch.

In forming structural components that resist stretch around waistband 111, strand segments 114 often operate cooperatively to resist stretch in particular directions or areas. Referring to FIG. 7, a first strand group 134 and a second strand group 135 are identified. First strand group 134 includes various strand segments 114 that are substantially parallel to each other and extend from one side of apparel 100 toward the center of the rear area. Second strand group 135 includes various strand segments 114 that are substantially parallel to each other and extend from an opposite side of apparel 100 toward the center of the rear area. Moreover, first strand group 134 crosses second strand group 135 in the center of the rear area. In general, strand groups 134 and 135 resist stretch from opposite sides of waistband 111. Additionally, given that strand segments 114 are substantially parallel to each other in each of strand groups 134 and 135, the strand segments 114 operate together to resist stretch in particular directions.

Manufacturing Process for First Tensile Strand Element

Figure 11:
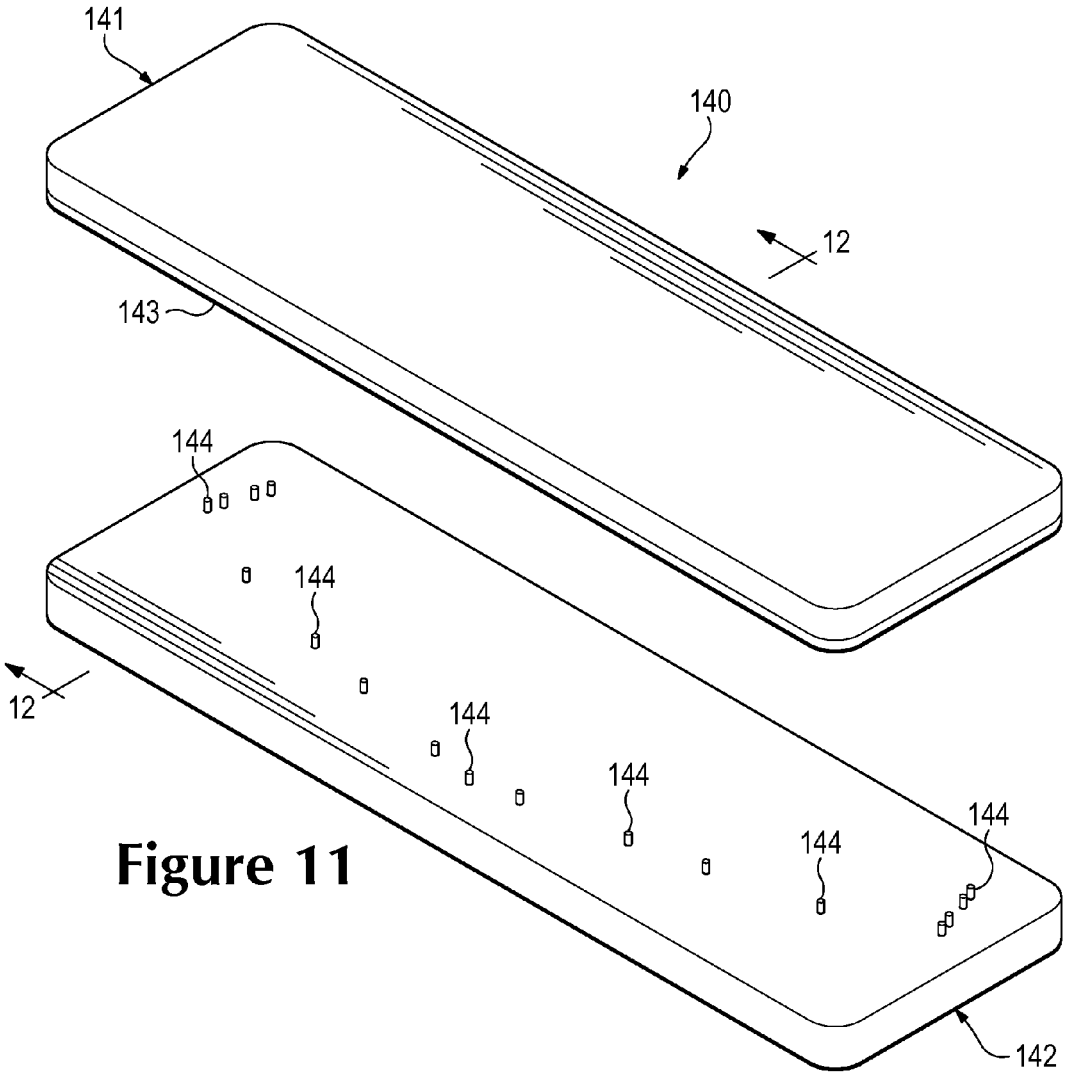
FIG. 11 is a perspective view of a manufacturing apparatus.
Figure 12:
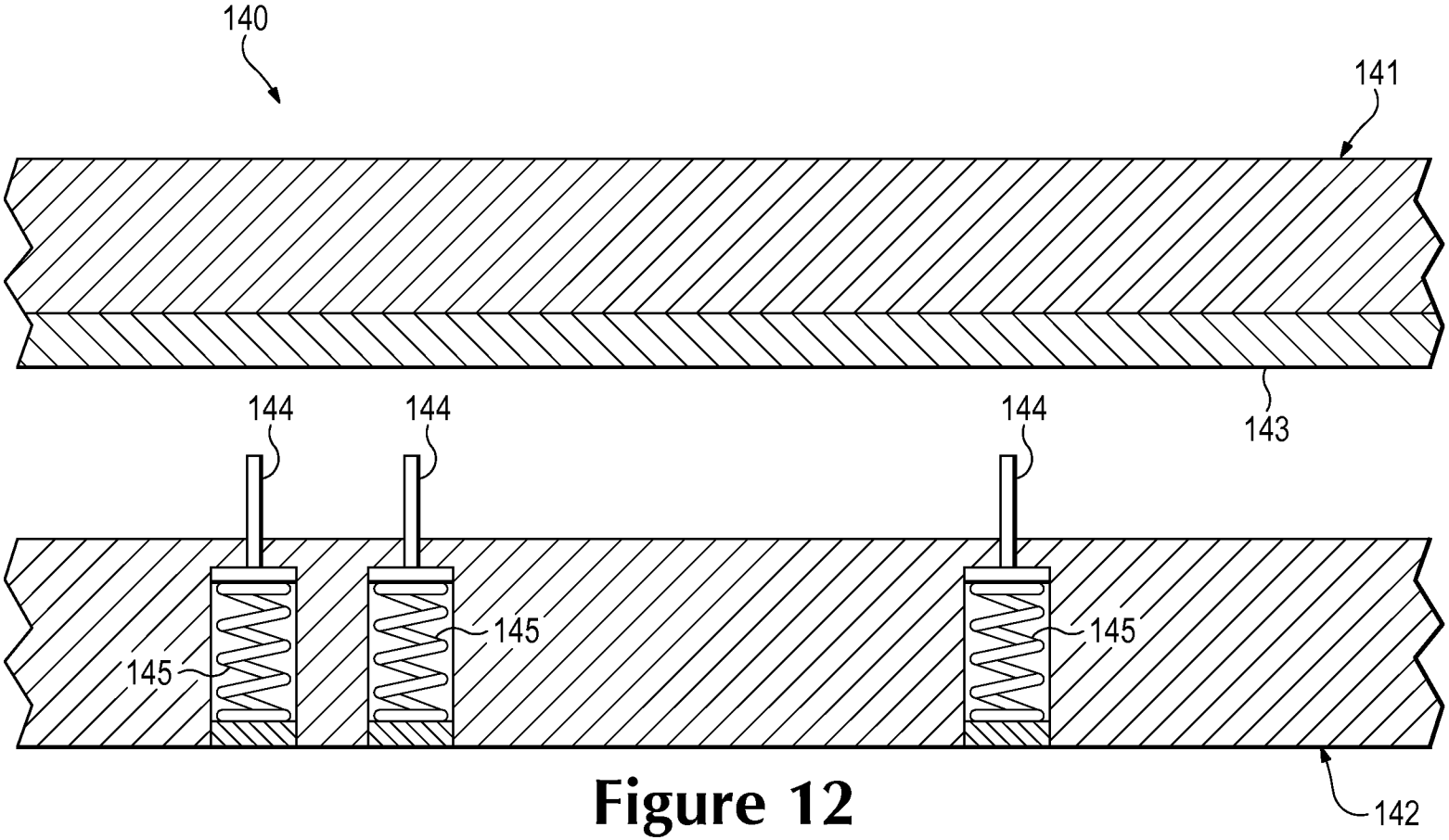
FIG. 12 is a schematic cross-sectional view of the manufacturing apparatus.

A variety of methods may be utilized to manufacture tensile strand element 140. Referring to FIGS. 11 and 12, a manufacturing apparatus 140 is depicted as including a press plate 141 and a pin plate 142. Press plate 141 includes a compressible element 143 that forms a generally planar surface facing toward pin plate 142. Compressible element 143 may, for example, be a polymer foam or silicone material that compresses or otherwise deforms when subjected to a compressive force. Pin plate 142 includes a plurality of pins 144 that protrude outward from a surface that faces press plate 141. As depicted in FIG. 12, each of pins 144 rests upon a spring 145.

Prior to the assembly of tensile strand element 130, the various components of tensile strand element 130 are assembled and prepared for manufacture. For example, first layer 131, second layer 132, and securing elements 133 are cut to desired dimensions through die cutting, hand cutting, or laser cutting, for example. A strand of suitable length to form strand segments 114 may also be provided. Additionally, press plate 141 of manufacturing apparatus 140 may be heated to a suitable temperature to effect bonding between the various components. Alternately, both plates 141 and 142 may incorporate heating elements (e.g., resistance heaters or conduits for channeling a heated fluid), or radiant heaters external to manufacturing apparatus 140 may be utilized.

Figure 13A:
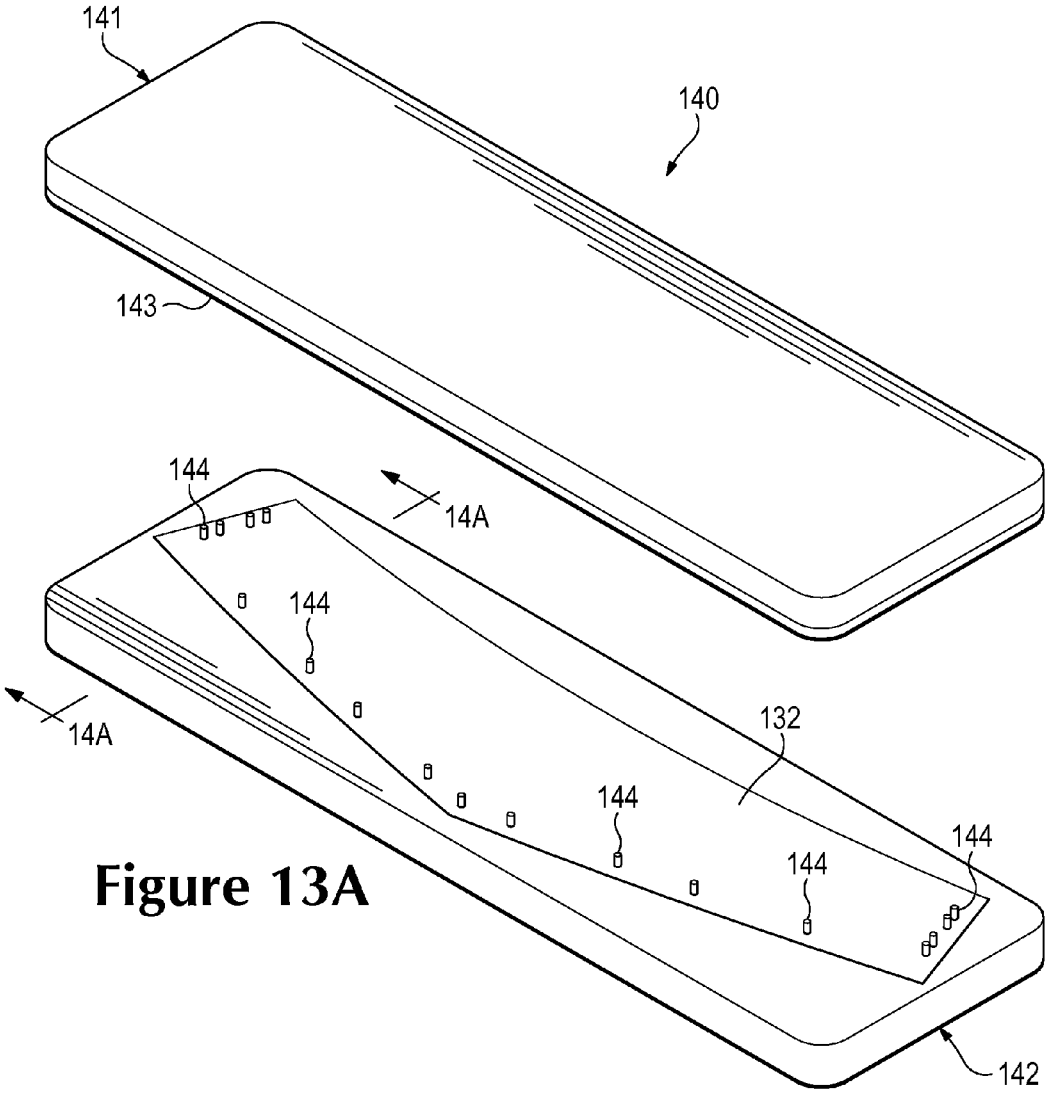
FIGS. 13A-13H are perspective views of a manufacturing process for the first tensile strand element.
Figure 13B:
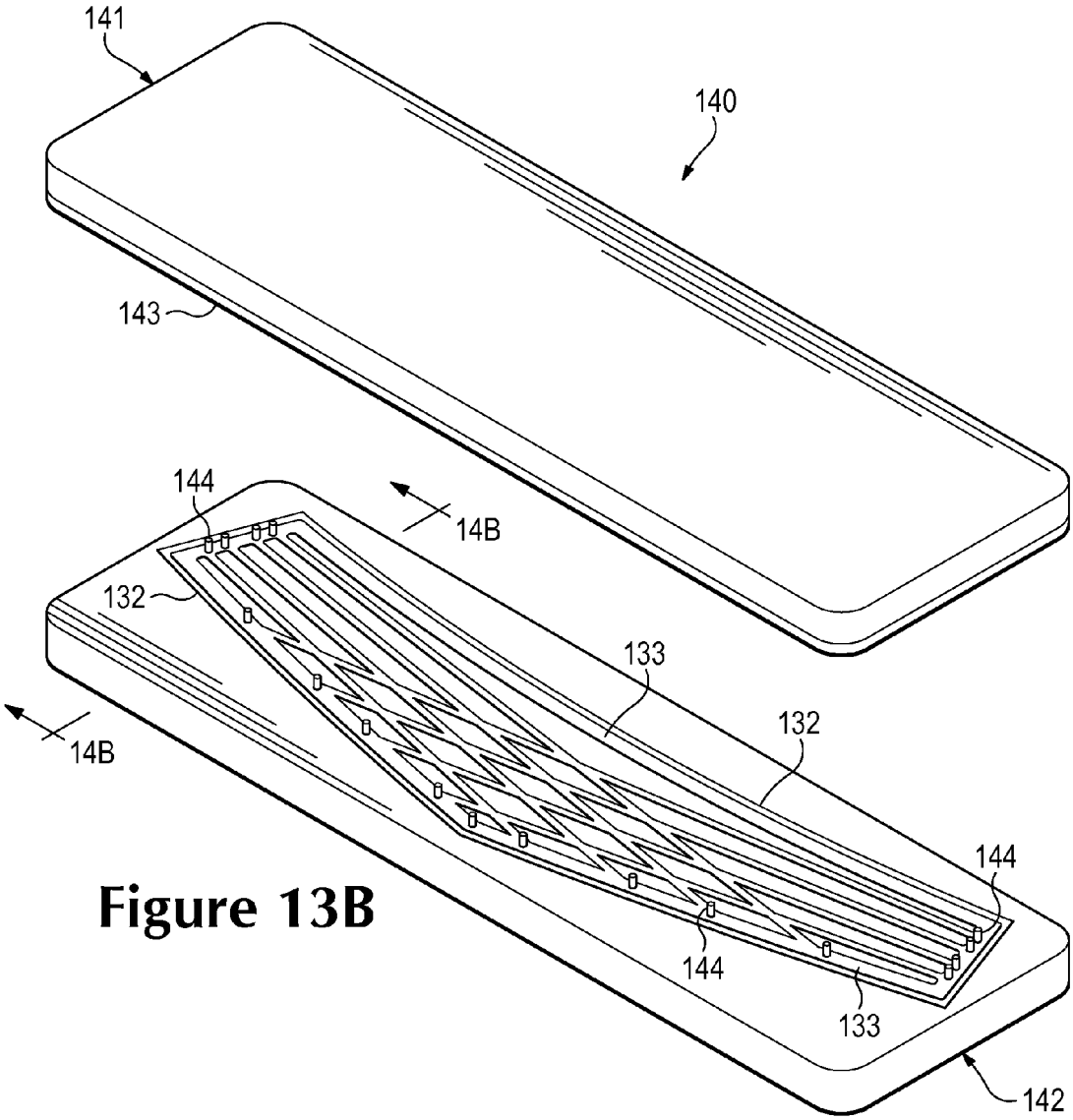
Figure 13C:
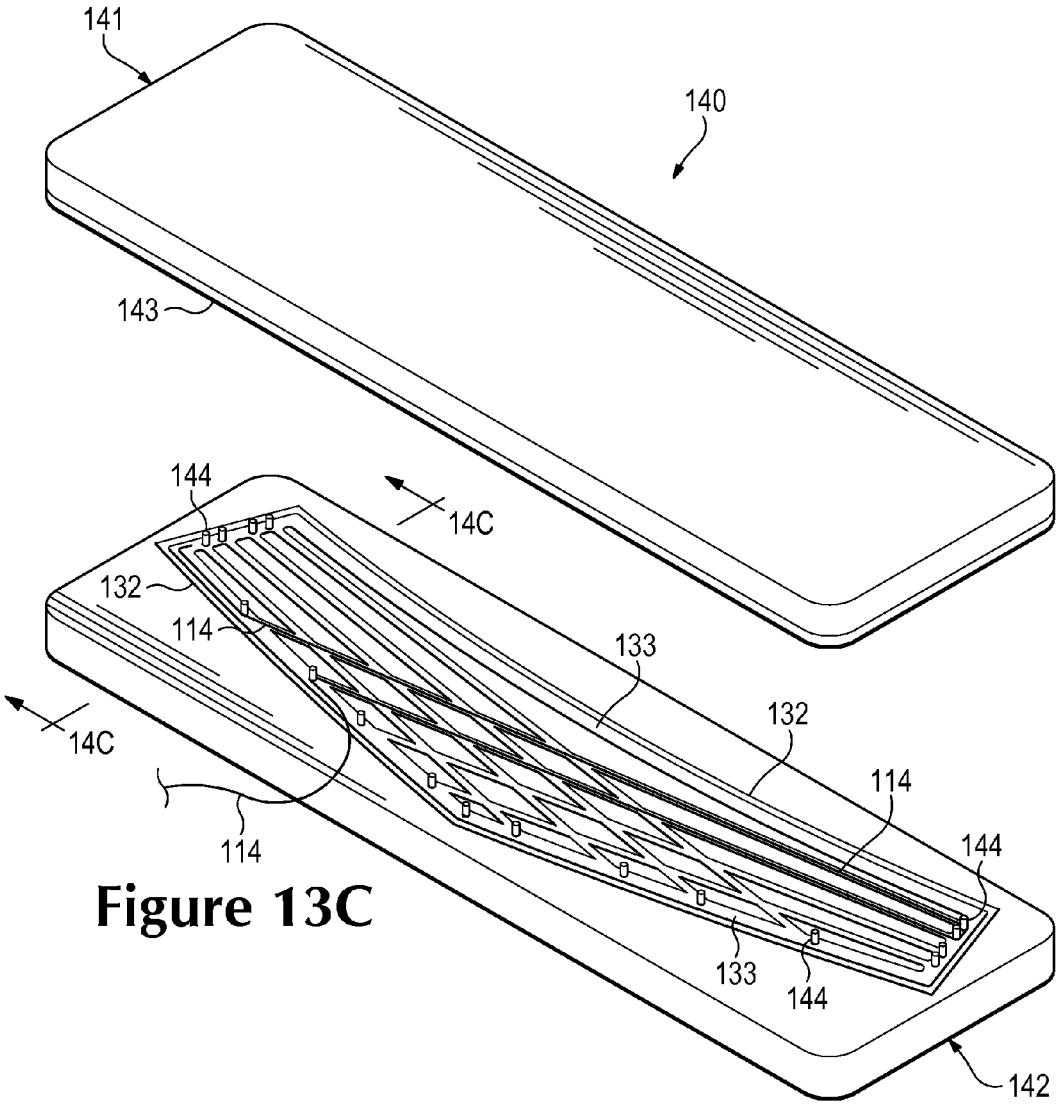
Figure 13D:
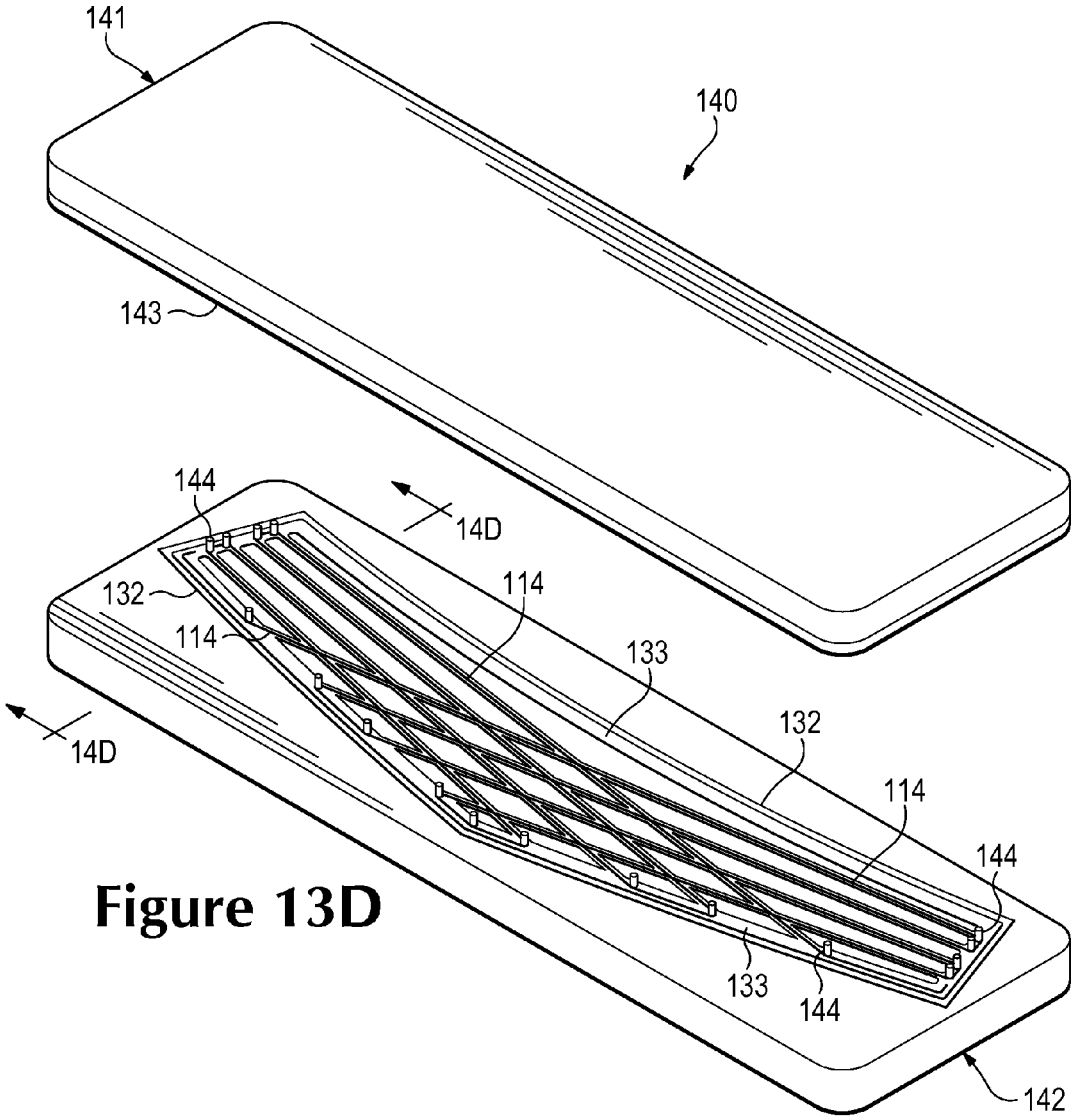
Figure 13E:
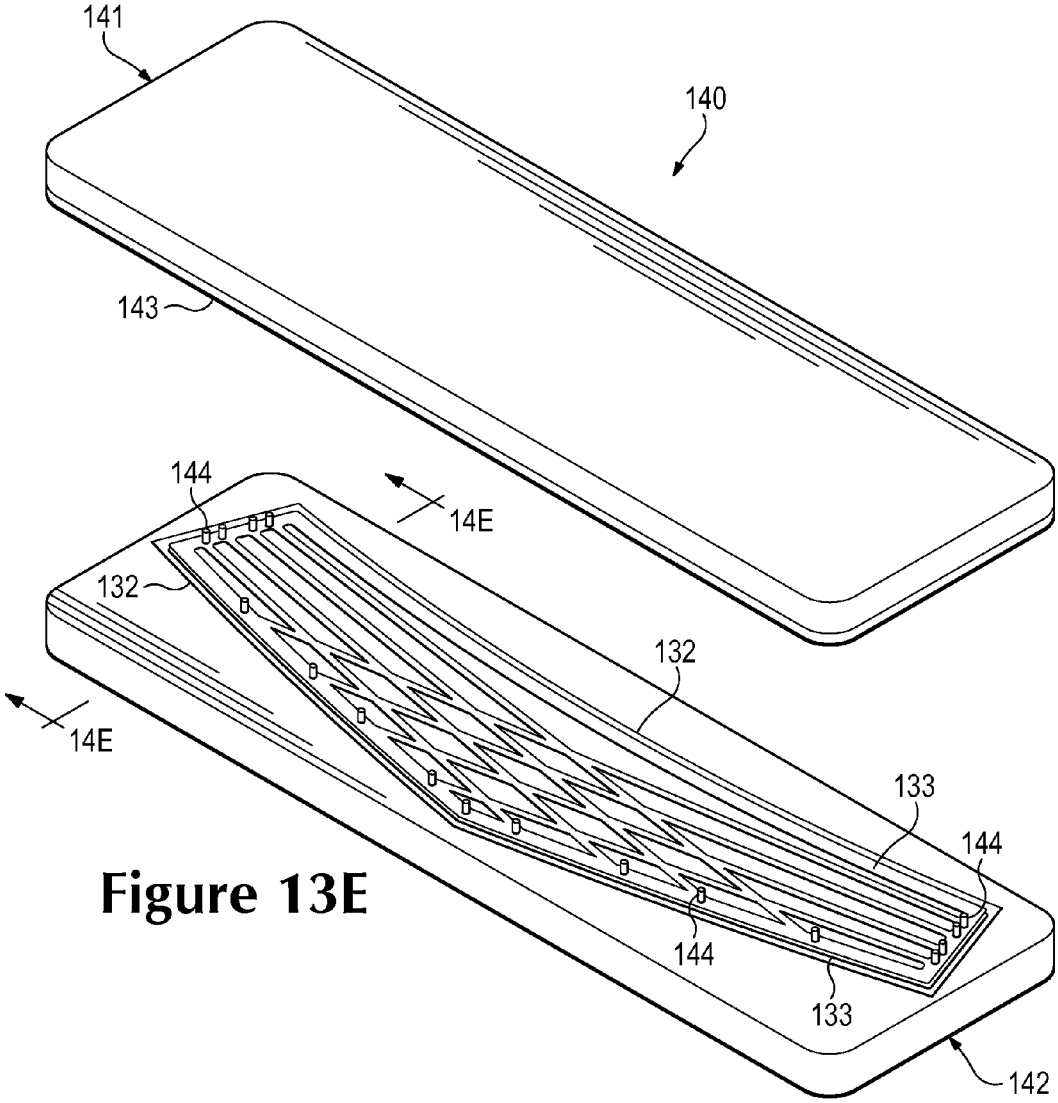
Figure 13F:
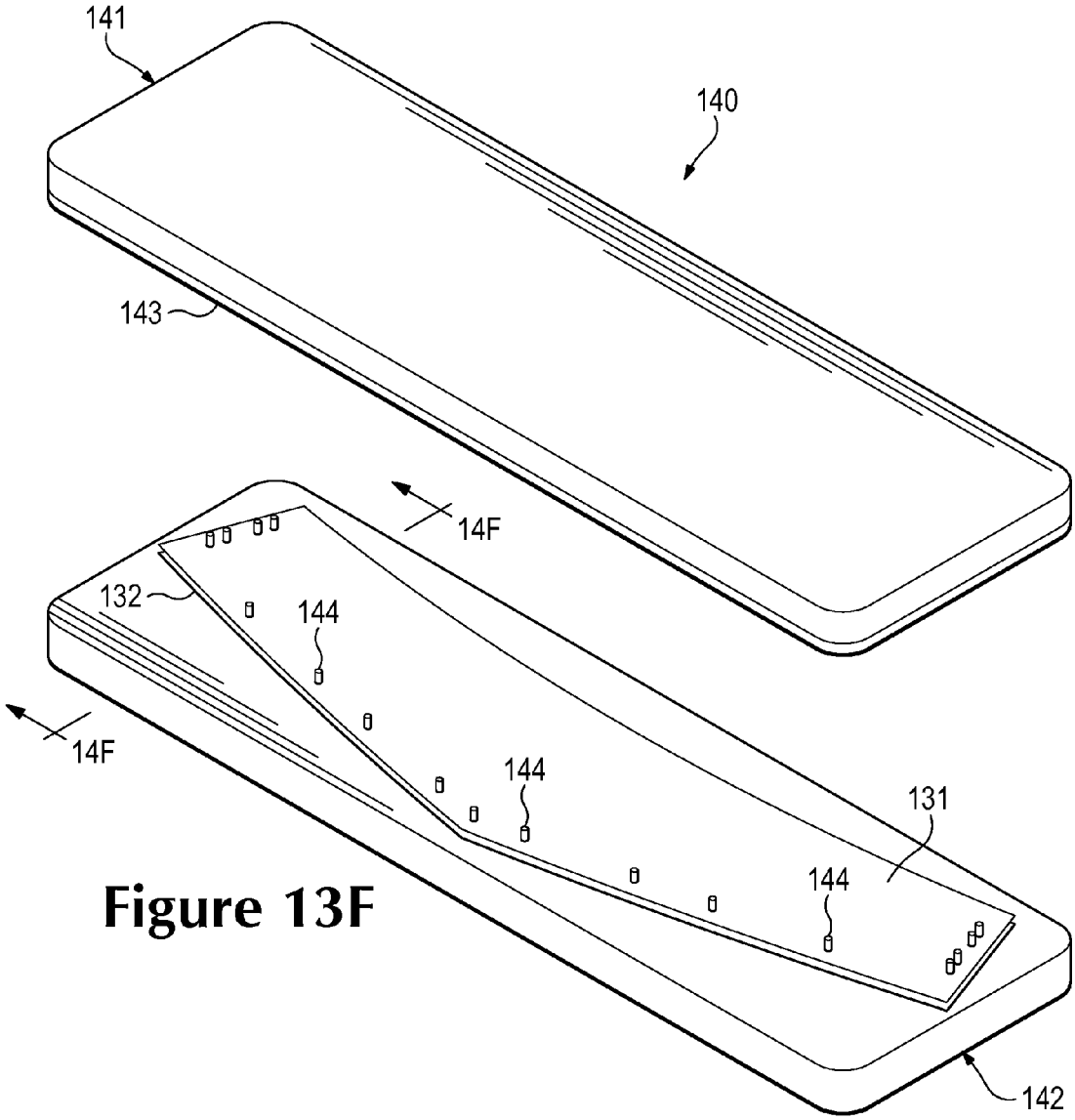
Figure 14A:
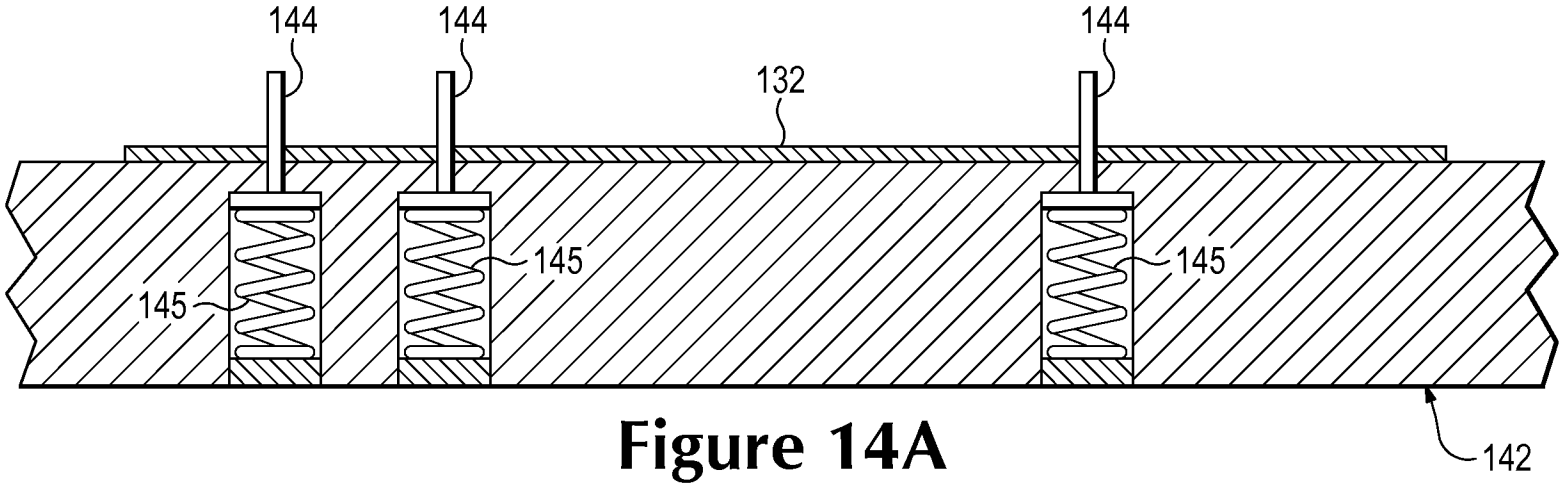
FIGS. 14A-14H are schematic cross-sectional views of the manufacturing process for the first tensile strand element.
Figure 14B:
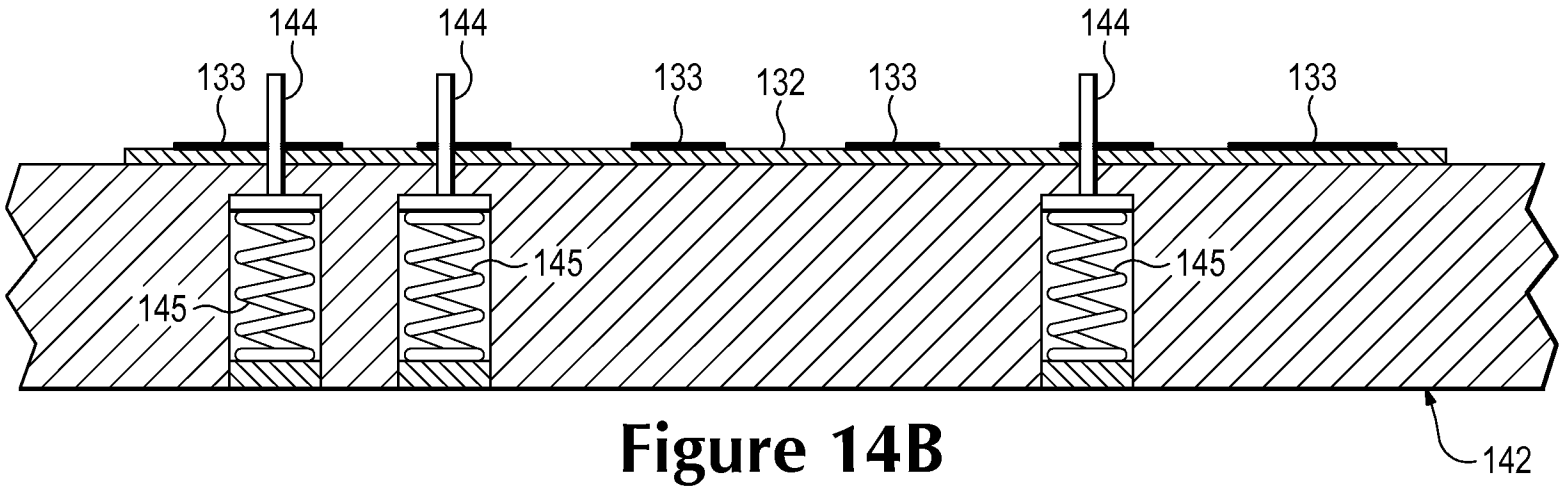
Figure 14C:
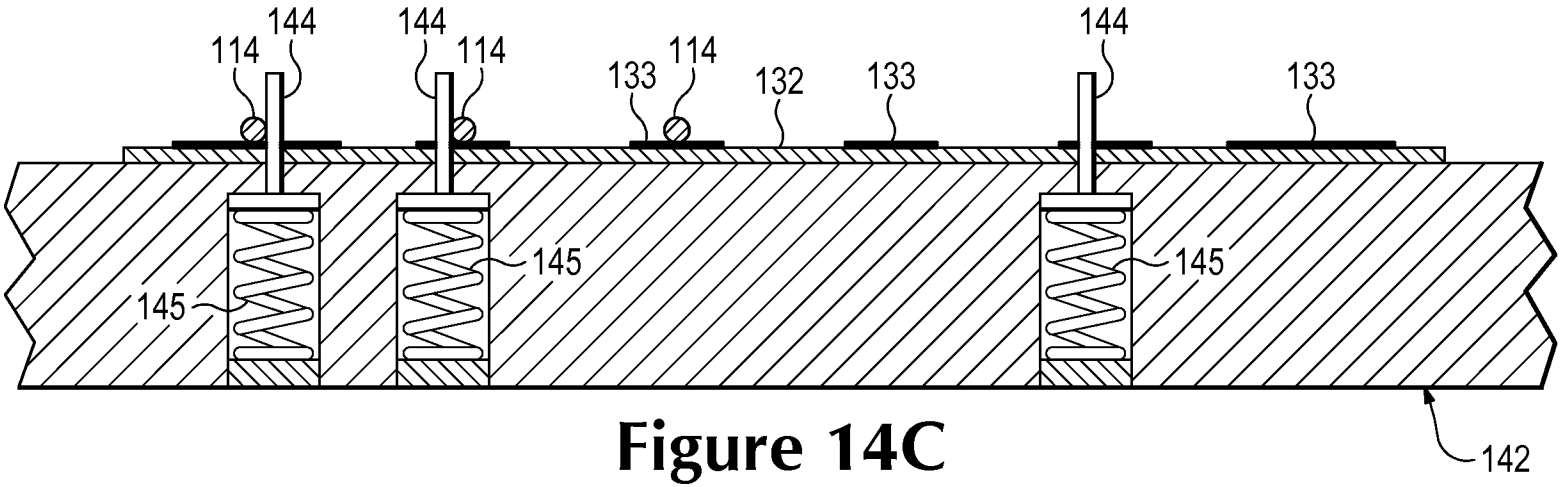
Figure 14D:
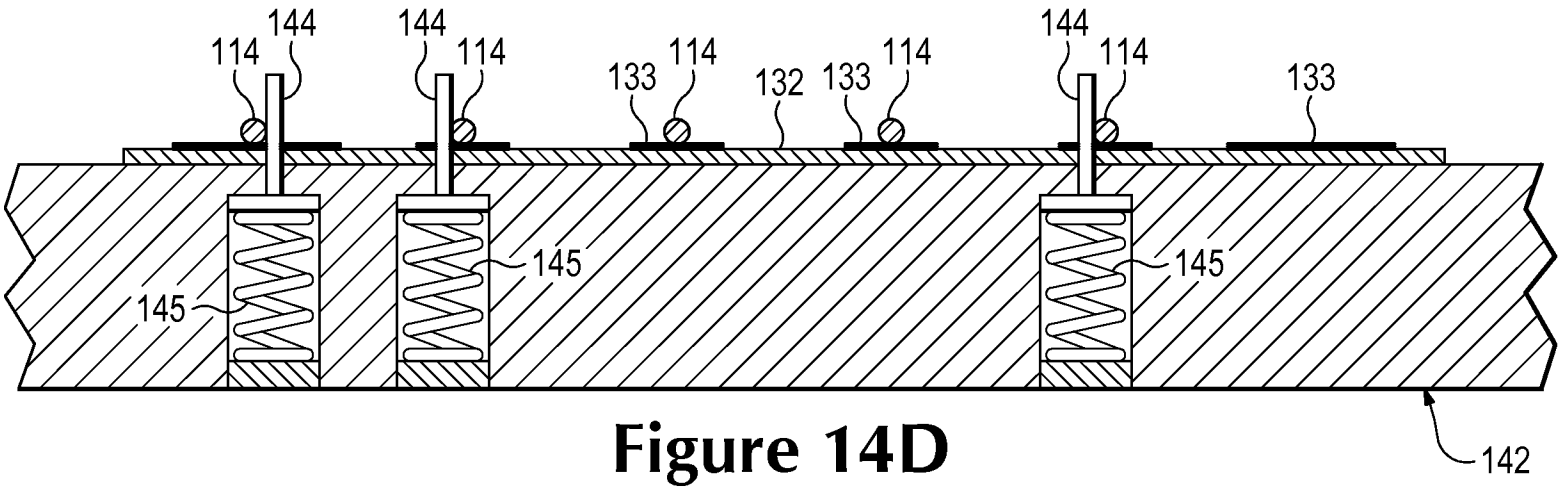
Figure 14E:
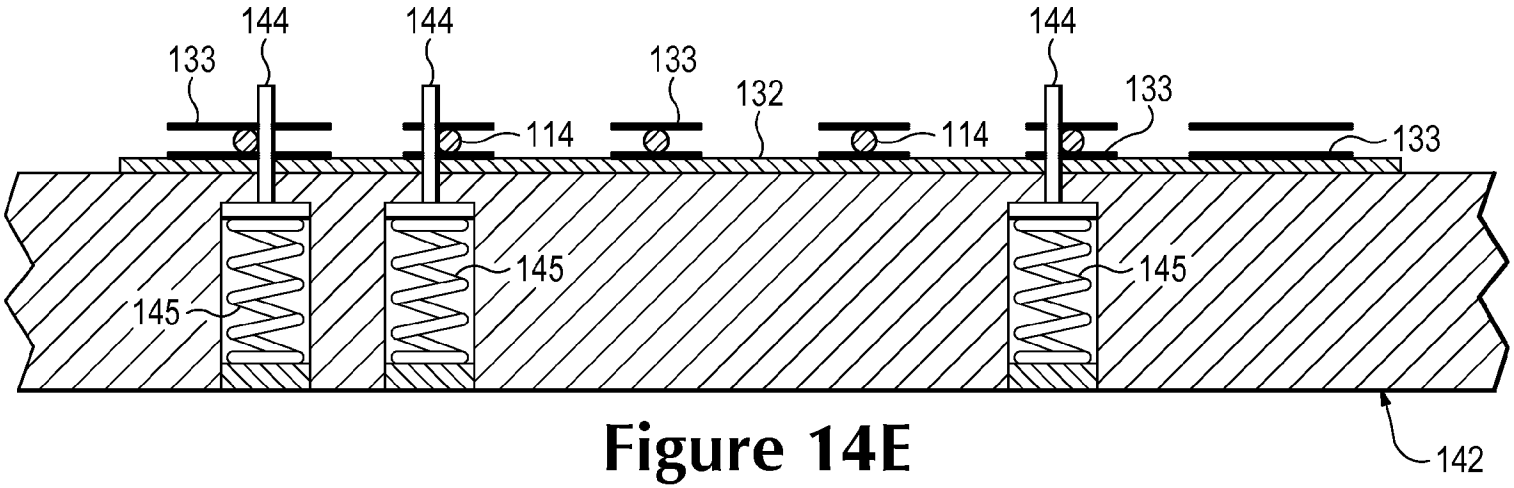
Figure 14F:
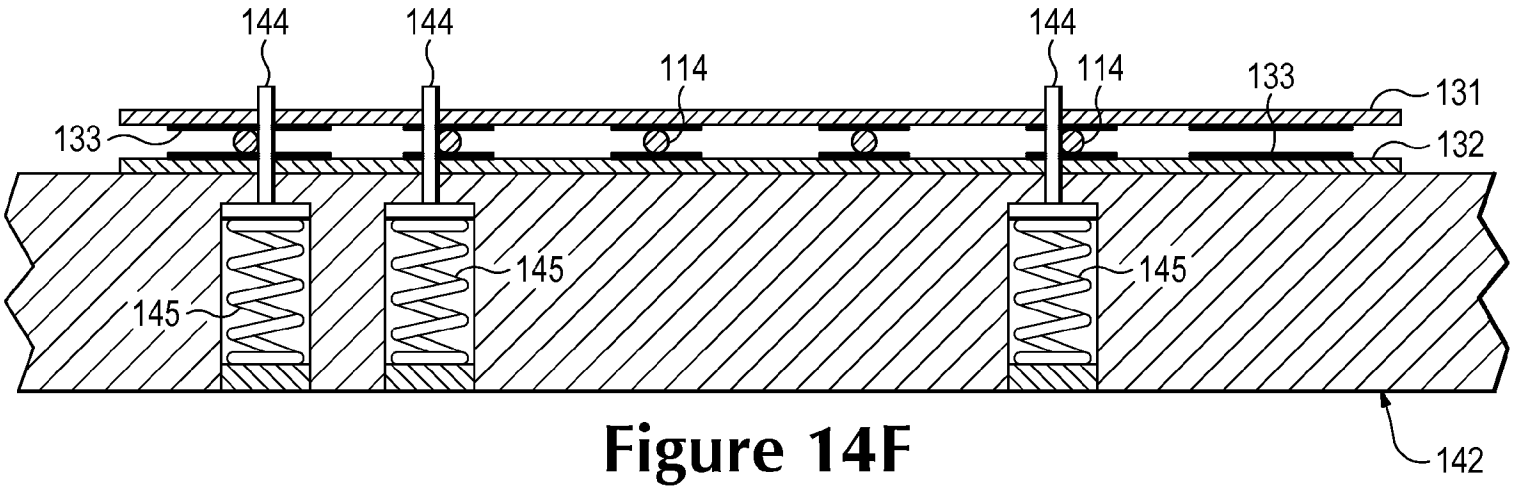

In assembling tensile strand element 130, second layer 132 is initially placed upon pin plate 142, as depicted in FIGS. 13A and 14A. When properly positioned, pins 144 protrude through second layer 132 in various locations at the periphery of second layer 132. Once second layer 132 is positioned, one of securing elements 133 is placed upon second layer 132, as depicted in FIGS. 13B and 14B, such that pins 144 protrude therethrough. At this stage, the strand forming strand segments 114 is wound around some of pins 144, as depicted in FIGS. 13C and 14C, to begin the process of locating strand segments 144 relative to second layer 132 and securing element 133. The strand is then wound around a remainder of pins 144, as depicted in FIGS. 13D and 14D, to complete the positioning of strand segments 114. Once strand segments 114 are properly positioned, the other of securing elements 133 is placed over strand segments 114, as depicted in FIGS. 13E and 14E, and first layer 131 is positioned, as depicted in FIGS. 13F and 14F.

Figure 13G:
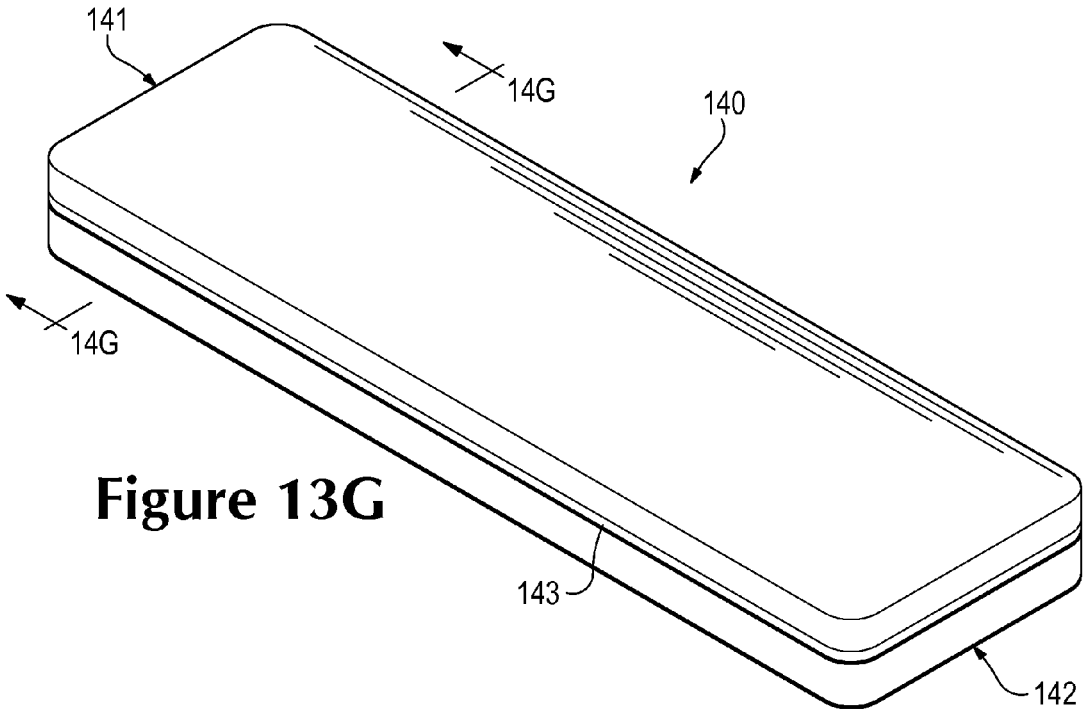
Figure 13H:
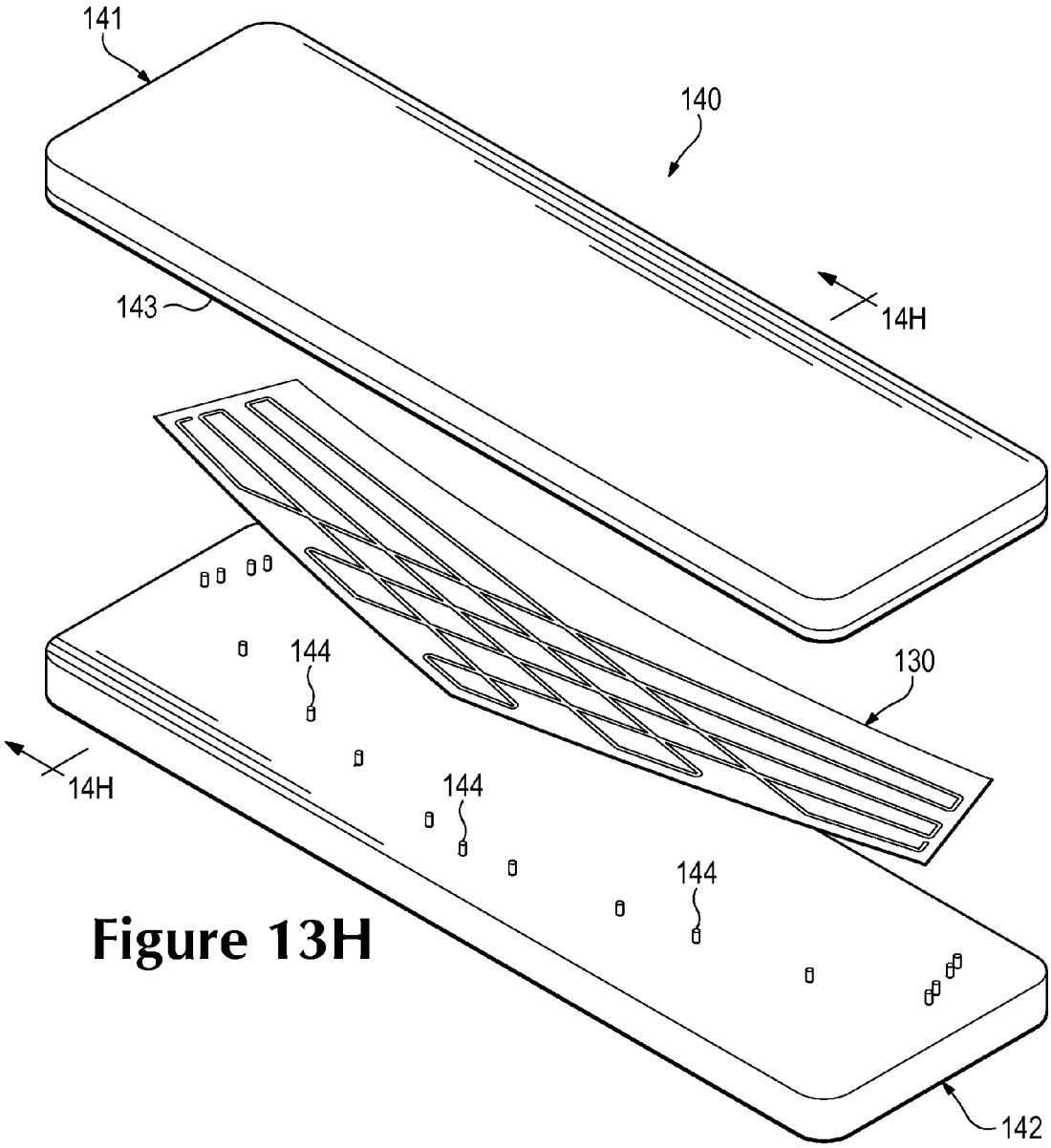
Figure 14G:
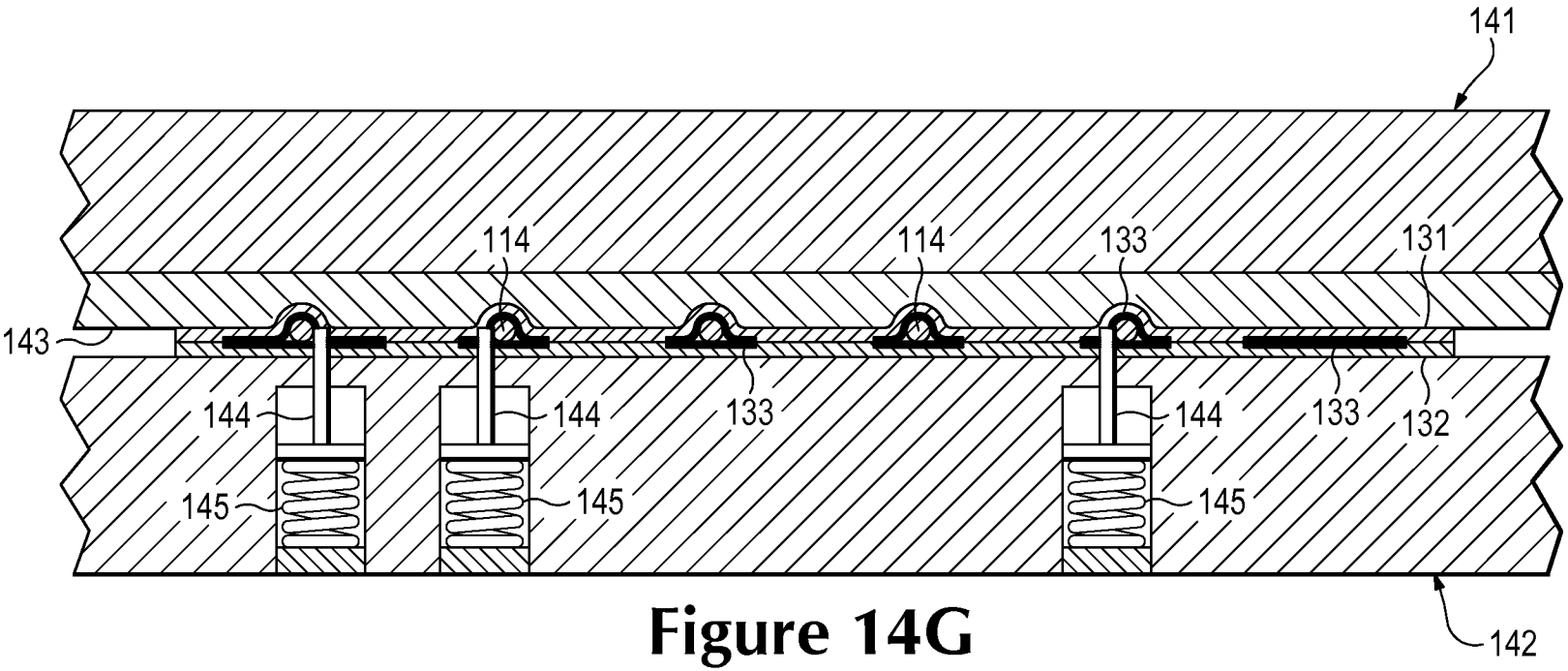
Figure 14H:
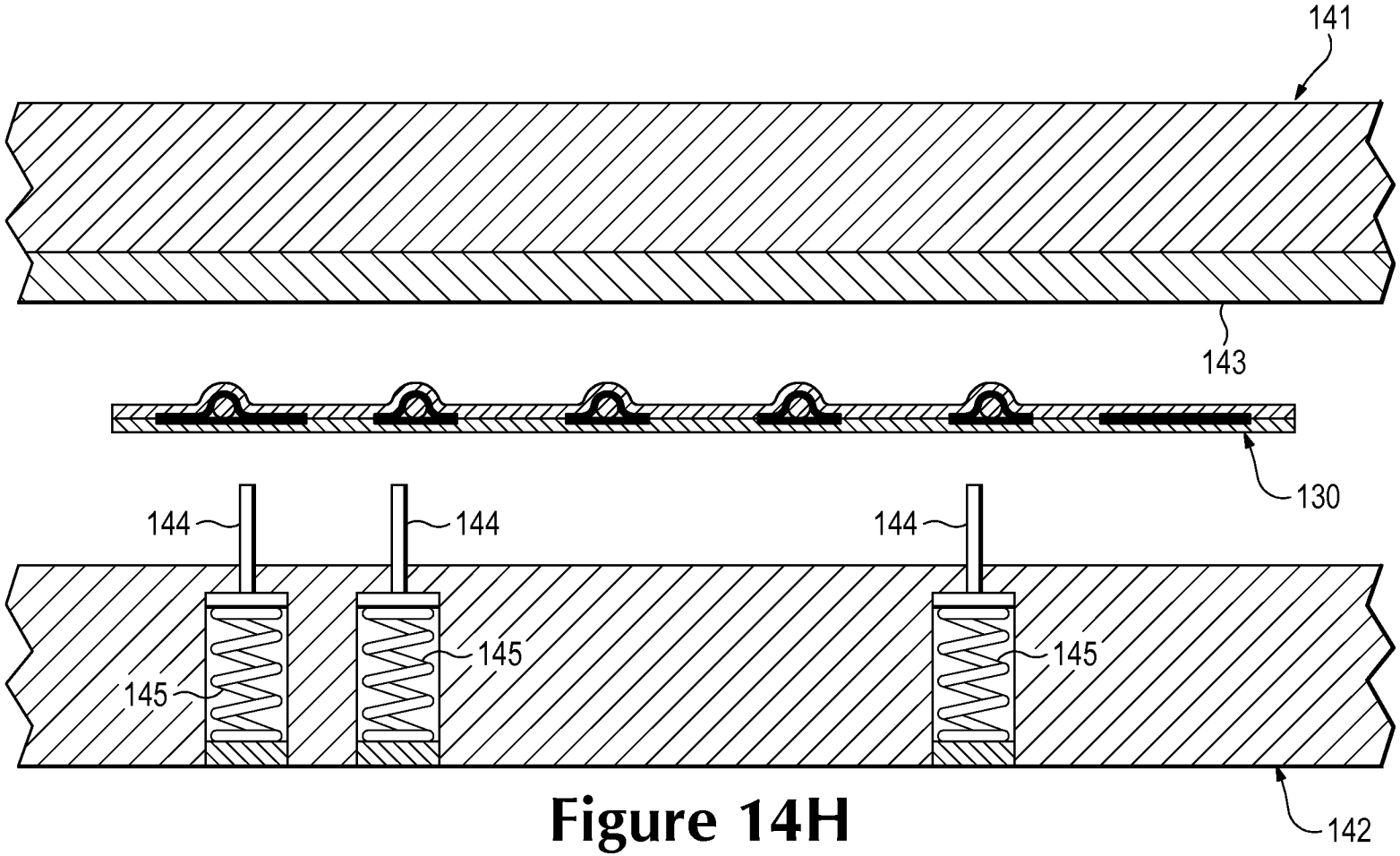

At this stage of the manufacturing process, the various components of tensile strand element 130 are properly arranged and assembled upon pin plate 142. Press plate 141 then translates toward the components and compresses the components, as depicted in FIGS. 13G and 14G. The downward pressure of press plate 141 induces pins 144 to compress springs 145 and retreat into pin plate 142. Additionally, press plate 141 heats the components of tensile strand element 130 to secure the components together. More particularly, heat from press plate 141 increases the temperature of securing elements 133 and melts or otherwise softens the thermoplastic polymer material forming securing elements 133 to form a bond that (a) secures strand segments 114 within tensile strand element 130 and (b) joins layers 131 and 132 to each other. Once bonding is complete, press plate 141 separates from pin plate 142 to permit the removal of tensile strand element 130, as depicted in FIGS. 13H and 14H. Upon cooling, the thermoplastic polymer material of securing elements 133 hardens or otherwise solidifies to securely join layers 131 and 132 and secure strand segments 114.

As noted above, compressible element 143 may compress or otherwise deform when subjected to a compressive force. During the compression of the components forming tensile strand element 130, areas of first layer 131 that are positioned adjacent to strand segments 114 protrude into compressible element 143, as depicted in FIG. 14G. This forms a series of protrusions on the surface of tensile strand element 130 formed by first layer 131. Conversely, the surface of tensile strand element 130 formed by second layer 132 exhibits a generally planar configuration. An advantage of this structure is that the protrusions on the surface of tensile strand element 130 formed by first layer 131 are visible from an exterior of apparel 100, thereby enhancing the aesthetic appeal of apparel 100. A further advantage of this structure is that the planar configuration of the surface of tensile strand element 130 formed by second layer 132 faces inward and may contact individual 10, thereby providing a relatively smooth surface that enhances the comfort of apparel 100.

Although the manufacturing process discussed above provides a suitable method for producing tensile strand element 130, a variety of other processes may also be utilized. For example, an embroidery process may be utilized to locate strand segments 114 relative to second layer 132 and one of securing elements 133. Once strand segments 114 are positioned, first cover layer 131 and the other of securing elements 133 are positioned over strand segments 114. A heat press may then bond the elements together. Other stitching processes may alternately be utilized to locate strand segments 114, such as computer stitching.

Second Tensile Strand Element

Figure 15:
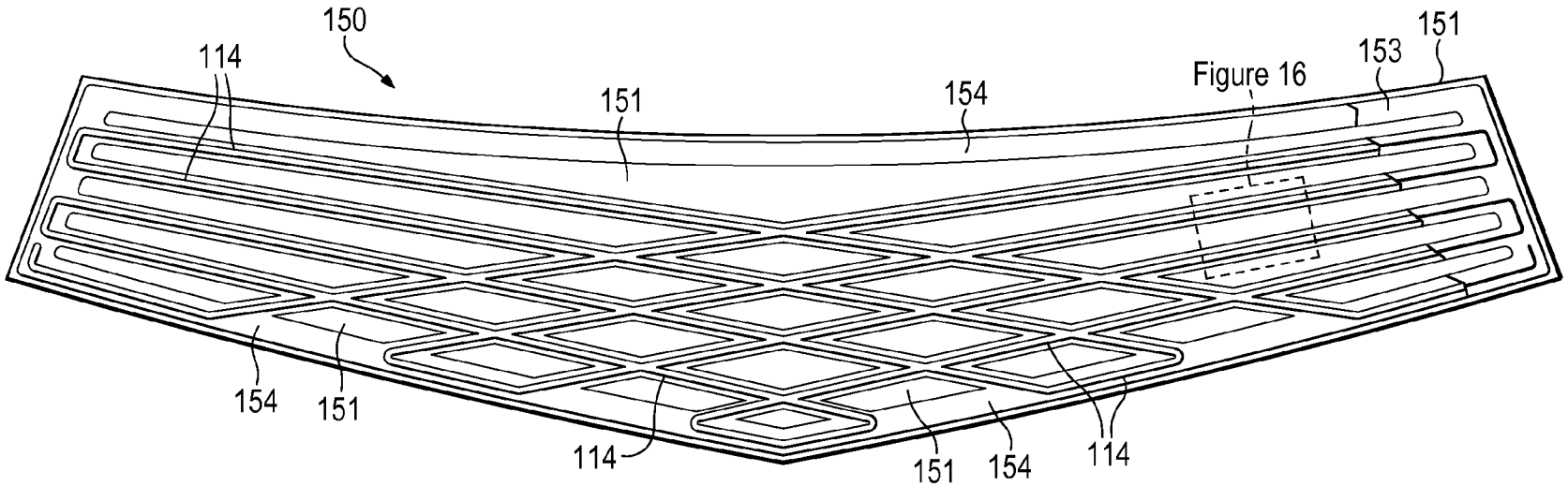
FIG. 15 is a plan view of a second tensile strand element that may be utilized in the article of apparel.

Another tensile strand element 150 that may be utilized in apparel 100 is depicted in FIG. 15. Additionally, a smaller portion of tensile strand element 150 is shown in FIGS. 16-18B to provide further detail. As with tensile strand element 130, tensile strand element 150 has a configuration that may form the rear area of waistband 111. Other tensile strand elements that form the front area of waistband 111 may have a similar structure. As an alternative, some configurations of apparel 100 may include a single tensile strand element, with a configuration that is similar to tensile strand element 150, that extends entirely around apparel 100 and forms the front area, side areas, and the rear area of waistband 111.

Tensile strand element 150 includes a base layer 151, a securing element 152, a backing layer 153, a cover layer 154, and the various strand segments 114. A variety of materials may be utilized for the various components of tensile strand element 150. As an example, however, base layer 151 and backing layer 153 may be formed from textile elements, including any of the textile elements discussed above for layers 131 and 132. Similarly, securing element 152 and cover layer 154 may be formed from thermoplastic polymer materials, including any of the materials discussed above for securing elements 133.

Tensile strand element 150 has a layered configuration wherein base layer 151 forms a substrate upon which the other components are stacked. Securing element 152 is joined with base layer 151 and effectively joins backing layer 153 to base layer 151. Strand segments 114 are located on backing layer 153 and joined to backing layer 153 with cover layer 154. Portions of cover layer 154 are, therefore, secured to both strand segments 114 and backing layer 153.

When incorporated into apparel 100, base layer 151 may form an inner surface of waistband 111 (i.e., a surface that faces toward individual 10) and both layers 151 and 154 may form an outer surface of waistband 111 (i.e., a surface that faces away from individual 10). Moreover, given that many thermoplastic polymer materials may be transparent or at least partially transparent, both strand segments 114 and backing layer 153 may be visible through cover layer 154. That is, strand segments 114 and backing layer 153 may be visible from the exterior of apparel 100. In order to enhance the aesthetic appeal of apparel 100, backing layer 153 may be formed from the same material that forms other areas of pelvic region 110 and leg regions 120. That is, backing layer 153 may have the same color as regions 110 and 120, and base layer 151 may be formed from a different material.

Base layer 151 extends continuously throughout the width and length of tensile strand element 150. Although securing element 152, backing layer 153, and cover layer 154 may also extend continuously throughout the width and length of tensile strand element 150, these elements define apertures or spaces in areas between strand segments 114. An advantage of this configuration is that securing element 152, backing layer 153, and cover layer 154 are absent in areas where strand segments 114 are absent, thereby enhancing breathability in waistband 111 and reducing the overall mass of apparel 100.

Figure 16:
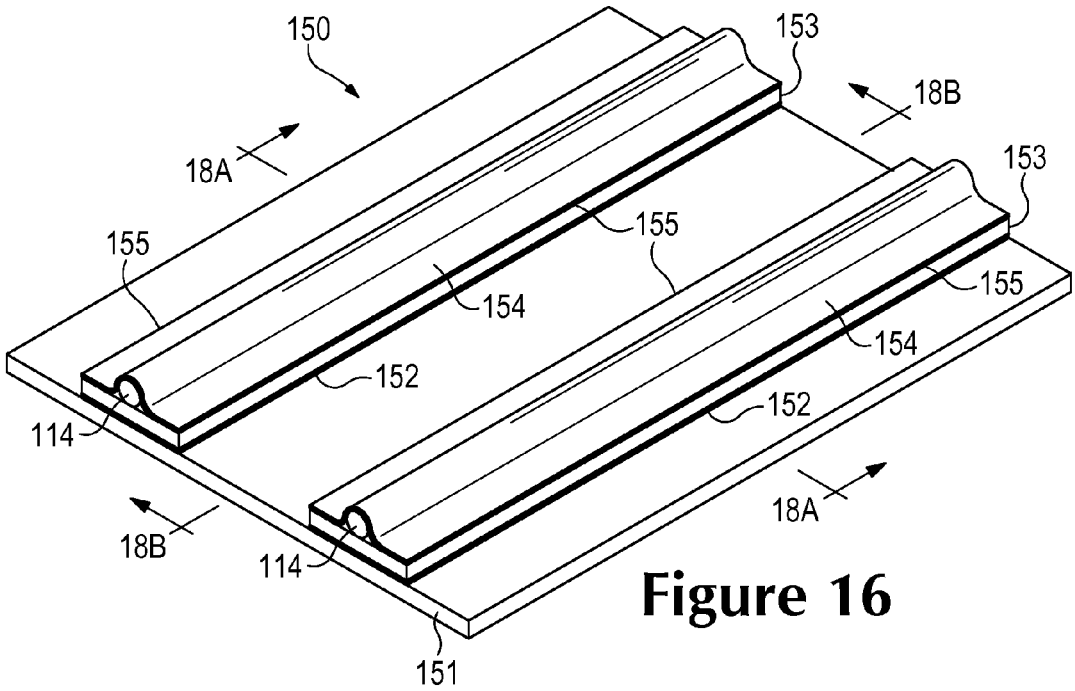
FIG. 16 is a perspective view of a portion of the second tensile strand element, as defined in FIG. 15.
Figure 17:
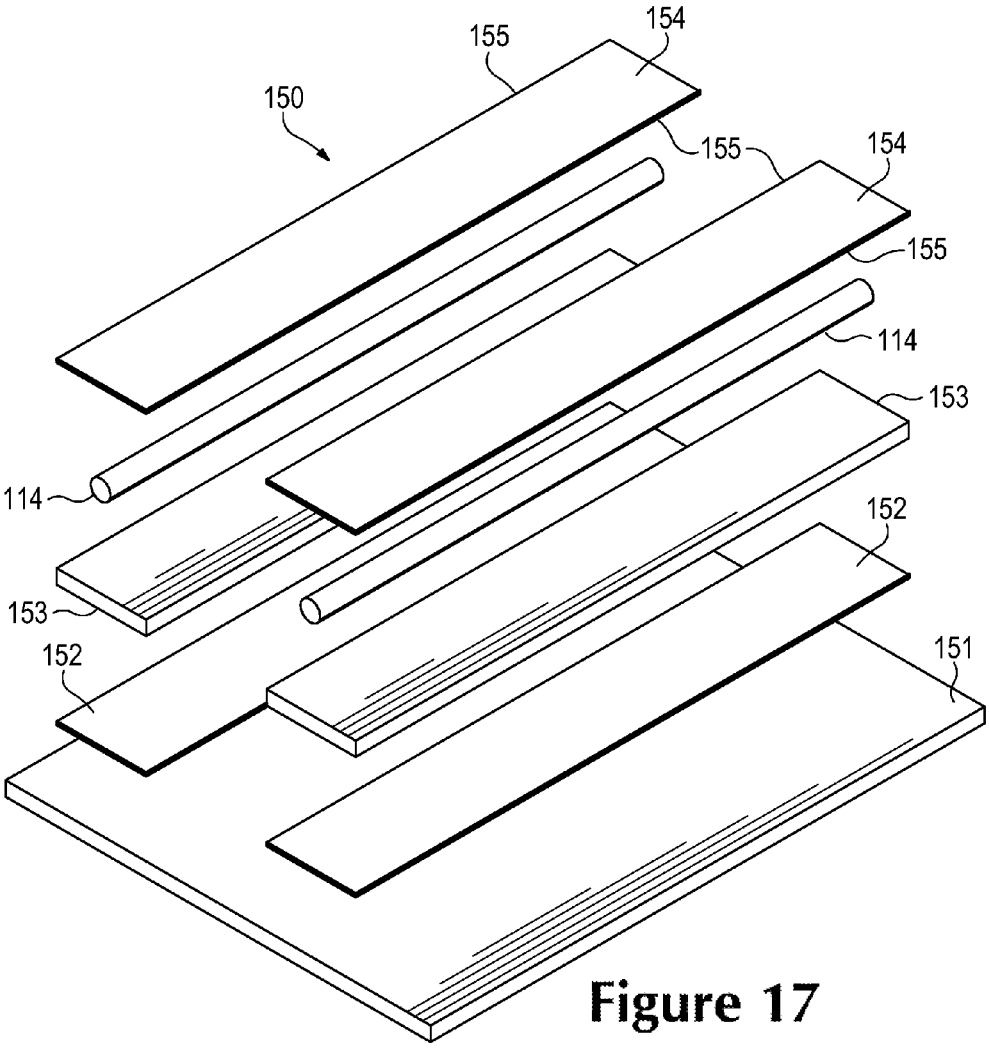
FIG. 17 is an exploded perspective view of the portion of the second tensile strand element.
Figure 18A:
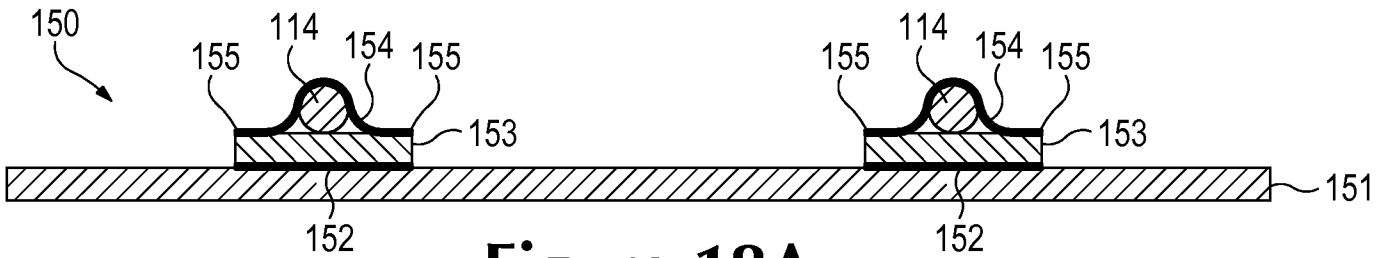
FIGS. 18A and 18B are cross-sectional views of the portion of the second tensile strand element, as defined by section lines 18A and 18B in FIG. 16.
Figure 18B:
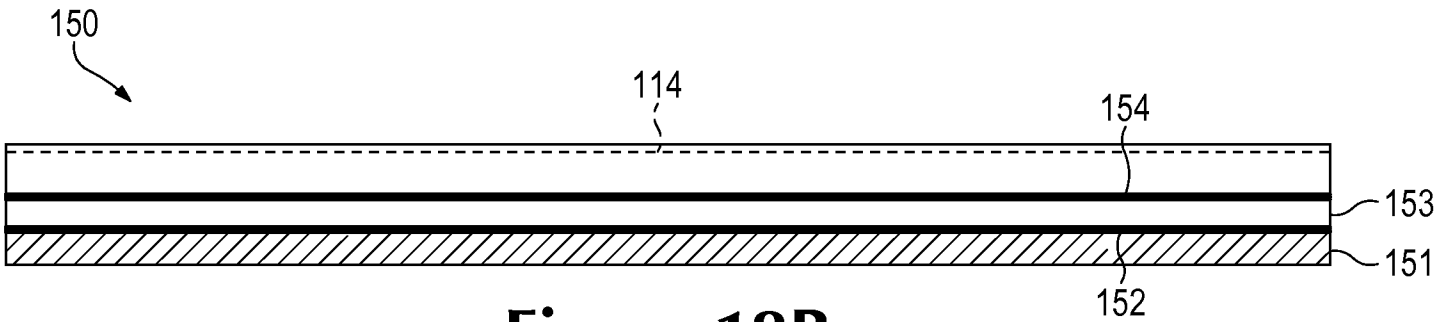

As discussed above, cover layer 154 (as well as securing element 152 and backing layer 153) define apertures or spaces in areas between strand segments 114. Portions of cover layer 154 define, therefore, a pair of spaced edges 155, as depicted in FIGS. 16 and 17. In this configuration, strand segments 114 are substantially centered between edges 155. An advantage to this configuration is that strand segments 114 are centered within portions of tensile strand element 150. Additionally, this configuration may enhance the overall aesthetic appeal of apparel 100.

Strand segments 114 lay adjacent to surfaces of base layer 150, backing layer 153, and cover layer 154. Moreover, strand segments 114 are substantially parallel to the surfaces of base layer 150, backing layer 153, and cover layer 154. As discussed above, strand segments 114 extend around waistband 111 to limit stretch. By being substantially parallel to the surfaces of base layer 150, backing layer 153, and cover layer 154, strand segments 114 resist stretch in directions that correspond with these surfaces. That is, strand segments 114 resist stretch in the direction extending around waistband 111. Although strand segments 114 may extend through one or more of base layer 150, backing layer 153, and cover layer 154 in some locations (e.g., as a result of stitching), areas where strand segments 114 extend through may permit stretch, thereby reducing the overall ability of strand segments 114 to limit stretch. As a result, strand segments 114 generally lay adjacent to and substantially parallel to surfaces of base layer 150, backing layer 153, and cover layer 154 throughout distances of at least five centimeters or more. That is, strand segments 114 extend parallel to base layer 150, backing layer 153, and cover layer 154 and between base layer 150, backing layer 153, and cover layer 154 throughout distances of at least five centimeters or more to limit stretch in waistband 111. In many configurations, strand segments 114 are also bonded to layers 153 and 154 along the distances of at least five centimeters to ensure that strand segments 114 remain properly positioned within tensile strand element 150.

Based upon the above discussion, base layer 151 and cover layer 154 generally lay adjacent to each other, although both securing element 152 and backing layer 153 may extend between layers 151 and 154. In this configuration, cover layer 154 forms a portion of an exterior surface of apparel 100. Additionally, cover layer 154 defines a pair of spaced edges 155. Strand segments 114 are located between layers 151 and 154, and strand segments 114 extend at least partially around waistband 111. Strand segments 114 lay substantially parallel to surfaces of layers 151 and 154 for a distance of at least five centimeters, and strand segments 114 are substantially centered between edges 155 for the distance of at least five centimeters.

Similar to the discussion above for tensile strand element 140, strand segments 114 form structural components in tensile strand element 150 that resist stretch around waistband 111. By resisting stretch, strand segments 114 have an effect upon the degree to which waistband 111 is tensioned to secure apparel 100 to individual 10. Various factors affect the ability of strand segments 114 to resist stretch in waistband 111, including (a) the properties of strand segments 114, (b) the extent to which strand segments 114 extend around waistband 111, and (c) the orientation and layout of strand segments 114.

Manufacturing Process for Second Tensile Strand Element

A variety of methods may be utilized to manufacture tensile strand element 150. As an example, manufacturing apparatus 140 may be utilized. Prior to the assembly of tensile strand element 150, the various components of tensile strand element 150 are assembled and prepared for manufacture. For example, base layer 151, securing element 152, backing layer 153, and cover layer 154 are cut to desired dimensions through die cutting, hand cutting, or laser cutting. A strand of suitable length to form strand segments 114 may also be provided. Additionally, press plate 141 of manufacturing apparatus 140 may be heated to a suitable temperature to effect bonding between the various components.

Figure 19A:
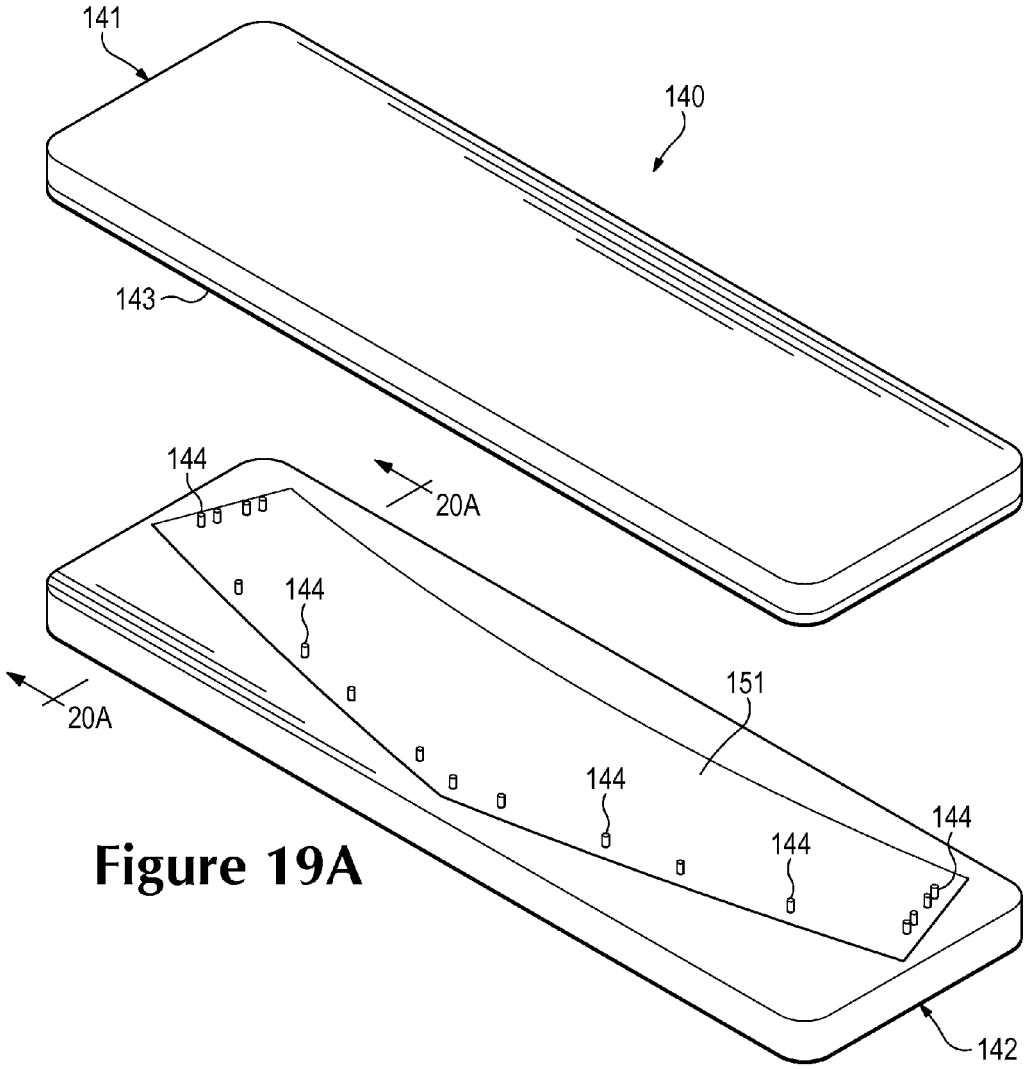
FIGS. 19A-19H are perspective views of a manufacturing process for the second tensile strand element.
Figure 19B:
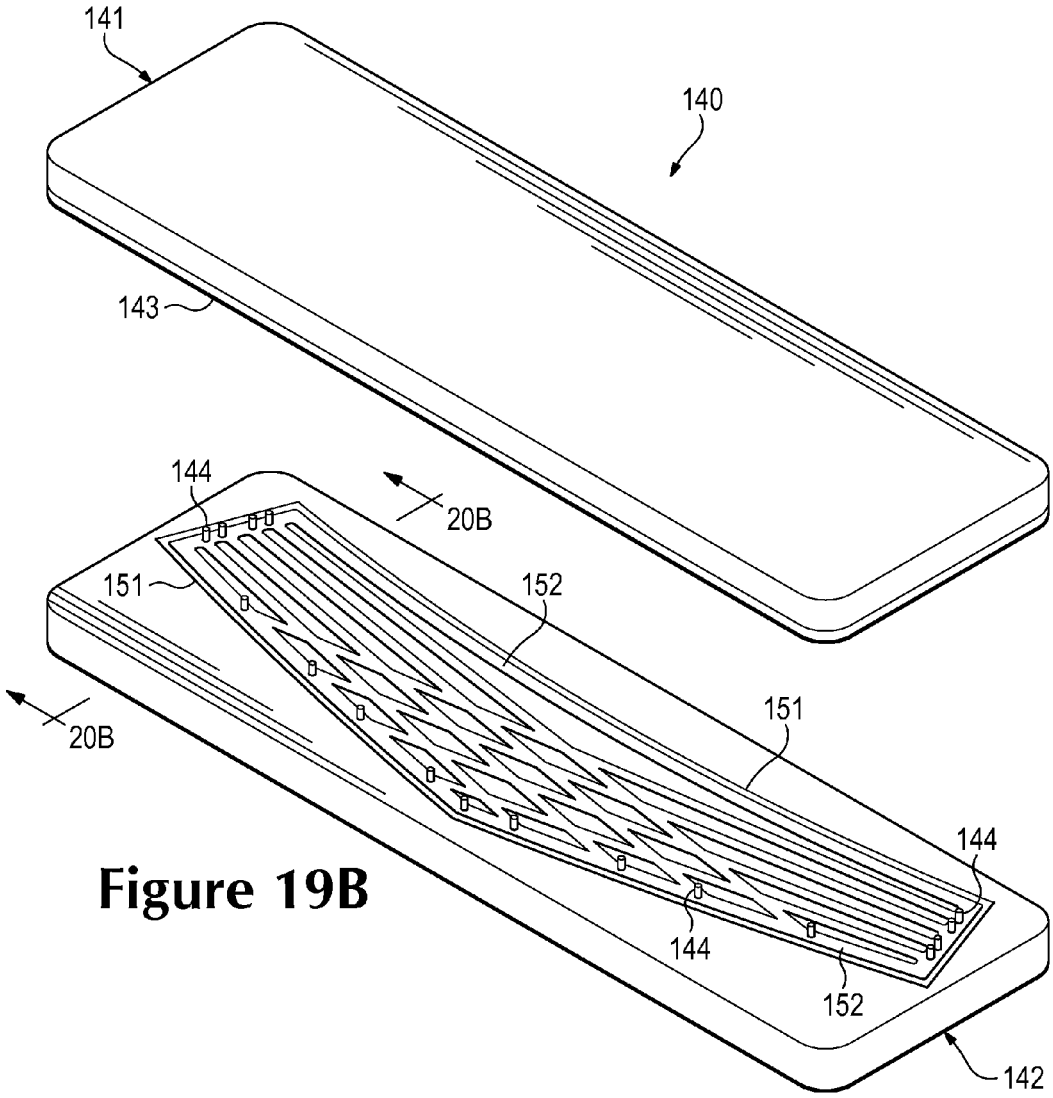
Figure 19C:
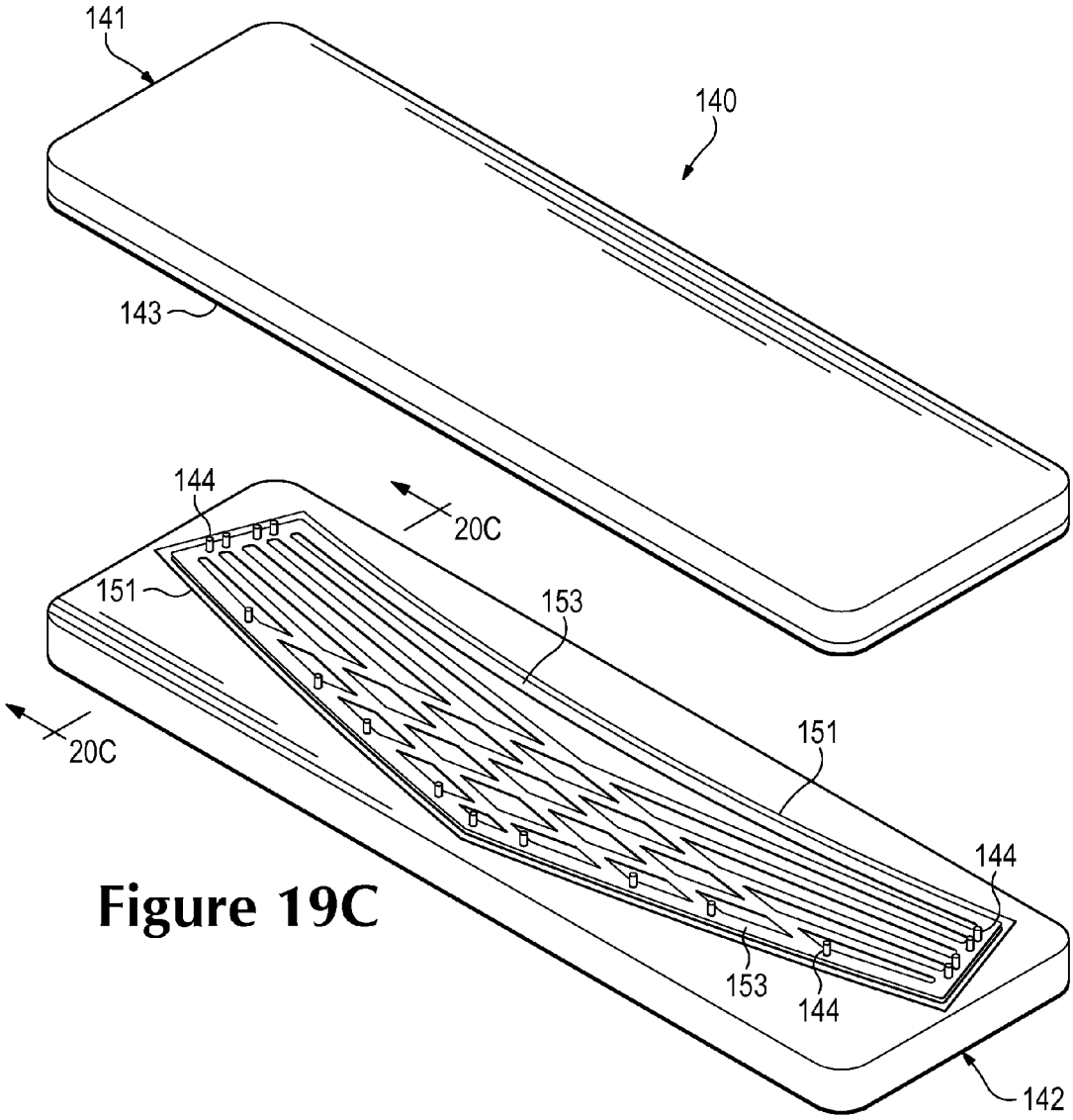
Figure 19D:
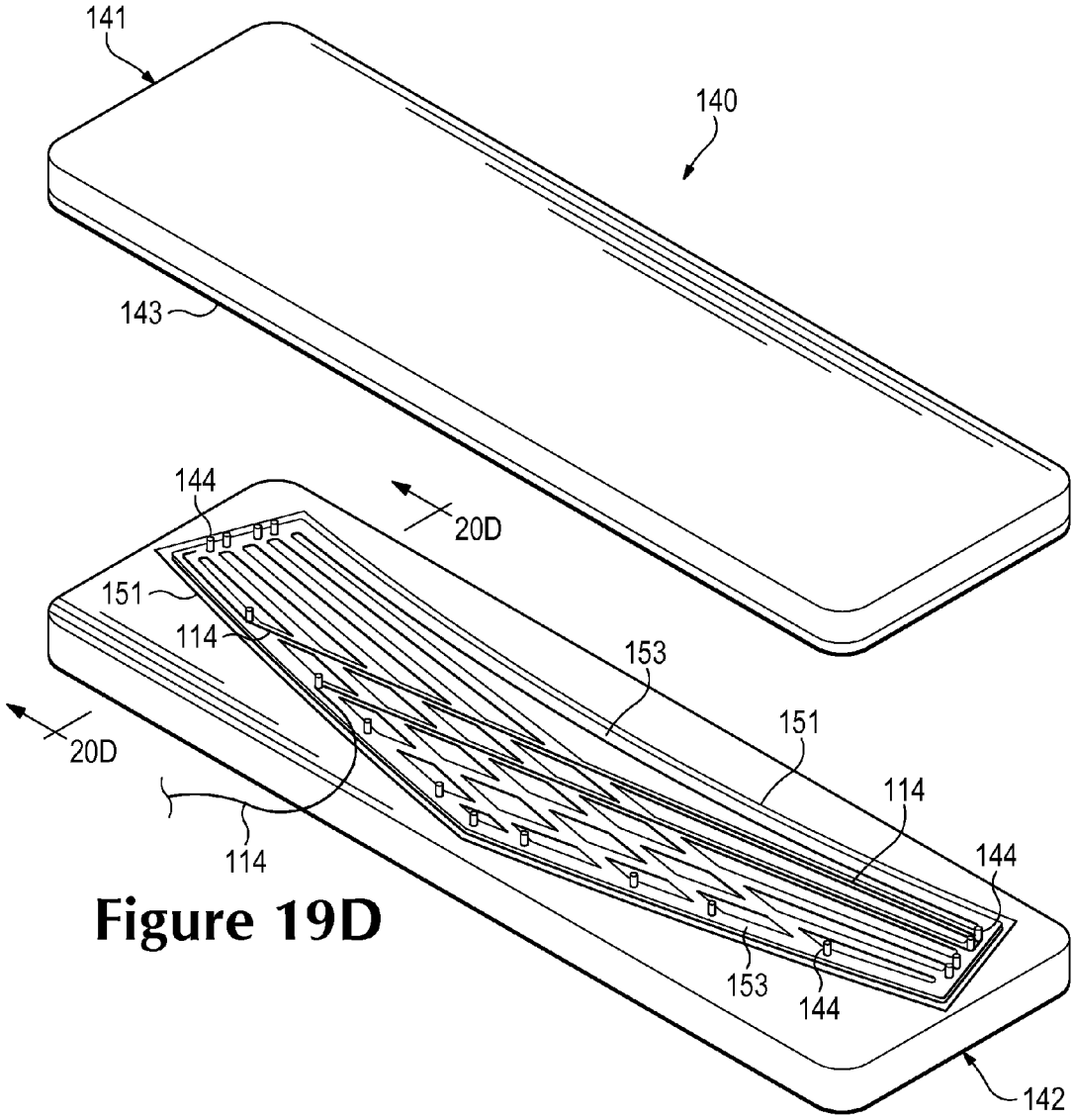
Figure 19E:
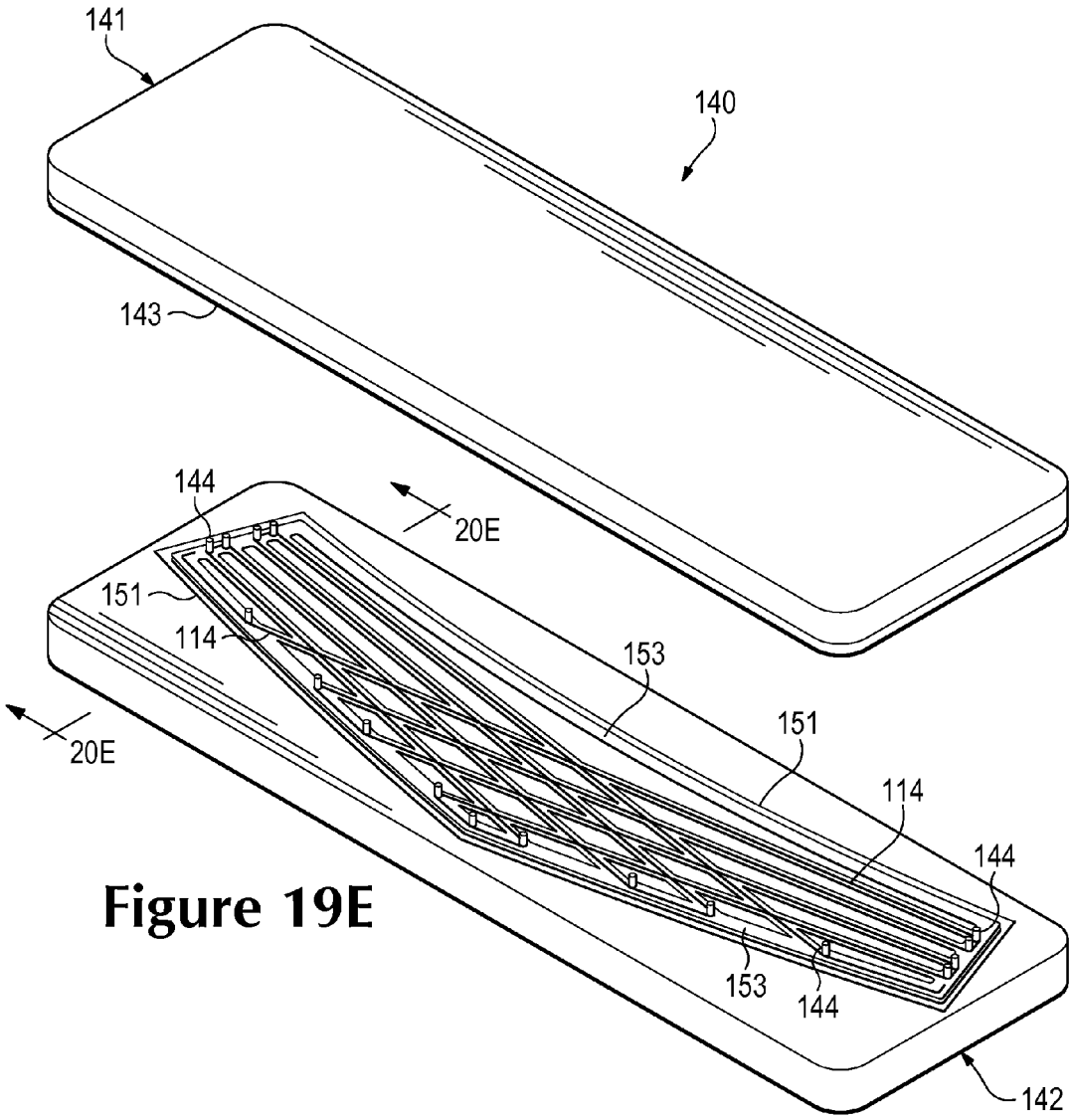
Figure 19F:
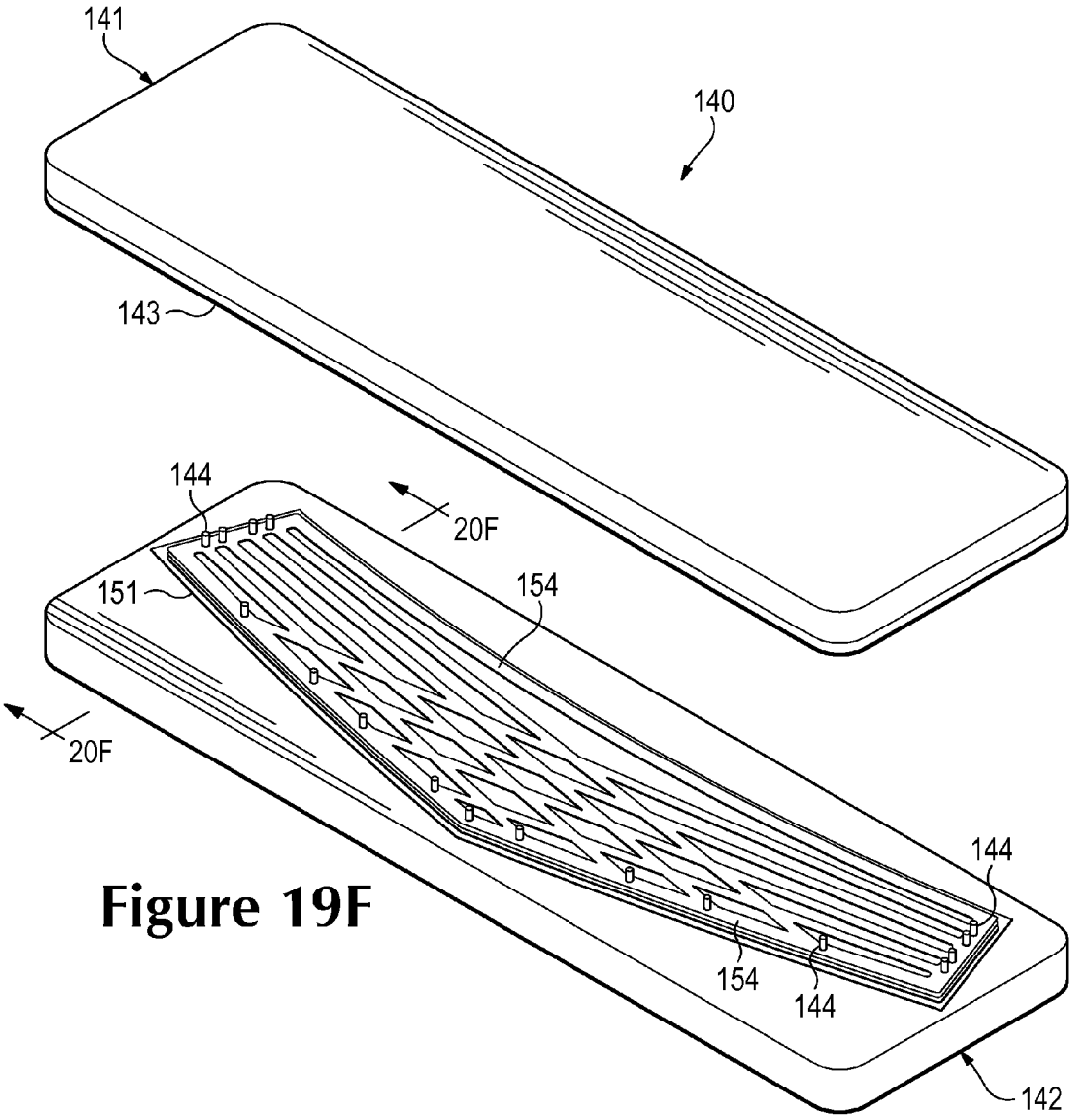
Figure 20A:
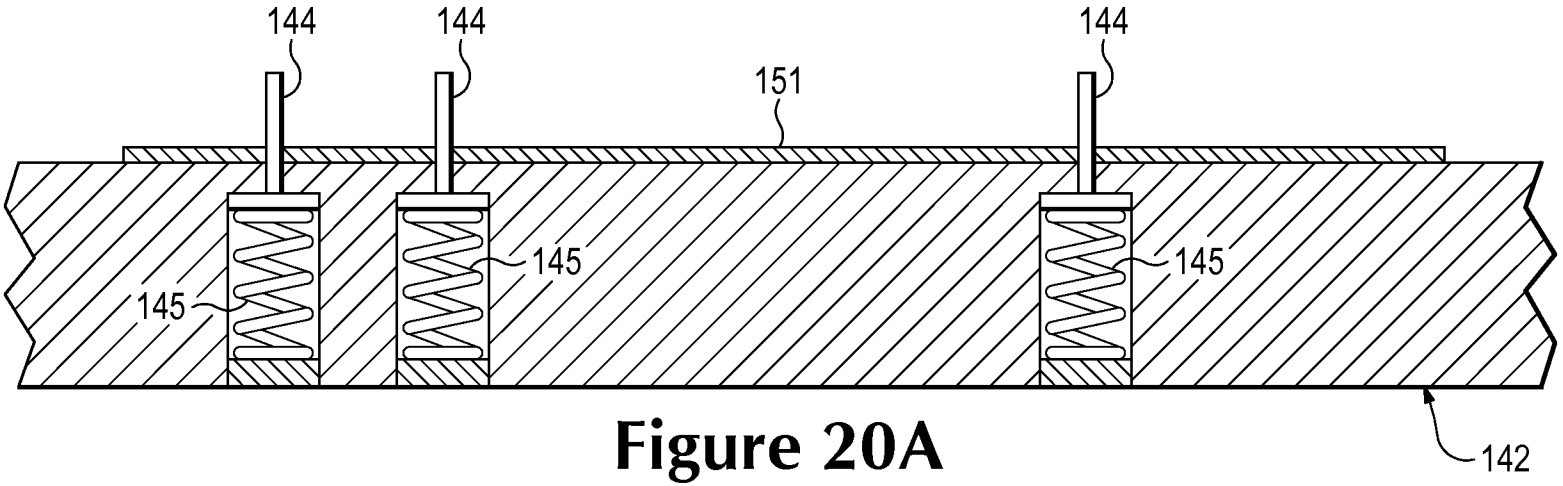
FIGS. 20A-20H are schematic cross-sectional views of the manufacturing process for the second tensile strand element.
Figure 20B:
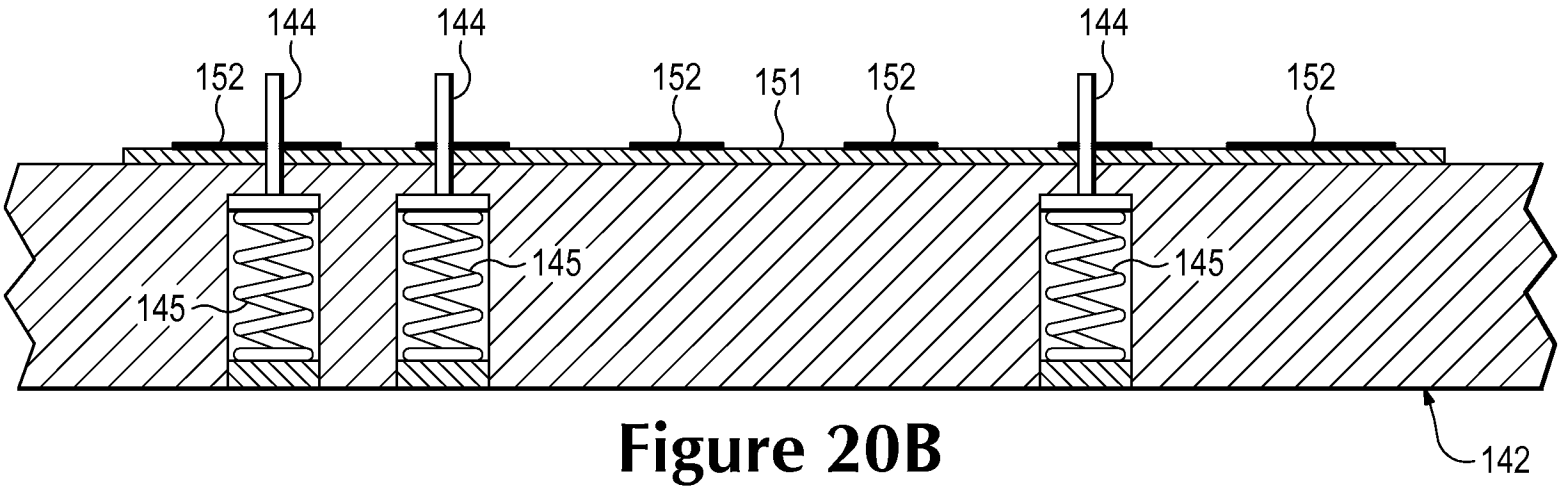
Figure 20C:
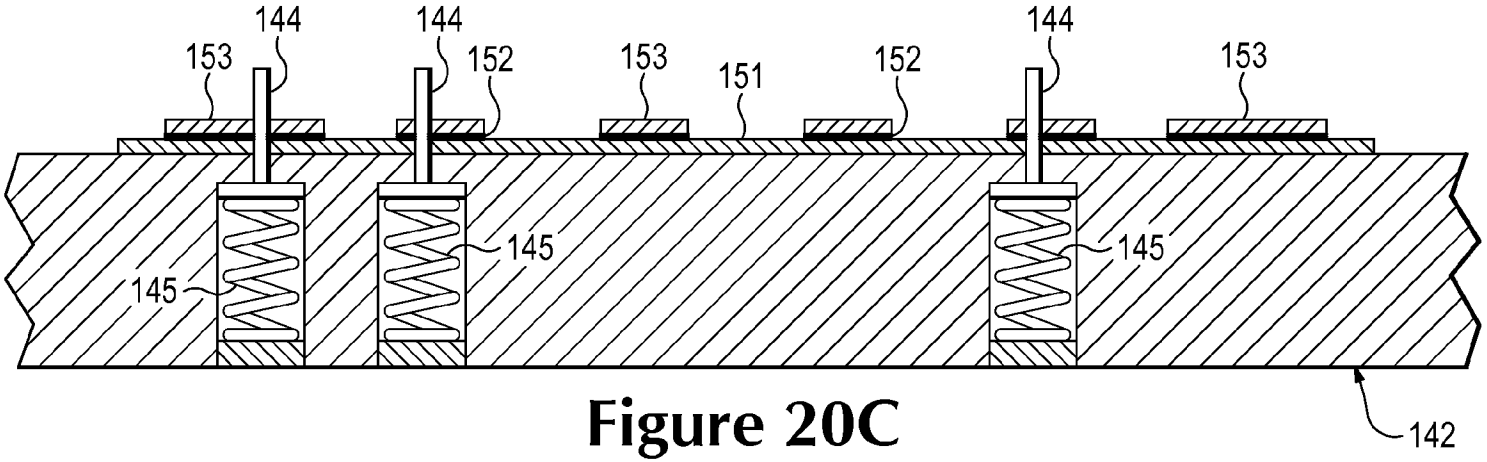
Figure 20D:
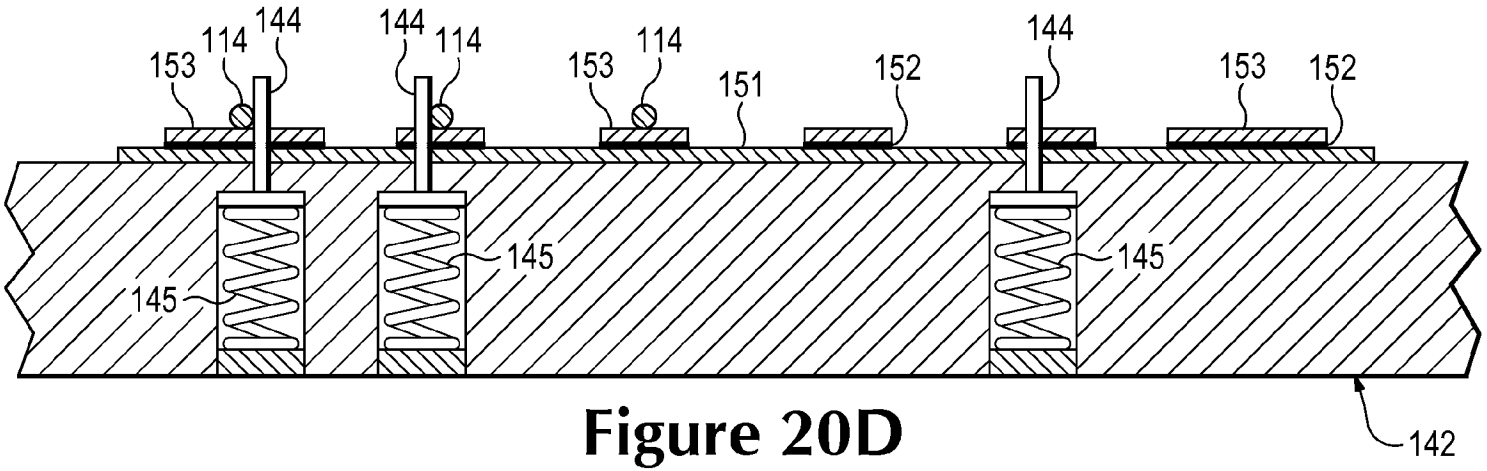
Figure 20E:
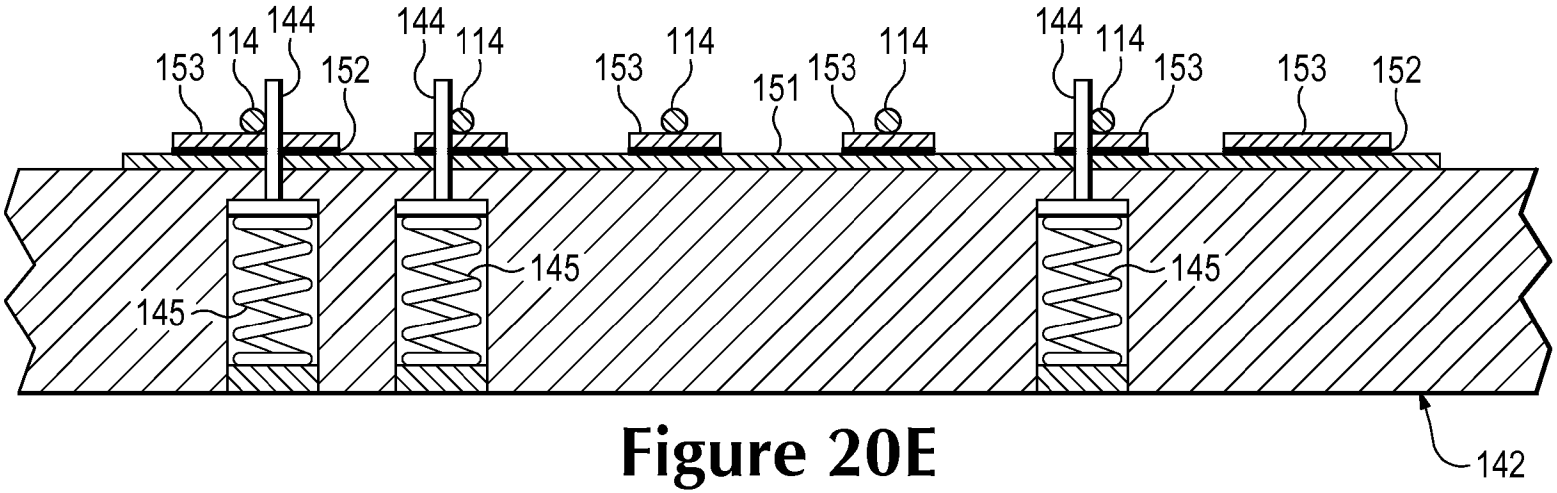
Figure 20F:
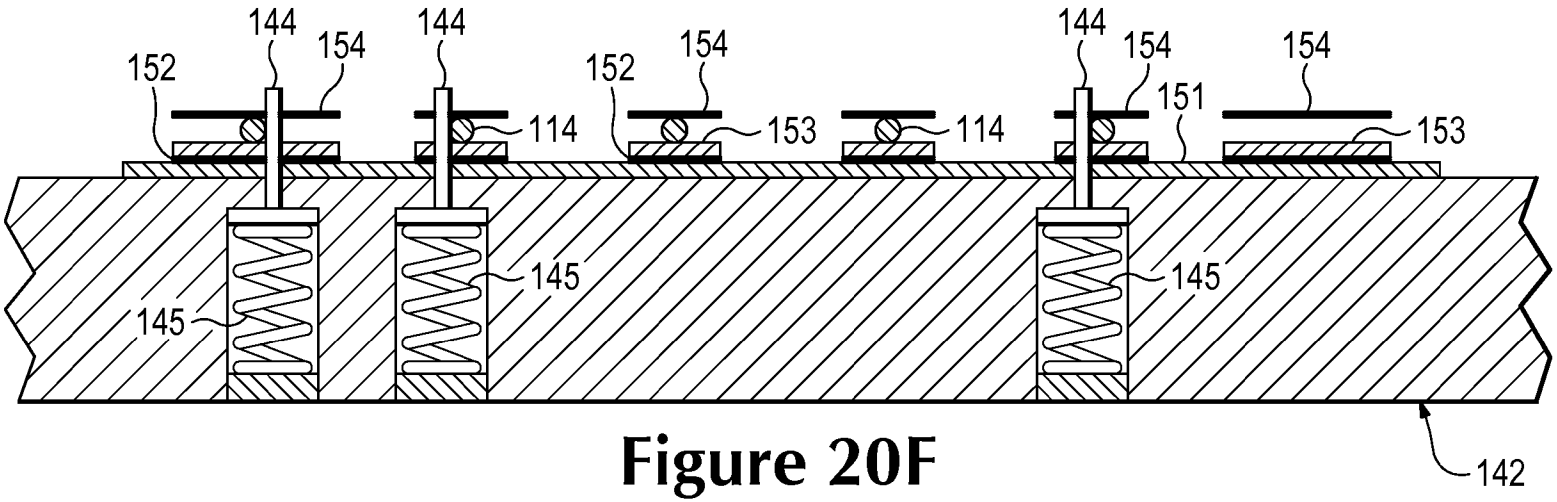

In assembling tensile strand element 150, base layer 151 is initially placed upon pin plate 142, as depicted in FIGS. 19A and 20A. When properly positioned, pins 144 protrude through base layer 151 in various locations at the periphery of base layer 151. Once base layer 151 is positioned, securing element 152 is placed upon base layer 151, as depicted in FIGS. 19B and 20B, such that pins 144 protrude therethrough. Similarly, backing layer 153 is placed upon securing element 152, as depicted in FIGS. 19C and 20C, such that pins 144 protrude therethrough. At this stage, the strand forming strand segments 114 is wound around some of pins 144, as depicted in FIGS. 19D and 20D, to begin the process of locating strand segments 144 relative to other components. The strand is then wound around a remainder of pins 144, as depicted in FIGS. 19E and 20E, to complete the positioning of strand segments 114. Once strand segments 114 are properly positioned, cover layer 154 is placed over strand segments 114, as depicted in FIGS. 19F and 120F.

Figure 19G:
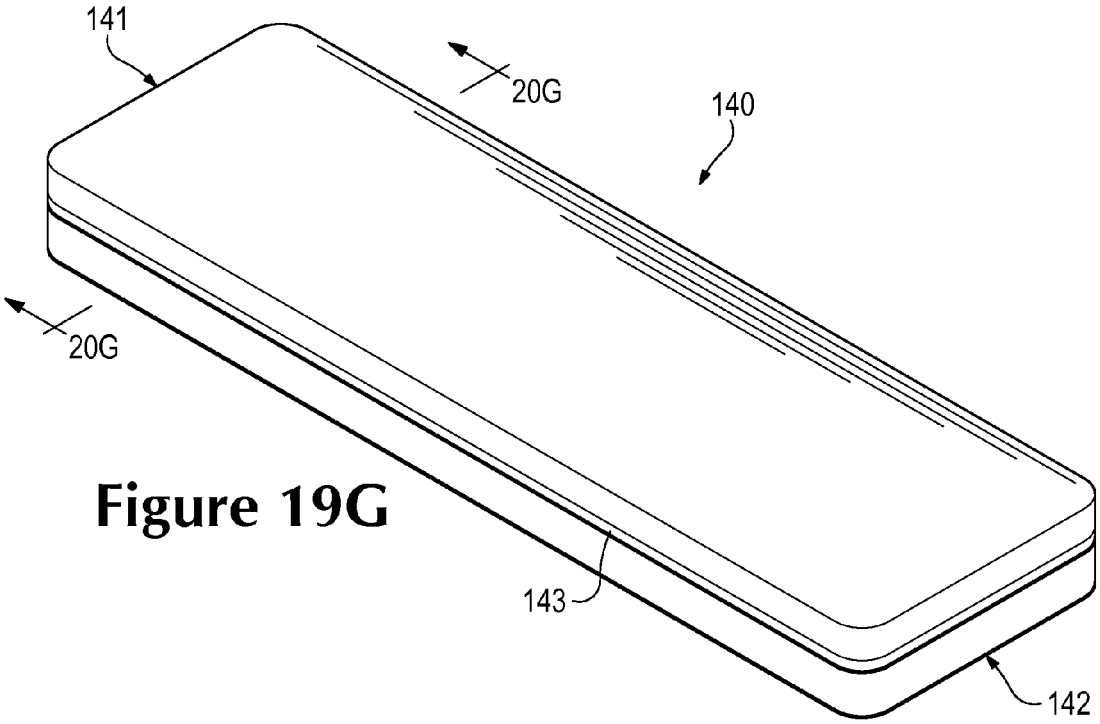
Figure 19H:
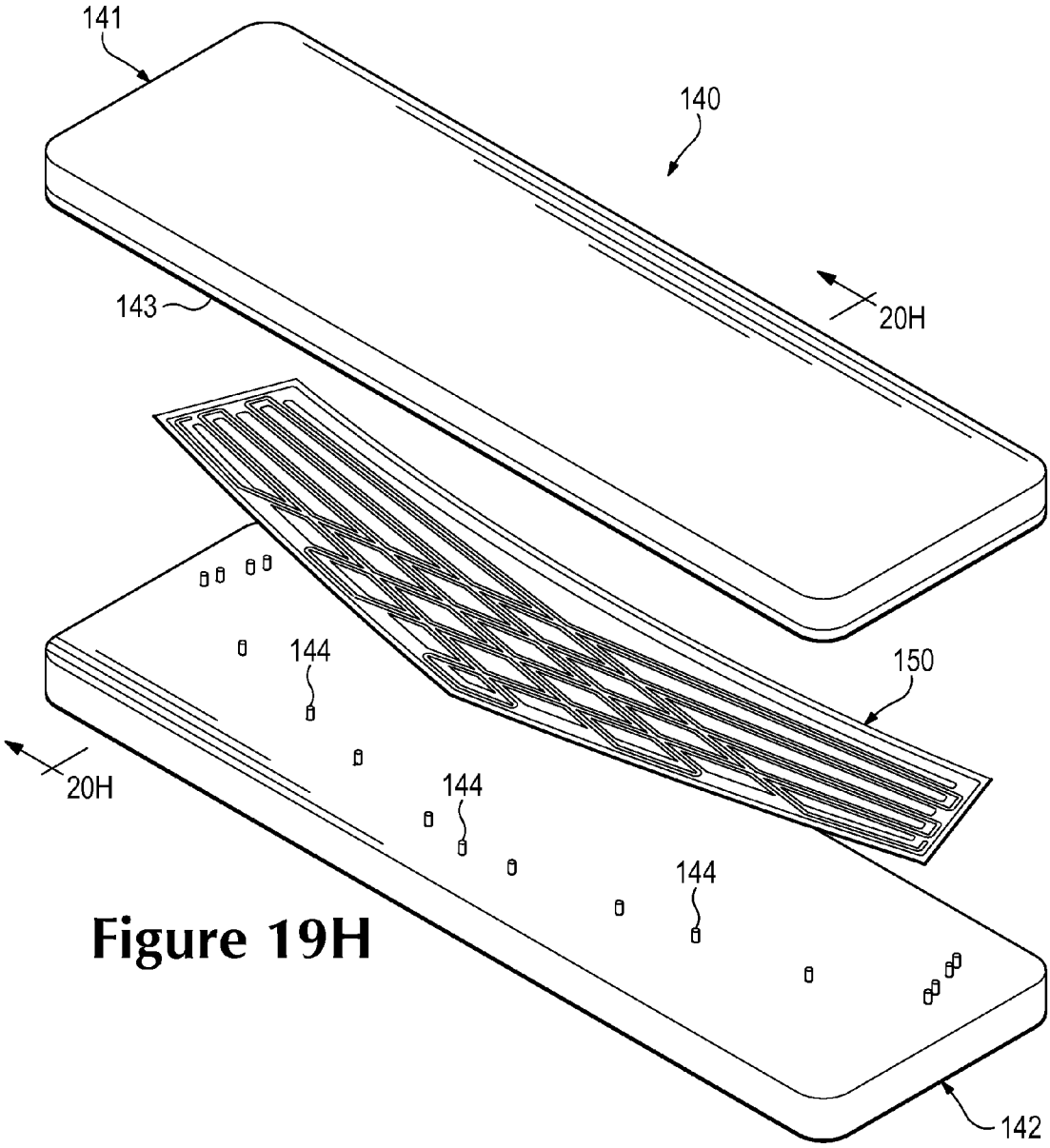
Figure 20G:
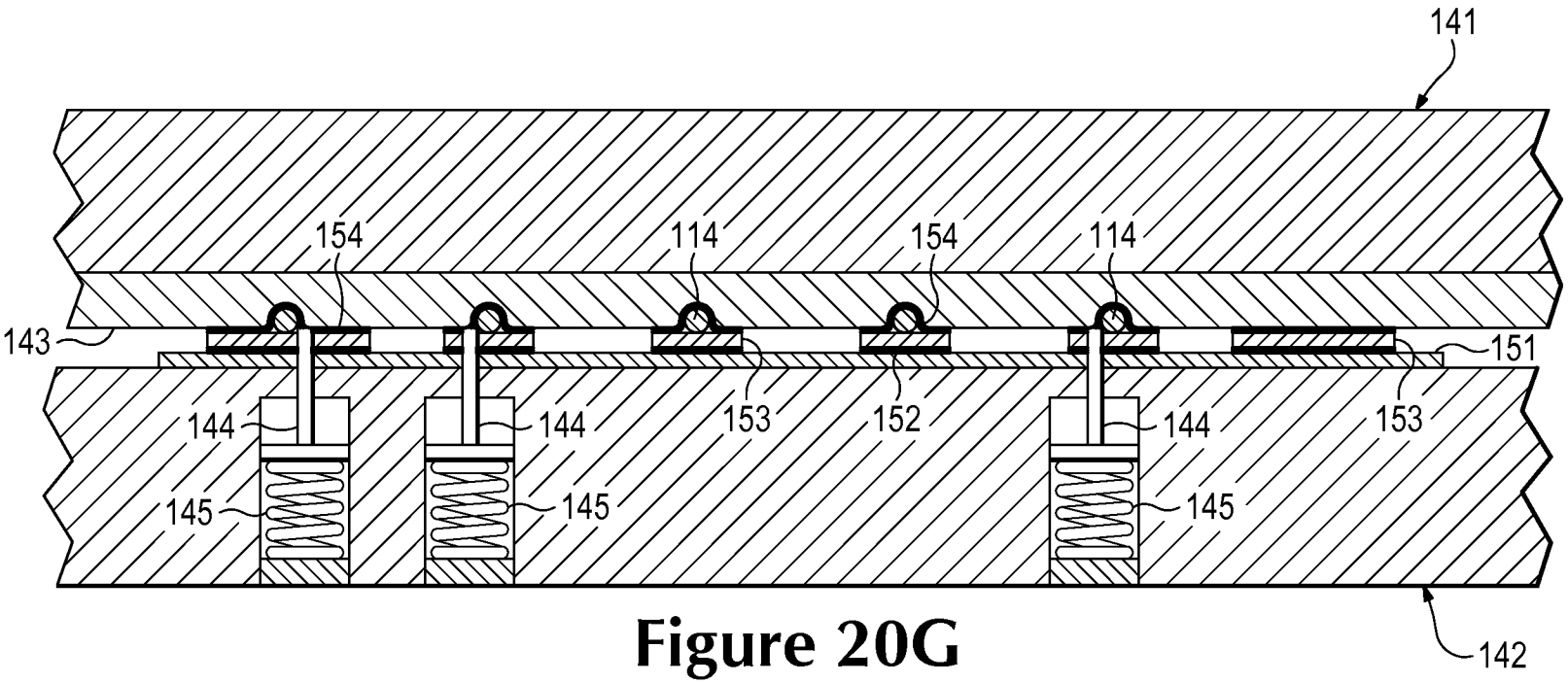
Figure 20H:
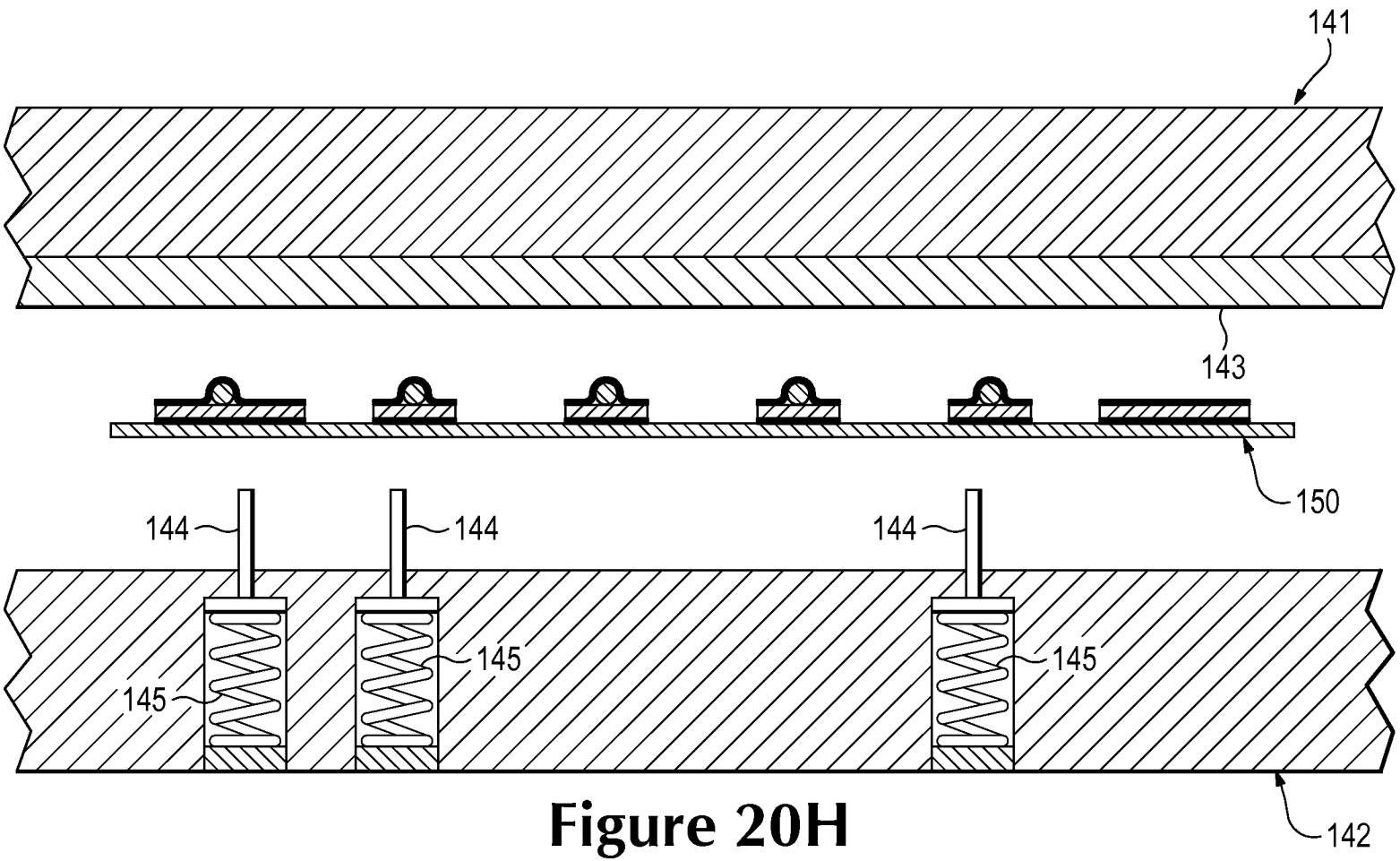

At this stage of the manufacturing process, the various components of tensile strand element 150 are properly arranged and assembled upon pin plate 142. Press plate 141 then translates toward the components and compresses the components, as depicted in FIGS. 19G and 20G. The downward pressure of press plate 141 induces pins 144 to compress springs 145 and retreat into pin plate 142. Additionally, press plate 141 heats the components of tensile strand element 150 to secure the components together. More particularly, heat from press plate 141 increases the temperature of securing element 152 and cover layer 154 and melts or otherwise softens the thermoplastic polymer materials forming securing element 152 and cover layer 154 to bond the components together. As with the procedure discussed above for tensile strand element 140, areas of tensile strand element 150 adjacent to strand segments 114 may protrude into compressible element 143. Once bonding is complete, press plate 141 separates from pin plate 142 to permit the removal of tensile strand element 150, as depicted in FIGS. 19H and 20H. Upon cooling, the thermoplastic polymer materials of securing element 152 and cover layer 154 hardens or otherwise solidifies to securely join the components and secure strand segments 114 within tensile strand element 150.

Lace Elements

Figure 21:
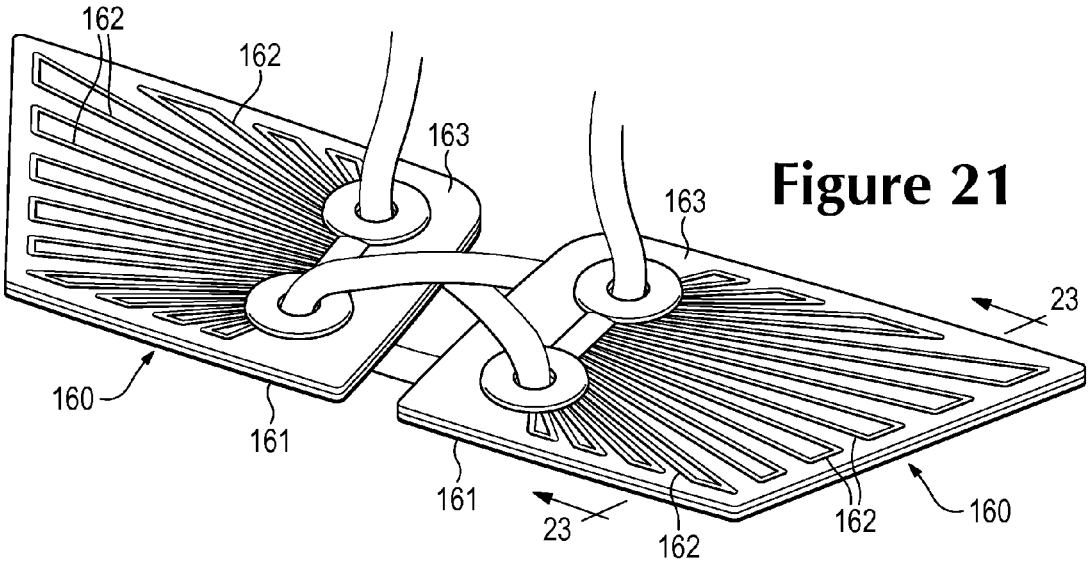
FIG. 21 is a perspective view of a pair of lace elements and a lace from the second article of apparel.
Figure 22:
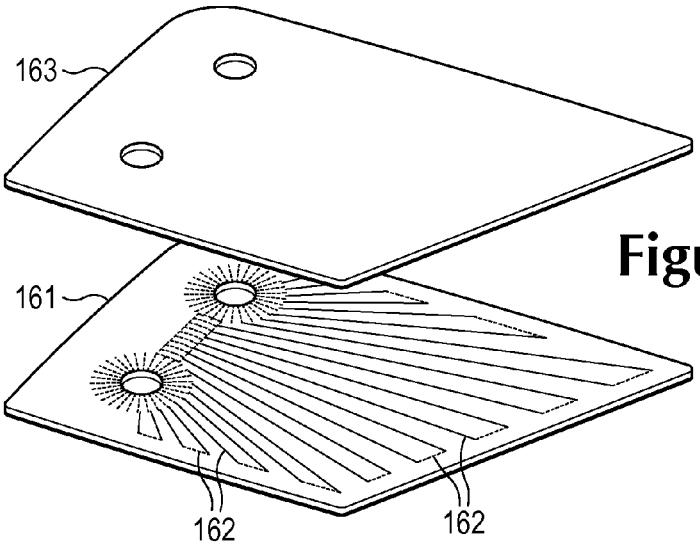
FIG. 22 is an exploded perspective view of the lace elements.
Figure 23:
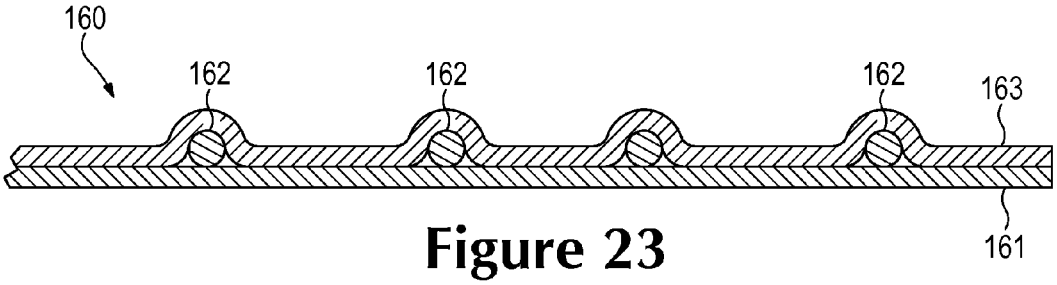
FIG. 23 is a cross-sectional view of one of the lace elements, as defined by section line 23 in FIG. 21.

A pair of lace elements 160, which are depicted in FIGS. 21-23, are located in the front area of waistband 111 and define the various apertures 113 through which lace 112 extends. Lace elements 160 include a base layer 161, a plurality of strand segments 162, and a cover layer 163. The strand forming strand segments 162 may be stitched to base layer 161, and cover layer 163 is placed over strand segments 162 and joined to both base layer 161 and strand segments 162. Strand segments 162 are, therefore, located between and joined to layers 161 and 163. Layers 161 and 163 may each be formed from a variety of materials, including textile elements, polymer sheets, and other materials.

Base layer 161 and cover layer 163 cooperatively define the various apertures 113. The strand forming strand segments 162 may be stitched around apertures 113 to effectively reinforce apertures 113. The strand also extends outward from apertures 113 to form the various strand segments 162. Moreover, strand segments 162 cooperatively resist stretch from lace 112 as it extends through apertures 113. Strand segments 162 also radiate outward from apertures 113, thereby distributing the forces from lace 112 to waistband 111.

A variety of methods may be utilized to manufacture lace elements 160. As an example, an embroidery process may be utilized to locate strand segments 114 relative to base layer 161. Once strand segments 114 are positioned, cover layer 163 may be bonded to base layer 161 and strand segments 114, thereby securing strand segments 114 within each of lace elements 160. In some processes, a thermoplastic material may be added to base layer 161 prior to embroidery, and the thermoplastic material may be utilized to bond the elements together. In other processes, the thermoplastic material may be incorporated into cover layer 163 or may be a separate element that extends between layers 161 and 163. In yet further processes, an adhesive or other method of joining the elements may be utilized. In yet another process, cover layer 163 may be formed from a sheet of thermoplastic polymer material that both covers strand segments 162 and bonds strand segments 162 to base layer 161. Similar processes are described in relation to footwear in U.S. Pat. No. 7,574,818 to Meschter, which is entirely incorporated herein by reference. As an alternative to an embroidery process, other stitching processes may be utilized to locate strand segments 114 relative to base layer 161, such as computer stitching. Additionally, processes similar to the manufacturing processes for tensile strand elements 130 and 150 may be utilized.

Further Configurations

The configuration of apparel 100 discussed above, as well as the configurations of tensile strand elements 130 and 150, provide examples of suitable configurations that incorporate strand segments 114 for purposes of resisting stretch in waistband 111. A variety of other configurations that resist stretch or impart other purposes may also be utilized. That is, various configurations of apparel 100 and elements of apparel 100 are also contemplated.

Figure 24A:
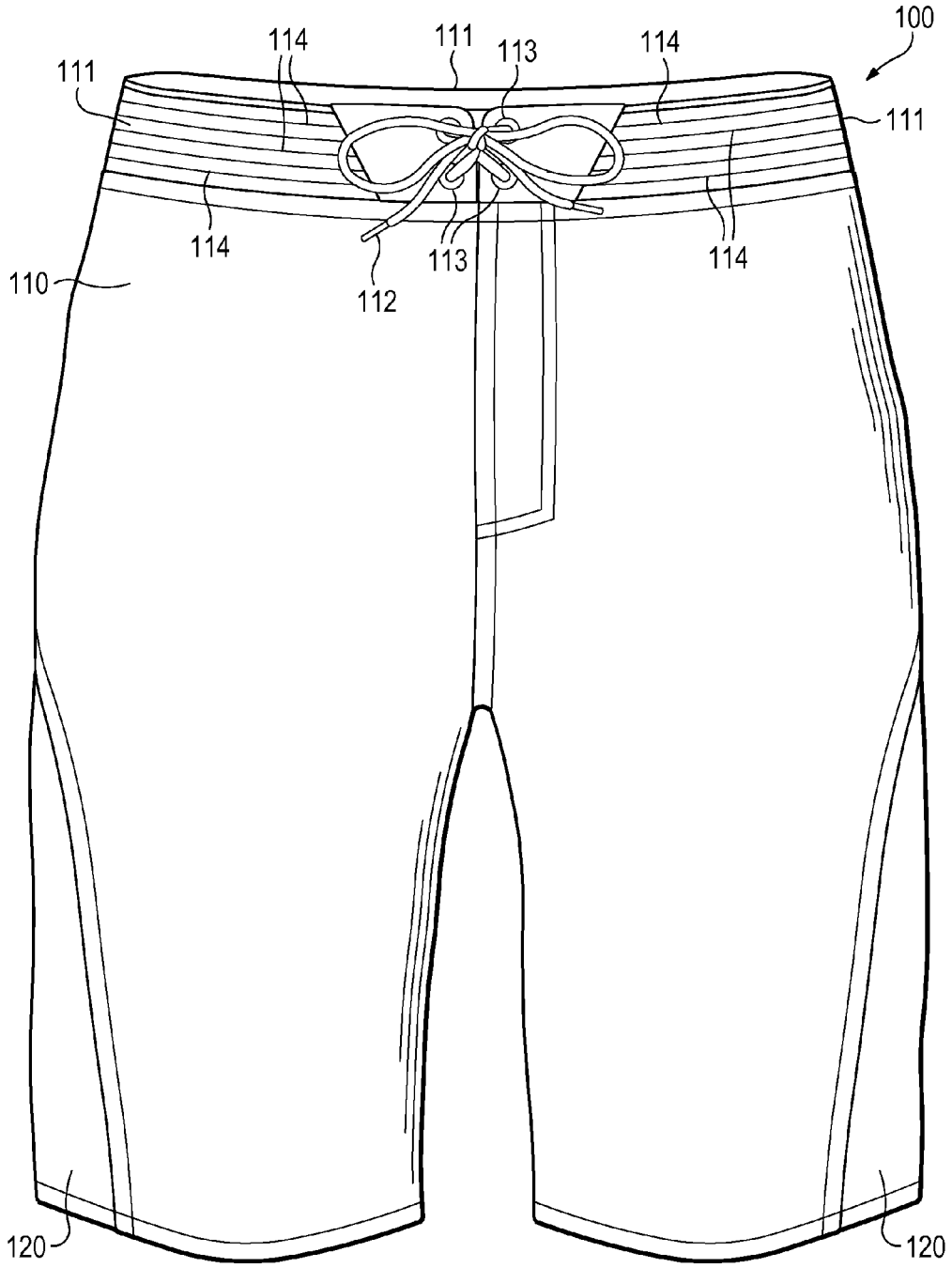
FIGS. 24A-24D are front elevational views corresponding with FIG. 2 and depicting further configurations of the article of apparel.
Figure 25A:
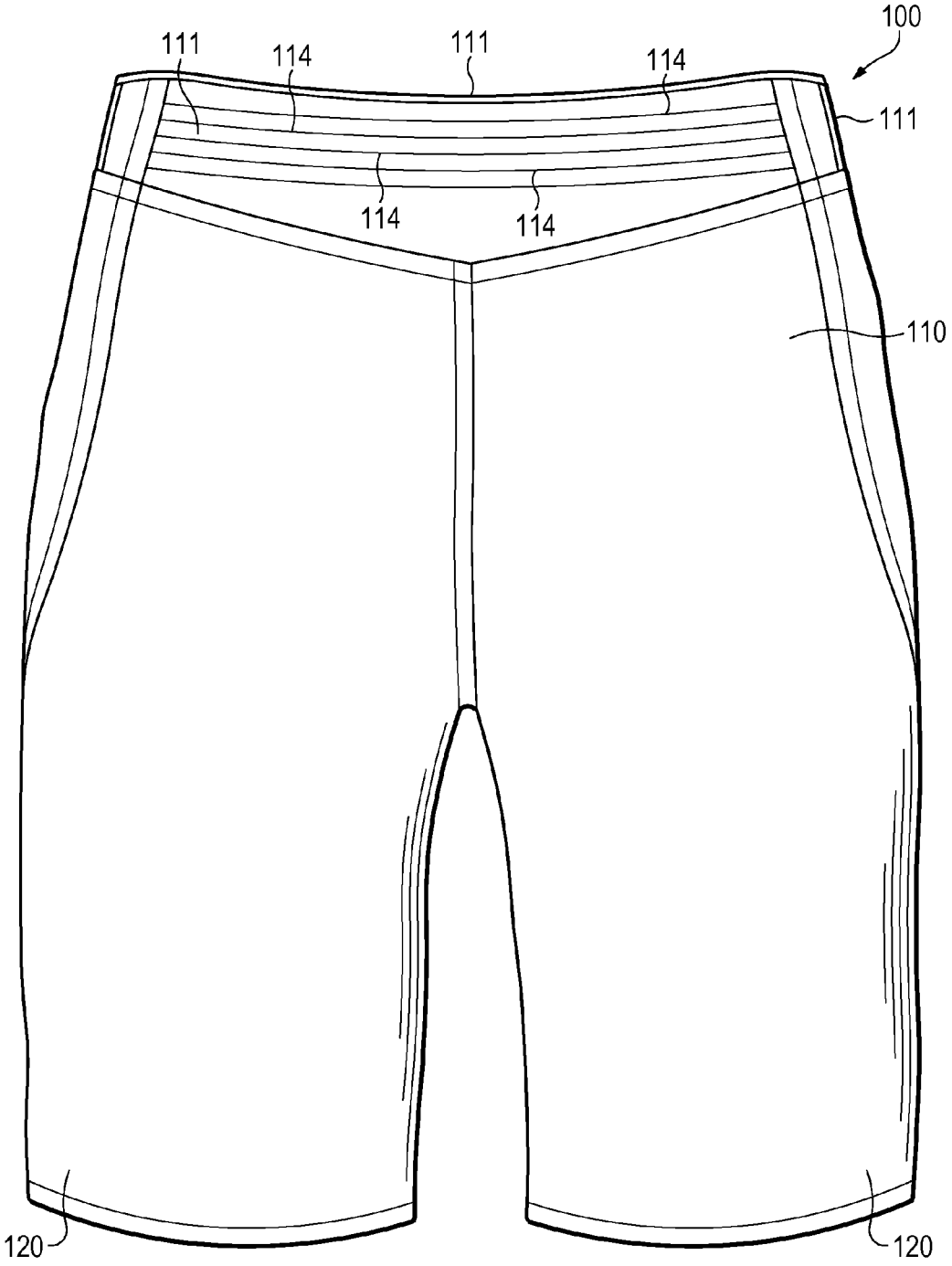
FIGS. 25A-25B are rear elevational views corresponding with FIG. 3 and depicting further configurations of the second article of apparel.

With reference to FIGS. 24A and 25A, apparel 100 is depicted as having a configuration wherein strand segments 114 extend substantially horizontally around waistband 111. That is, strand segments 114 extend in a direction that is generally parallel to the upper opening defined by waistband 111. Whereas strand segments 114 in tensile strand elements 130 and 150 are angled, strand segments 114 in these configurations extend horizontally. Although angled strand segments 114 impart sufficient stretch resistance, for example, horizontally-oriented strand segments may impart a greater degree of stretch resistance.

Figure 24B:
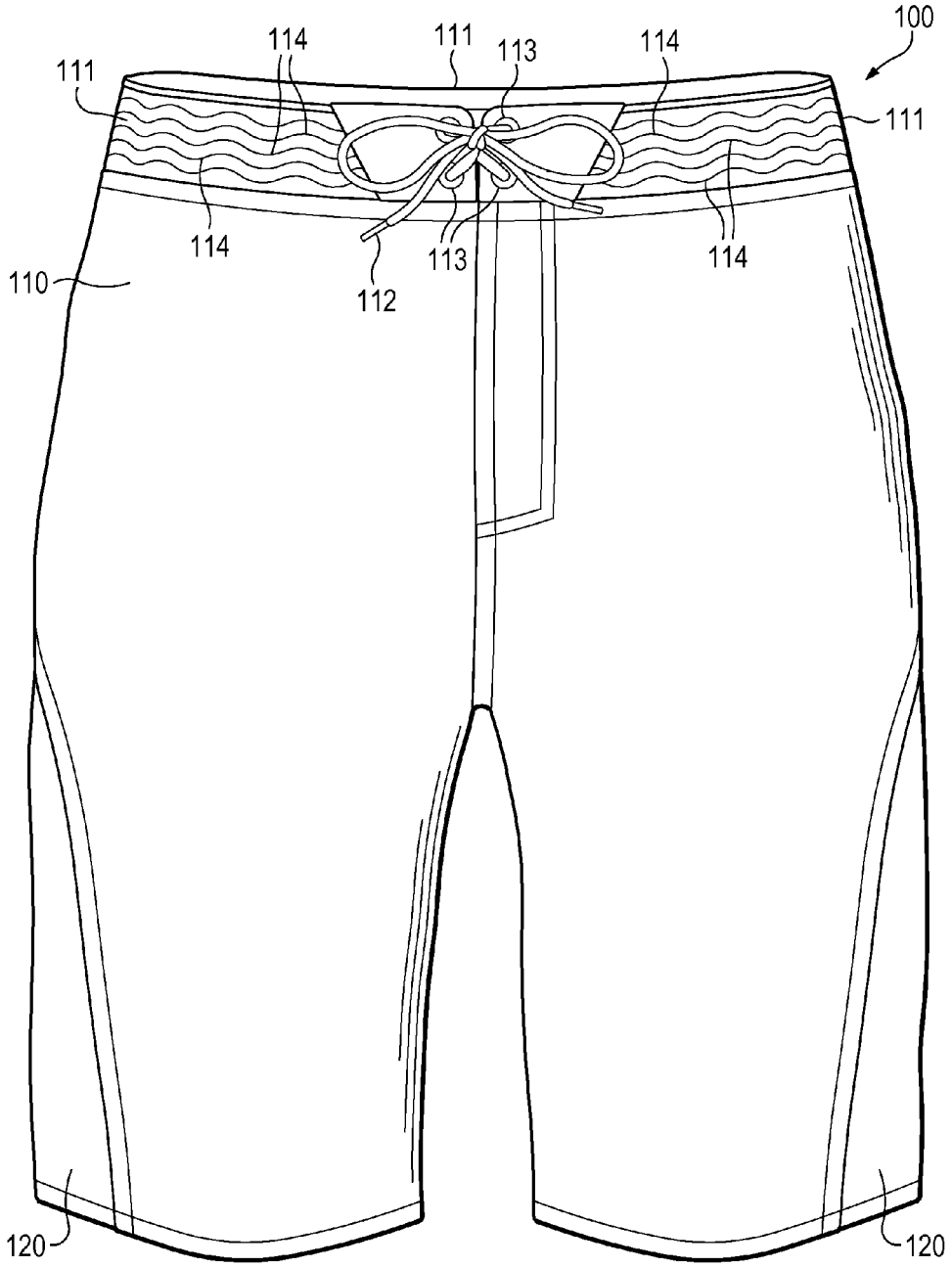

As an opposite configuration to FIGS. 24A and 25A, FIG. 24B depicts a structure wherein strand segments 114 exhibit a wavy or non-linear configuration. As discussed above, strand segments 114 may resist stretch in waistband 111, but the non-linear areas of strand segments 114 may allow some stretch in waistband 111. As strand segments 114 straighten due to the stretch, however, strand segments 114 may then resist stretch waistband 111. Accordingly, this configuration imparts an initial degree of stretch, but then limits stretch once strand segments 114 straighten.

Figure 24C:
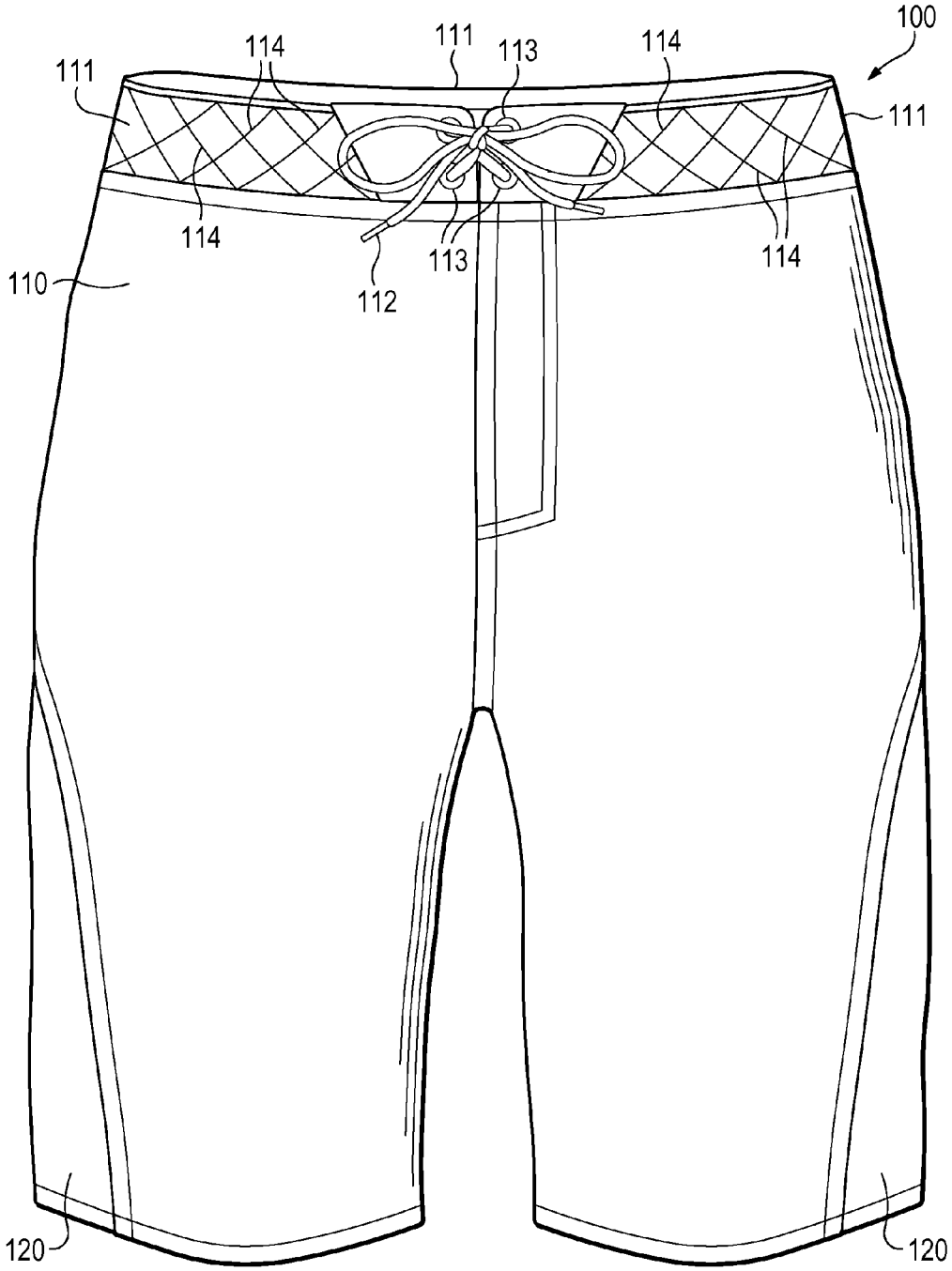
Figure 24D:
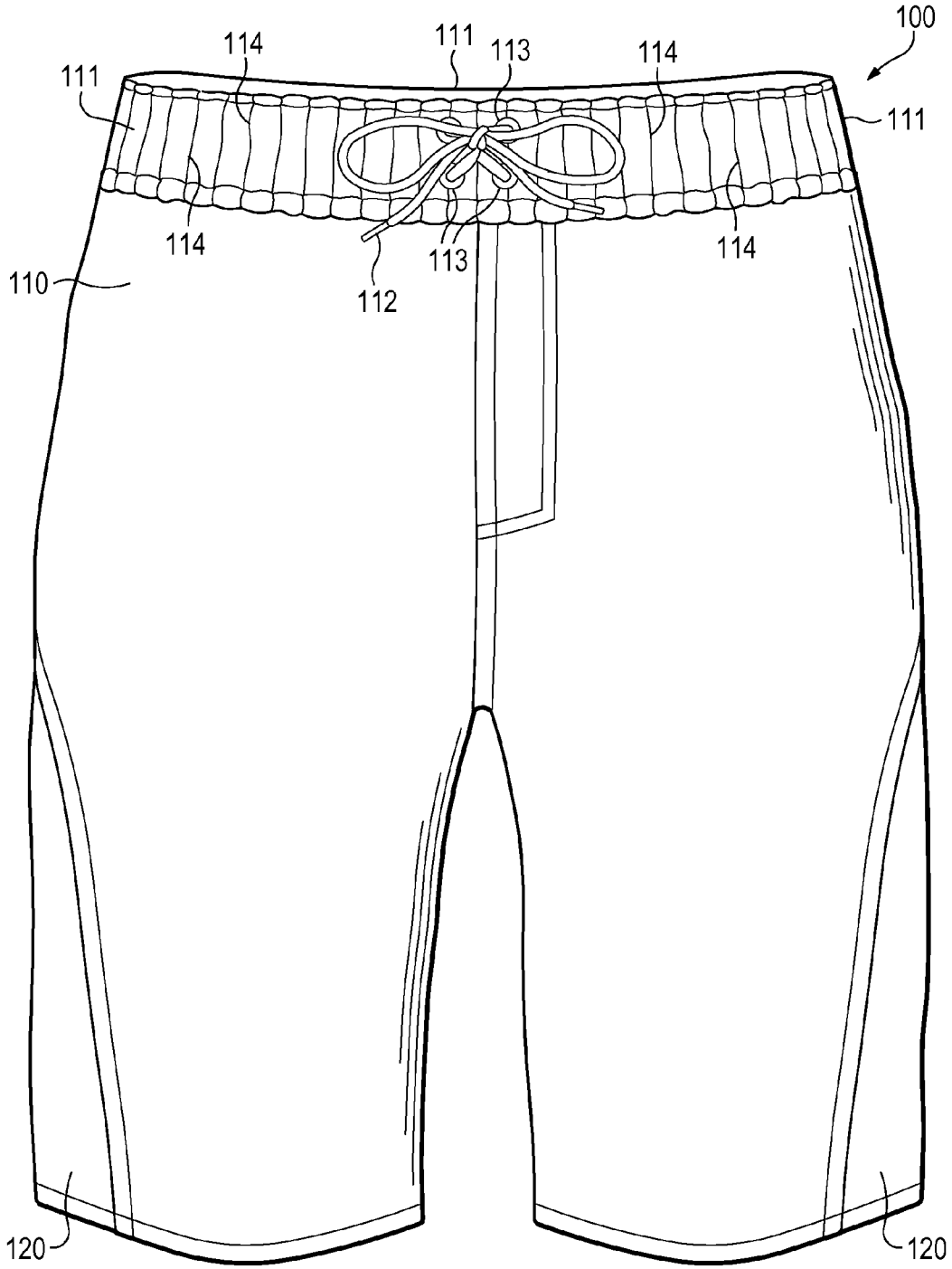

An additional configuration is depicted in FIG. 24C, wherein strand segments 114 cross each other in the front area of waistband 111. Additionally, FIG. 24D depicts a configuration wherein an elastic material is incorporated into the front area of waistband 111. In this configuration, lace 112 may extend through waistband 111 and pass around to the rear area, where either of tensile strand elements 130 or 150 may be present. As such, the non-stretch properties of tensile strand elements 130 or 150 may be coupled with areas of waistband 111 that exhibit relatively high degrees of stretch.

Figure 25B:
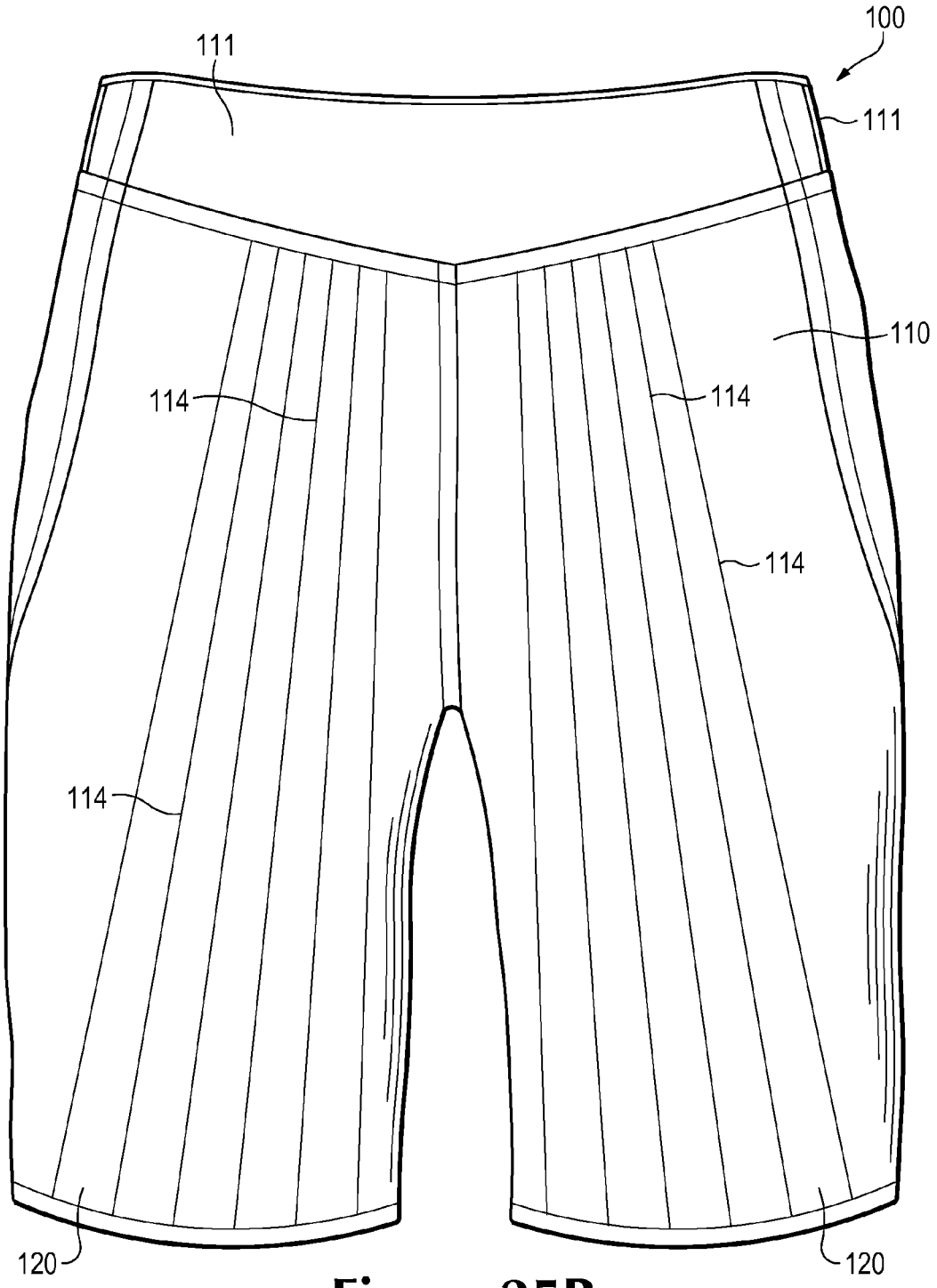

Each of the configurations discussed above incorporate strand segments 114 in waistband 111. Strand segments 114 may, however, be utilized in other areas of apparel 100. Referring to FIG. 25B, for example, strand segments 114 extend in a generally vertical direction through portions of regions 110 and 120. In further configurations, strand segments 114 may be located in the front area of apparel 100, may extend horizontally through leg regions 120, or may have a crossed configuration in either of regions 110 and 120.

Figure 26A:
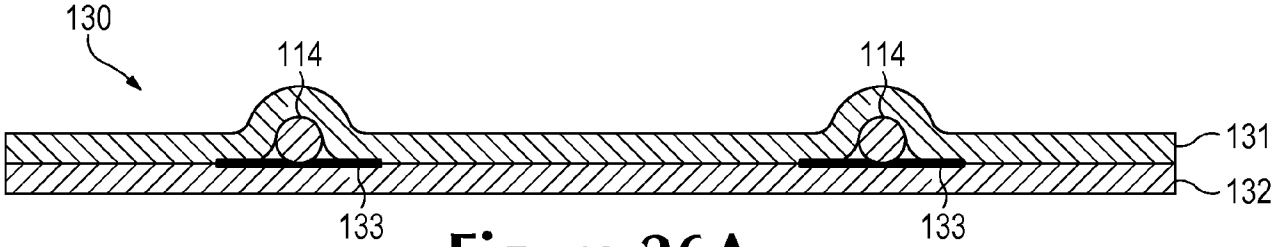
FIGS. 26A-26E are cross-sectional views corresponding with FIG. 10A and depicting further configurations of the first tensile strand element.
Figure 26B:
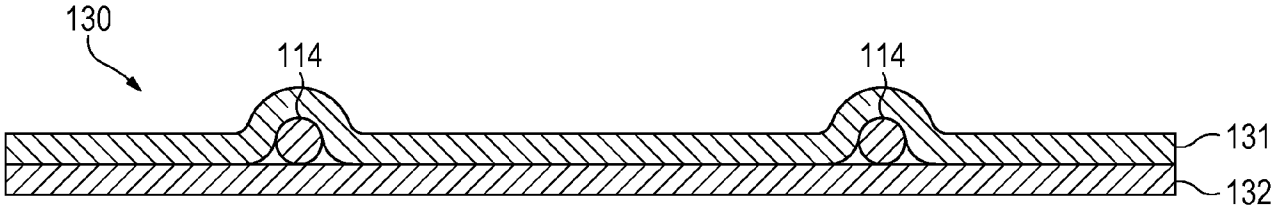
Figure 26C:
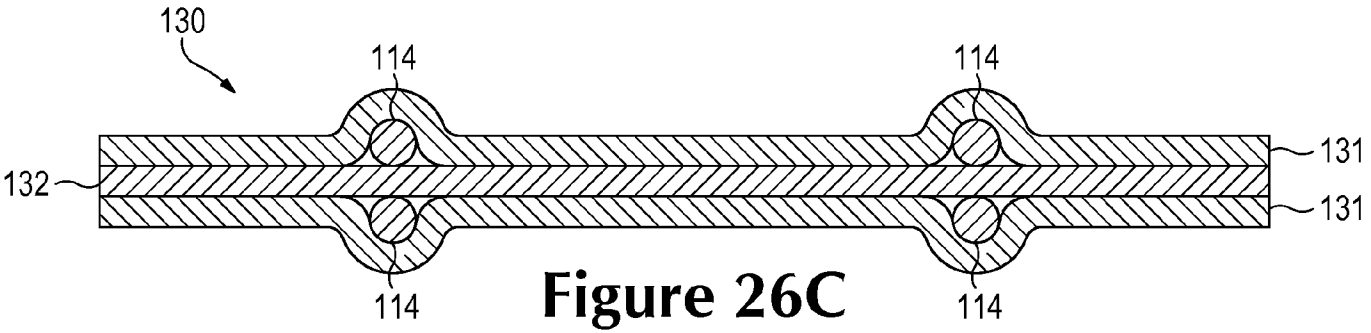
Figure 26D:
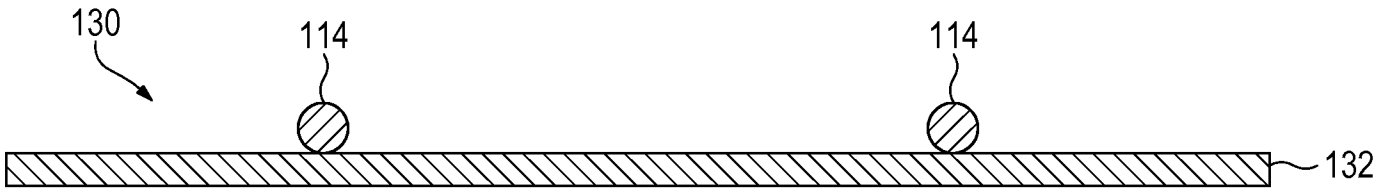
Figure 26E:
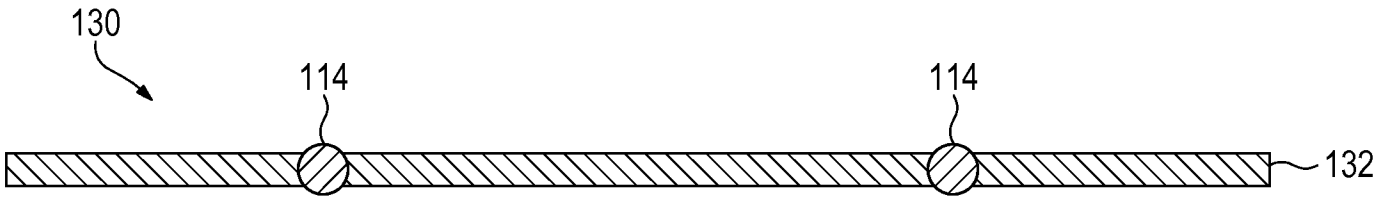

Aspects associated with the structure of tensile strand element 130 may also vary from the configuration discussed above. Referring to FIG. 26A, a single securing element 133 is positioned between layers 131 and 132 and utilized to (a) secure strand segments 114 within tensile strand element 130 and (b) join layers 131 and 132 to each other. Both of securing elements 133 may also be absent, as depicted in FIG. 26B, when an adhesive is utilized or when one of layers 131 and 132 incorporates a thermoplastic polymer material that is suitable for joining the elements. When manufacturing processes that involve embroidery are utilized, strand segments 114 may be located on opposite sides second layer 132, as depicted in FIG. 26C. In some configurations, strand segments 114 may be exposed, as depicted in FIG. 26D, or may be embedded within second layer 132, as depicted in FIG. 26E.

Figure 27A:
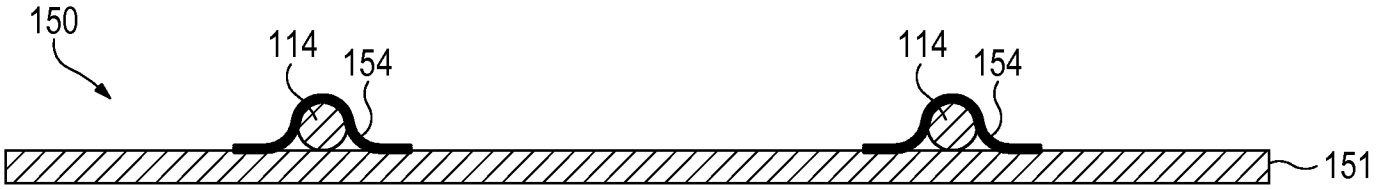
FIGS. 27A-27C are cross-sectional views corresponding with FIG. 18A and depicting further configurations of the second tensile strand element.
Figure 27B:
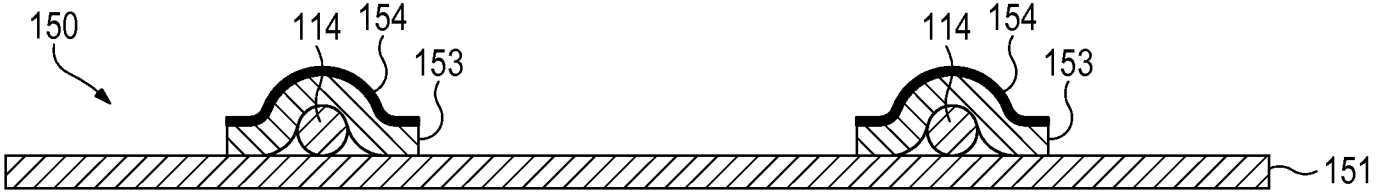
Figure 27C:
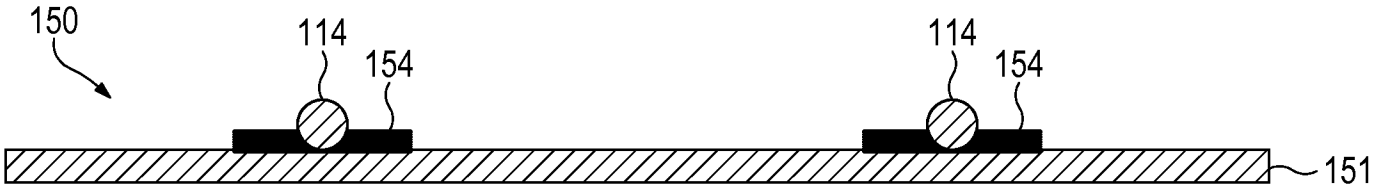

Many of the alternate configurations discussed above for tensile strand element 130 may also be applied to tensile strand element 150. Furthermore, FIG. 27A depicts a configuration wherein tensile strand element 150 includes base layer 151, cover layer 154, and strand segments 114. Securing element 152 and backing layer 153 may, therefore, be absent from some configurations. Strand segments 114 may also be located between base layer 151 and backing layer 153, as depicted in FIG. 27B. Additionally, a configuration wherein strand segments 114 are embedded within cover layer 154 is depicted in FIG. 27C.

The invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. An article of apparel comprising:

a pelvic region for covering a pelvic area of a wearer, the pelvic region including a waistband for extending around a waist of the wearer, the waistband having:

a cover layer and a base layer that lay adjacent to each other, the cover layer forming a portion of an exterior surface of the apparel, and the cover layer defining a pair of spaced edges, and a strand segment located between the cover layer and the base layer, the strand segment extending at least partially around the waistband, the strand segment laying substantially parallel to surfaces of the cover layer and the base layer for a distance of at least five centimeters, and the strand segment being substantially centered between the edges of the cover layer for the distance of at least five centimeters;

a pair of leg regions for covering at least a portion of leg areas of the wearer; and wherein the cover layer is absent from areas not including the strand segment.

2. The article of apparel recited in claim 1, wherein the cover layer is formed from a thermoplastic polymer material.

3. The article of apparel recited in claim 2, wherein the strand segment is visible through the cover layer.

4. The article of apparel recited in claim 1, wherein at least one additional layer extends between the strand segment and the base layer.

5. The article of apparel recited in claim 1, wherein the base layer forms another portion of the exterior surface of the apparel.

6. The article of apparel recited in claim 1, wherein the strand segment is located in at least a rear area of the waistband.

7. The article of apparel recited in claim 1, wherein the strand segment crosses further strand segments in the waistband.

8. The article of apparel recited in claim 1, wherein the pelvic region defines at least one aperture located in a front area of the waistband, and a lace extends through the aperture, the lace being a separate element from the strand segment.

9. The article of apparel recited in claim 1, wherein the strand segment has a thickness less than two millimeters.

10. An article of apparel comprising:

a pelvic region for covering a pelvic area of a wearer, the pelvic region including a waistband for extending around a waist of the wearer, the waistband having:

a cover layer and a base layer that lay adjacent to each other, the cover layer being formed from a thermoplastic polymer material and defining a portion of an exterior surface of the apparel, and the base layer being located inward from the cover layer and forming another portion of the exterior surface of the apparel, and a plurality of strand segments located between the cover layer and the base layer, the strand segments laying substantially parallel to surfaces of the cover layer and the base layer for distances of at least five centimeters, and at least a portion of the strand segments being visible through the cover layer;

a pair of leg regions for covering at least a portion of leg areas of the wearer; and wherein the cover layer is absent in areas between the strand segments.

11. The article of apparel recited in claim 10, wherein the strand segments are visible through the cover layer.

12. The article of apparel recited in claim 10, wherein at least one additional layer extends between the strand segment and the base layer.

13. The article of apparel recited in claim 10, wherein the strand segments are located in at least a rear area of the waistband.

14. The article of apparel recited in claim 10, wherein the strand segments cross each other.

15. The article of apparel recited in claim 10, wherein the strand segments are portions of a single strand.

16. The article of apparel recited in claim 15, wherein a first portion of the strand segments are substantially parallel to each other, a second portion of the strand segments are substantially parallel to each other, and the first portion of the strand segments crosses the second portion of the strand segments.

17. The article of apparel recited in claim 16, wherein the first portion of the strand segments cross the second portion of the strand segments in a rear area of the waistband.

18. The article of apparel recited in claim 10, wherein the pelvic region defines at least one aperture located in a front area of the waistband, and a lace extends through the aperture, the lace being a separate element from the strand segments.

19. An article of apparel comprising:

a pelvic region for covering a pelvic area of a wearer, the pelvic region including a waistband for extending around a waist of the wearer, the waistband defining a front area, a rear area located opposite the front area, a first side area located between the front area and the rear area, and a second side area located opposite the first side area and between the front area and the rear area, and the waistband having:

an outer layer that forms at least a portion of an exterior surface of the waistband, the outer layer having an at least partially transparent configuration, and a plurality of strand segments located adjacent to the outer layer, the strand segments laying substantially parallel to a surface of the outer layer for distances of at least five centimeters, a first portion of the strand segments extending from the first side area to the rear area, and a second portion of the strand segments extending from the second side area to the rear area, the first portion of the strand segments crossing the second portion of the strand segments in the rear area;

a pair of leg regions for covering at least a portion of leg areas of the wearer; and wherein the outer layer is absent in areas between the strand segments.

20. The article of apparel recited in claim 19, wherein the pelvic region defines at least one aperture located in a front area of the waistband, and a lace extends through the aperture, the lace being a separate element from the plurality of strand segments.

21. The article of apparel recited in claim 19, wherein the strand segments are visible through the outer layer.

22. The article of apparel recited in claim 19, wherein the strand segments are portions of a single strand.

* * * * *